US006644749B2

(12) United States Patent
VanDeRiet et al.

(10) Patent No.: US 6,644,749 B2
(45) Date of Patent: Nov. 11, 2003

(54) OFFICE CHAIR

(75) Inventors: Douglas M. VanDeRiet, Holland, MI (US); Jeffrey R. Oberlin, Fruitport, MI (US)

(73) Assignee: Herman Miller, Inc., Zeeland, MI (US)

( * ) Notice: Subject to any disclaimer, the term of this patent is extended or adjusted under 35 U.S.C. 154(b) by 28 days.

(21) Appl. No.: 09/855,967

(22) Filed: May 15, 2001

(65) Prior Publication Data

US 2002/0109380 A1 Aug. 15, 2002

Related U.S. Application Data

(60) Provisional application No. 60/206,204, filed on May 22, 2000, provisional application No. 60/206,205, filed on May 22, 2000, and provisional application No. 60/206,457, filed on May 22, 2000.

(51) Int. Cl.[7] ..... A47C 7/02; A47C 7/54; A47C 3/04

(52) U.S. Cl. ..... 297/440.1; 297/440.14; 297/440.15; 297/440.22; 297/239; 297/411.26

(58) Field of Search ..... 297/440.1, 440.14, 297/440.15, 440.16, 440.2, 440.21, 440.22, 411.26, 411.29, 239

(56) References Cited

U.S. PATENT DOCUMENTS

| | | | | | |
|---|---|---|---|---|---|
| 3,095,236 | A | * | 6/1963 | Klassen | 297/239 |
| 3,111,344 | A | * | 11/1963 | Hoven et al. | 297/239 |
| 3,446,530 | A | | 5/1969 | Rowland | 297/239 |
| 3,708,202 | A | | 1/1973 | Barecki et al. | 297/239 |
| 3,814,474 | A | | 6/1974 | Baker et al. | |
| 3,982,785 | A | * | 9/1976 | Ambasz | 297/440.14 X |
| 4,118,069 | A | | 10/1978 | Hunter | |
| 4,240,663 | A | | 12/1980 | Locher | 297/239 |
| 4,318,570 | A | * | 3/1982 | Adam et al. | 297/440.1 |
| 4,570,994 | A | | 2/1986 | Lowrey | |
| 4,575,152 | A | | 3/1986 | McLaughin, Sr. | |
| 4,597,606 | A | | 7/1986 | Magee | |
| 4,900,085 | A | * | 2/1990 | Tobler | 297/44.15 X |
| 5,009,467 | A | * | 4/1991 | McCoy | 297/411.26 |
| 5,439,268 | A | | 8/1995 | Dozsa-Farkas | 297/411.26 X |
| 5,478,137 | A | | 12/1995 | Olson et al. | 297/411.26 |
| 5,599,068 | A | | 2/1997 | Kelly et al. | 297/239 X |
| 5,626,394 | A | | 5/1997 | Perry | 297/239 X |
| 5,630,643 | A | * | 5/1997 | Scholten et al. | 297/440.15 X |
| 5,662,381 | A | * | 9/1997 | Roosien et al. | 297/440.2 |
| 5,746,479 | A | | 5/1998 | Bodnar | 297/440.1 X |
| 5,782,536 | A | * | 7/1998 | Heidmann et al. | 297/440.15 |
| 5,961,184 | A | * | 10/1999 | Balderi et al. | 297/440.15 |
| 6,027,169 | A | * | 2/2000 | Roslund, Jr. | 297/440.22 |
| 6,095,603 | A | * | 8/2000 | Hock | 297/440.14 X |
| 6,109,696 | A | * | 8/2000 | Newhouse et al. | 297/440.2 |
| 6,224,160 | B1 | * | 5/2001 | Takeuchi et al. | 297/440.15 |

* cited by examiner

*Primary Examiner*—Rodney B. White
(74) *Attorney, Agent, or Firm*—Brinks Hofer Gilson & Lione

(57) ABSTRACT

A modular arm rest system for a chair. The arm rest includes a connecting member that is installed into an interior cavity in the chair frame and is retained by a nose. A back is also provided with an arm rest hole that the connecting member can be installed through, thereby securing the back to the chair frame. The modular system includes a reclining chair and a four-legged stacker chair with arm rests and plugs so that the chairs can be reconfigured as desired by the user.

48 Claims, 31 Drawing Sheets

OFFICE CHAIR

This application claims the benefit of U.S. Provisional Application No. 60/206,204, filed May 22, 2000, U.S. Provisional Application No. 60/206,205, filed May 22, 2000, and U.S. Provisional Application No. 60/206,457, filed May 22, 2000.

FIELD OF THE INVENTION

The present invention relates generally to chairs, and more particularly, to an arm rest system.

BACKGROUND OF THE INVENTION

An office chair is a well-known piece of furniture that allows a user to comfortably sit in the chair while performing various work tasks. Manufacturers of office chairs have always faced a difficult task when trying to produce an office chair that will be suitable for a broad variety of different people. One reason for this difficulty is that users of chairs vary greatly in their relative size and proportions. The heights of users, for example, can vary significantly, with some users being taller while others are shorter, and some users having longer trunk proportions while others have longer leg sections. In addition, the size of users varies, with some being larger while others are smaller. Another difficulty that manufacturers must consider is the wide variety of tasks that different users perform in their office chairs. Although many users perform similar tasks in their chair like working on a computer, writing at a desk, or reading documents, the work environment and the type of individual user can vary greatly. For example, the tasks performed while sitting in a chair can differ considerably between workers in a factory, a home-office, or at an administration center. Different types of users, like executive workers and staff workers, also have different requirements for their chair.

Notwithstanding these difficulties, the most difficult issue that manufacturers must confront is the various preferences of individual users. Seldom do the individual preferences of different users coincide exactly. Often a user will generate strong personal opinions about an office chair as a result of the long periods of time in which the user sits in the chair and the direct intimate contact that the user has with the chair. To a large extent, manufacturers have been forced to address this wide range of personal preference by providing many different chair designs so that different users can choose a chair that satisfies their particular preferences. At the same time, manufacturers strive for designs which are cost effective to produce and which will satisfy as many users as possible.

One preference that all users share is a desire for an office chair that is comfortable. One feature that chair manufacturers often include to make a chair more comfortable is a tilt mechanism. This mechanism allows the back of the chair to recline rearward when the user applies pressure with his upper body to the back of the chair. This allows the user to relax in a more laid back, fully supported position. Typically, a range of about 20° of rearward travel is commonly provided, with a constant amount of pressure required to recline the back throughout the travel range.

One reclining system that is commonly used for office chairs involves a single pivot between the stem of the chair and the seat and back assembly. Typically, the pivot is located beneath the seat and behind the front edge of the seat. In this system, the seat and the back are rigidly attached to each other so that the back is oriented approximately 90° in a vertical direction from the seat. A spring is then provided to bias the seat and back assembly forward into an unreclined position in which the seat is approximately horizontal to the floor and the back is approximately vertical. When the user applies pressure to the back of the chair, the pivot and spring allow the seat and the back to rotate rearwardly together around the pivot. Some users find this reclining system undesirable, however, because of the rigid attachment of the seat and the back. One especially undesirable result of this reclining system is that the front edge of the seat moves upward as the back is reclined. Because the seat and the back are rigidly attached to each other, the rotating movement of the seat and back assembly around the pivot causes the front edge of the seat to move upwards from its unreclined position. This upward movement places pressure on the underside of the user's legs and can lift the user's legs slightly off the floor.

To resolve this problem of seat movement during reclining, other chairs provide a fixed placement of the seat. The back is then reclined rearward independently of the seat. These systems, however, produce friction and pulling between the back of the chair and the user's upper body because the back generally travels along a different angular rotation than the user's upper body. As a result, the user usually feels an upward pulling on his clothes as he reclines.

A more desirable reclining system allows the seat to move during reclining, but at a different rate of travel than the back. One challenge in designing these types of reclining systems is achieving an optimal balance between the seat movement and back travel during reclining. The system must also be cost effective and simple to manufacture. One desirable way to reduce the cost of a reclining system is to minimize the number of parts that are required in the assembly. In addition, another way to reduce costs is to design the reclining system so that it is easy to assemble. This ease of assembly has become increasingly important recently as chair manufacturers have begun to ship chairs unassembled directly to end users. Thus, the reclining system should be capable of being assembled without needing numerous special tools. Finally, the reclining system must be durable so that it can survive over a long lifetime without failure in a variety of work environments.

One problem with some reclining systems is that the leverage applied to the main spring changes as the back is reclined rearward. For example, in some systems a greater amount of leverage is applied when the back is reclined rearward than when the back is upright. This results in the user feeling less support from the back the further the user reclines rearward. To compensate for this characteristic, some chairs have provided assist springs to supplement the reclining pressure provided by the main spring. The assist springs, however, must be cost effective and simple to install. Desirably, the assist springs can be integrated into the reclining system without a significant number of special features required to add the assist springs.

Another feature that manufacturers commonly provide on office chairs to improve comfort is a height adjustment system for the seat and the back. This feature is especially important because the length of different users'legs varies greatly. Generally, users prefer to adjust the height of their chair so that their feet rest flat on the floor and their upper legs are parallel to the seat. Often, however, a chair is used by a variety of different people, who each have their own preferred height for the seat. This is especially true of chairs that are shared by many people, such as conference room chairs. Because the height of these chairs must be changed frequently by many different people, the adjustment system should be capable of being changed quickly without requiring time consuming adjustments. The height adjustment system should also be simple to operate so that temporary users will be able to quickly learn how to change the height of the seat without becoming confused.

Commonly, office chairs have included adjustable cylinders in the stem of the chair to provide the desired height adjustment. These cylinders generally employ a valve stem that is oriented horizontally, or parallel, to the floor. Thus, in order to release the cylinder to allow the height of the chair to be adjusted, an actuating system is provided that actuates the horizontal valve stem upward and downward. However, in these systems the vertical positioning of the actuating system in relation to the horizontal valve stem is usually quite critical. This typically makes the manufacturing and assembly of the height adjustment system more expensive and complicated. The manner of using these systems can also become complicated, thus confusing the user as he attempts to adjust the height of the chair.

Generally, reclining systems provide the desired reclining pressure to the back with a spring that is increasingly stressed as the back is reclined rearward. Because individual users commonly prefer different amounts of reclining pressure, manufacturers typically provide a spring adjustment system that can be used by the user to increase or decrease the amount of reclining pressure. The spring adjustment system usually includes a screw that can be turned by the user, thereby moving a spring guide that increases or decreases stress in the spring. Generally, manufacturers install the spring into the reclining system with a small amount of initial stress introduced into the spring when the adjusting screw is turned to the lowest pressure setting. Therefore, the user is prevented from relieving the entire stress in the spring when the adjusting screw is turned. This preload stress is desirable because an unstressed spring will tend to rattle in the reclining system when the chair is moved about. The back of the chair will also be loose and will flop in the upright position between the forward stop and the spring. In addition to these problems, some spring adjustment systems require a minimum amount of spring pressure at all times in order to function properly.

Typically, manufacturers introduce the preload stress into the spring either manually or with special tools while the spring is being installed into the reclining system. Thus, in the case of some spring assemblies, a force as high as 100 lbs may need to be applied to compress the spring during installation. This combined procedure of compressing the spring while simultaneously installing the spring into the reclining system can become quite difficult and time consuming. This procedure is also undesirable for chairs that are shipped unassembled directly to end users who may not have the special tools necessary to install the spring with the necessary preload stress. Thus, a system for easily introducing an initial preload stress into the spring is desirable.

To provide further comfort for the user, manufacturers often provide arm rests on the chair so that the user can conveniently rest his forearms. Other users, however, prefer not to have arm rests on their chairs because the arm rests can obstruct the sides of the chair and can interfere with free movement into or out of the chair. Chairs without arm rests are also preferred to save costs when the chair will be used infrequently.

Thus, a modular arm rest system is desirable to allow chairs to be provided with or without arm rests. Desirably, this system would include a reclining chair and a four-legged stacker chair. A modular arm rest system such as this could increase the number of chair configurations possible and could minimize costs by using common components or components with similar functions. The arm rest system, however, must provide a rigid, secure attachment to the chair frame in order to satisfy the user's expectations of quality. In addition, the arm rest system should be simple and easy to install to allow users to install or remove the arm rests themselves. Finally, an arm rest system that allows users to reconfigure a chair later after initial assembly of the chair would be preferred.

One area of the chair that has a significant impact on a user's satisfaction with the chair is the seat. The seat is the surface upon which the user rests his buttocks, and as such, the seat directly influences the overall comfort of the chair. Generally, users prefer a seat that is soft, yet supportive. In addition, seats that provide increased aeration through the seat surface tend to be more comfortable.

One type of seat that has been used is a fabric seat that is supported around the circumference by a seat frame. In this type of seat, the fabric is a membrane designed to provide increased aeration. Typically, these seats have been manufactured in an integrated molding operation, in which the outer edges of the fabric are secured to the seat frame by being molded into the seat frame. However, this manufacturing technique can be expensive and requires special manufacturing equipment that is not always readily available. Thus, a low cost fabric seat is desirable.

SUMMARY OF THE INVENTION

Accordingly, a modular arm rest system is provided that increases the number of chair configurations available to the user. The arm rest system also reduces costs by using components that are common between several chairs and components with similar functions. Preferably, the arm rest system includes a reclining chair and a four-legged stacker chair. In addition, the system should include both arm rests and plugs so that the chairs can be configured with or without arm rests.

The connecting system includes a connecting member that is installed into an interior cavity in the chair frame. The arm rest or plug is then securely retained by a nose. Preferably, the nose is either a set screw or a detent assembly. A common back is also provided that can be used on both the reclining chair and the stacker chair. The back includes an arm rest hole through which the connecting member can be installed, thereby securing the back to the chair frame. Preferably, the connecting system is easily attached and detached so that users can reconfigure the chairs.

BRIEF DESCRIPTION OF SEVERAL VIEWS OF THE DRAWINGS

The invention, including its construction and method of operation, is illustrated more or less diagrammatically in the drawings, in which.

DETAILED DESCRIPTION

Reclining System

Figure 1:
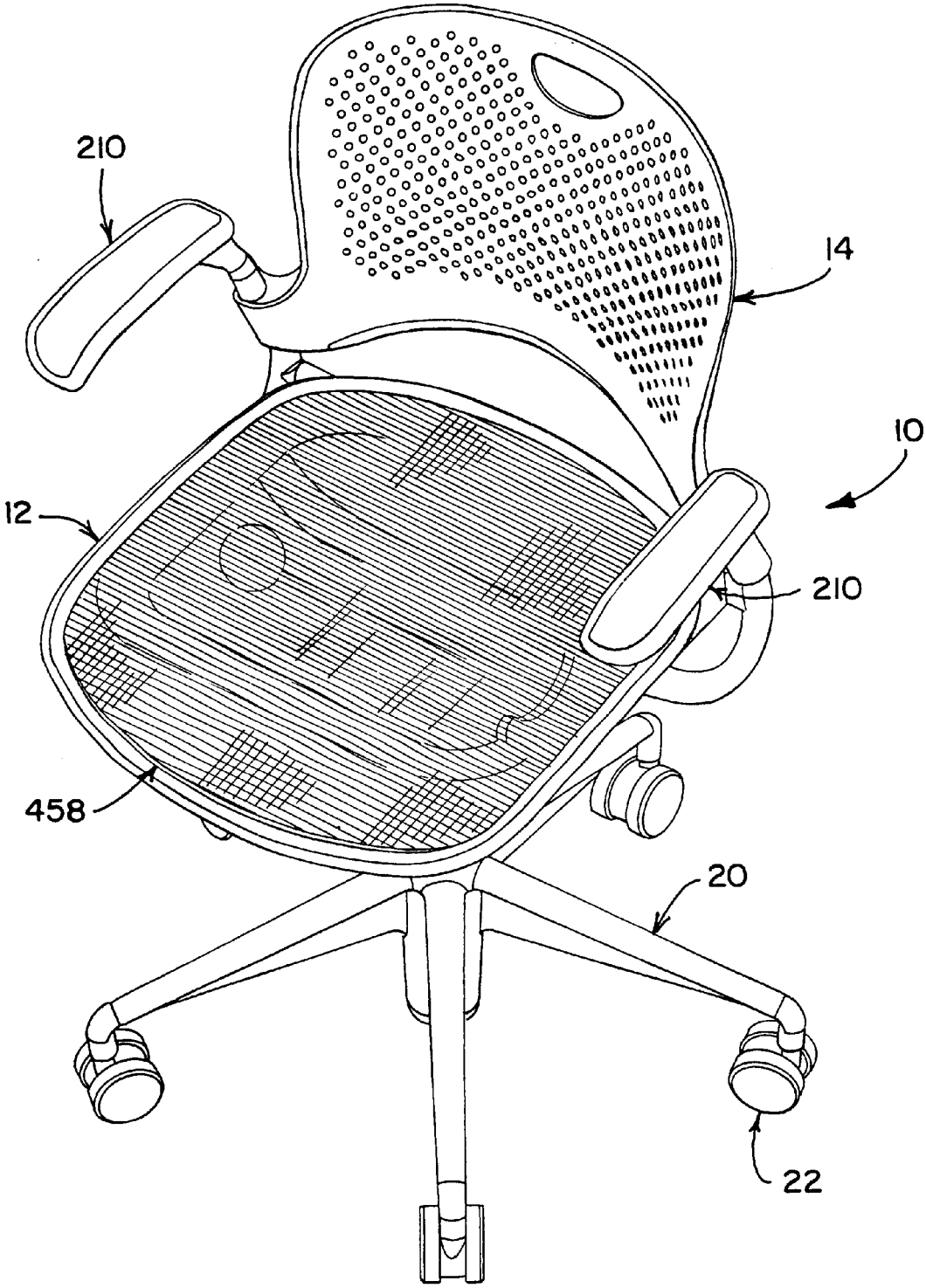
FIG. 1 is a perspective view of a task chair, showing a set of task chair arm rests installed and a fabric seat installed.

Turning now to the drawings, and particularly to FIG. 1, there is shown an office chair 10. A user sits in the office chair 10 by resting his upper legs and buttocks on the seat 12 of the chair 10. Although a variety of different seats can be used, a seat 12 like that disclosed below can be used. The user's legs extend down along the front of the chair 10 so that his feet are flat on the floor. In order to rest the user's upper body, the user can lean rearward and relax the back side of his upper body against the back 14 of the chair 10. Arm rests 210 are also provided so that the user can relax his arms on top of the arm rests 210. Although arm rests are not needed, and many styles of arm rests can be used, arm rests 210 like those disclosed below can be used. The seat 12 is supported along its underside by a chair stem assembly 18, and stability is provided by a number of legs 20 that rest on the floor. Casters 22 are provided on the bottom of the legs 20 to allow the chair 10 to be easily moved from place to place. Flat floor pads, however, could also be used in place of the casters 22.

Figure 2:
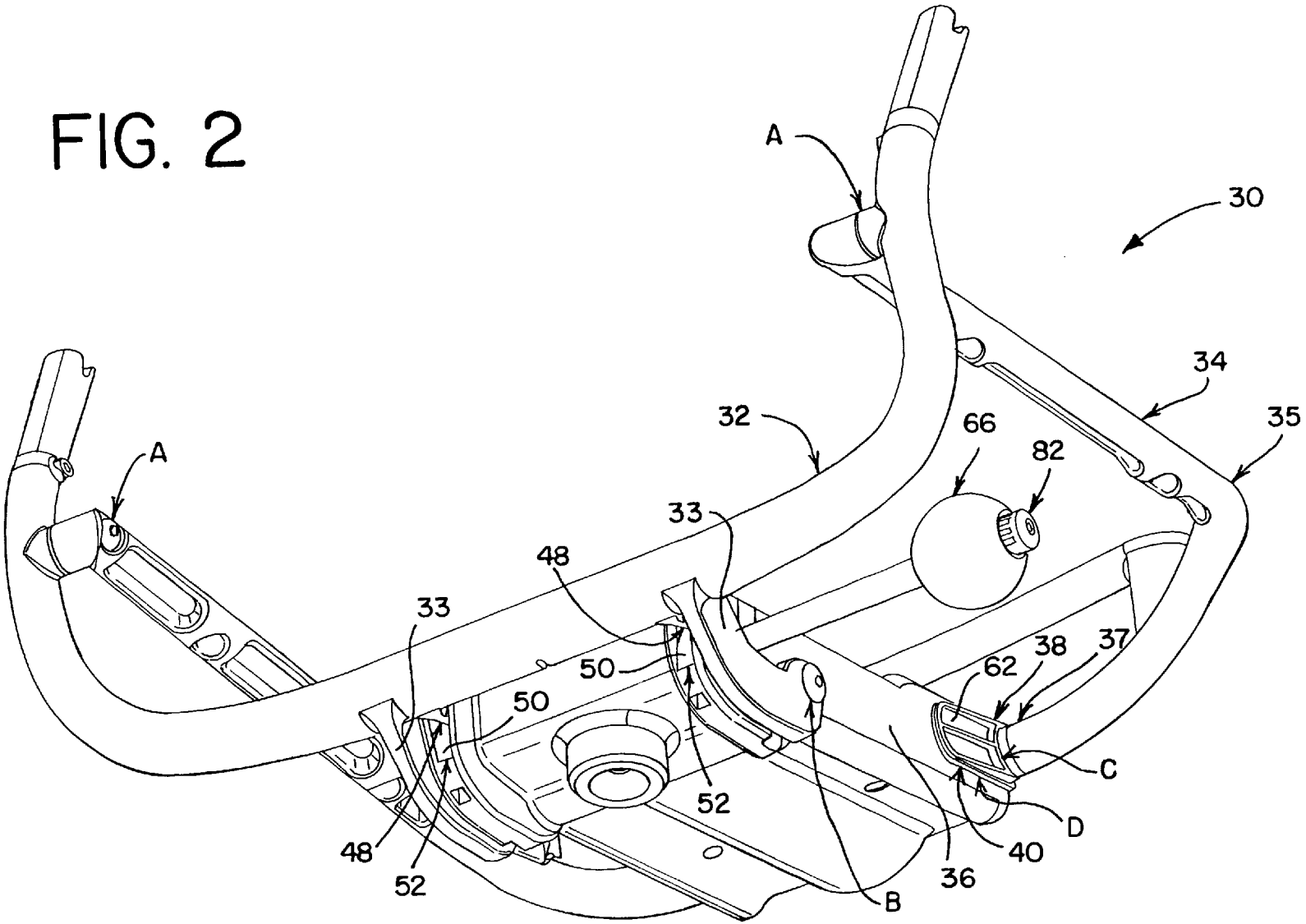
FIG. 2 is a perspective view of a frame assembly.
Figure 3:
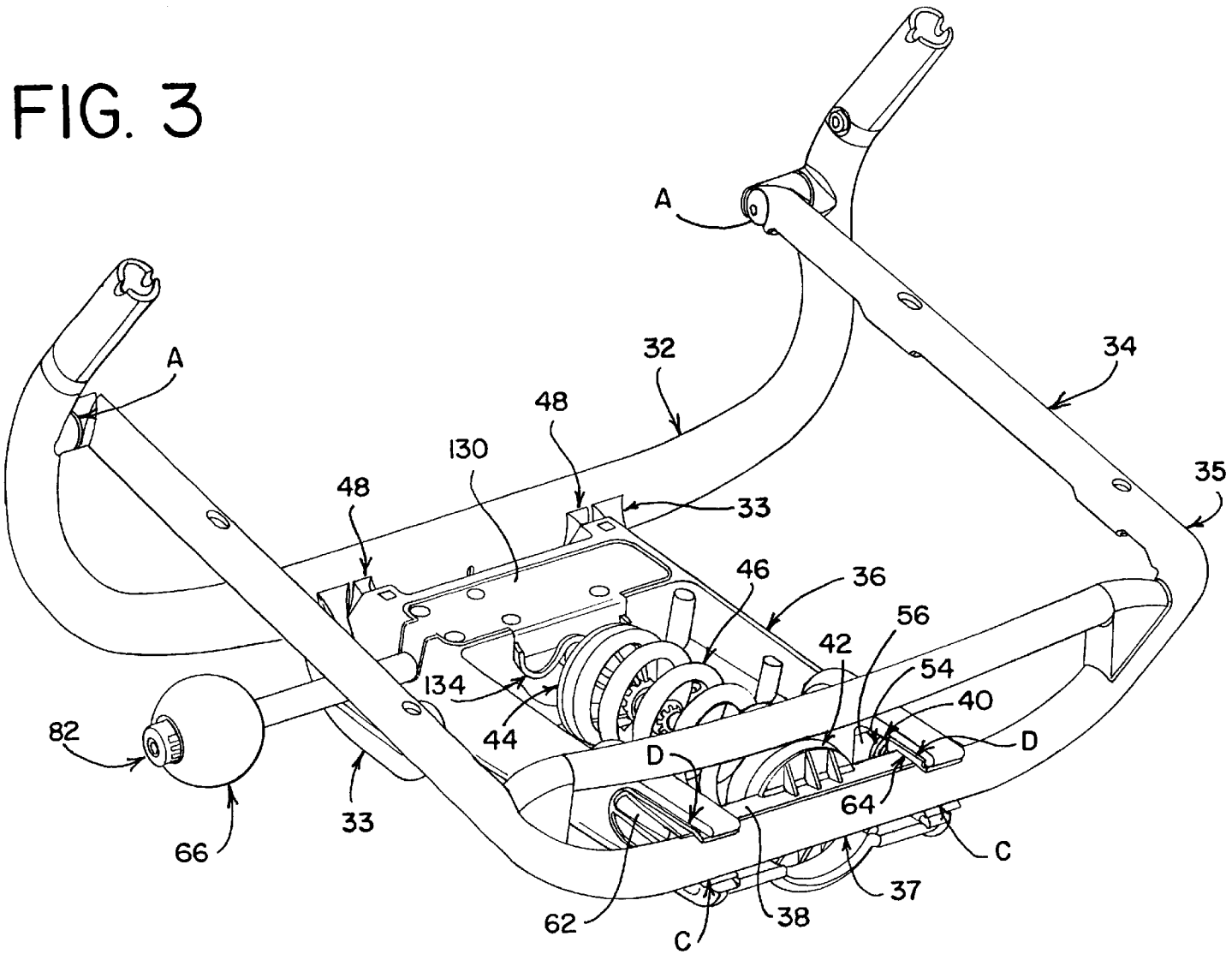
FIG. 3 is a perspective view of the frame assembly.
Figure 4:
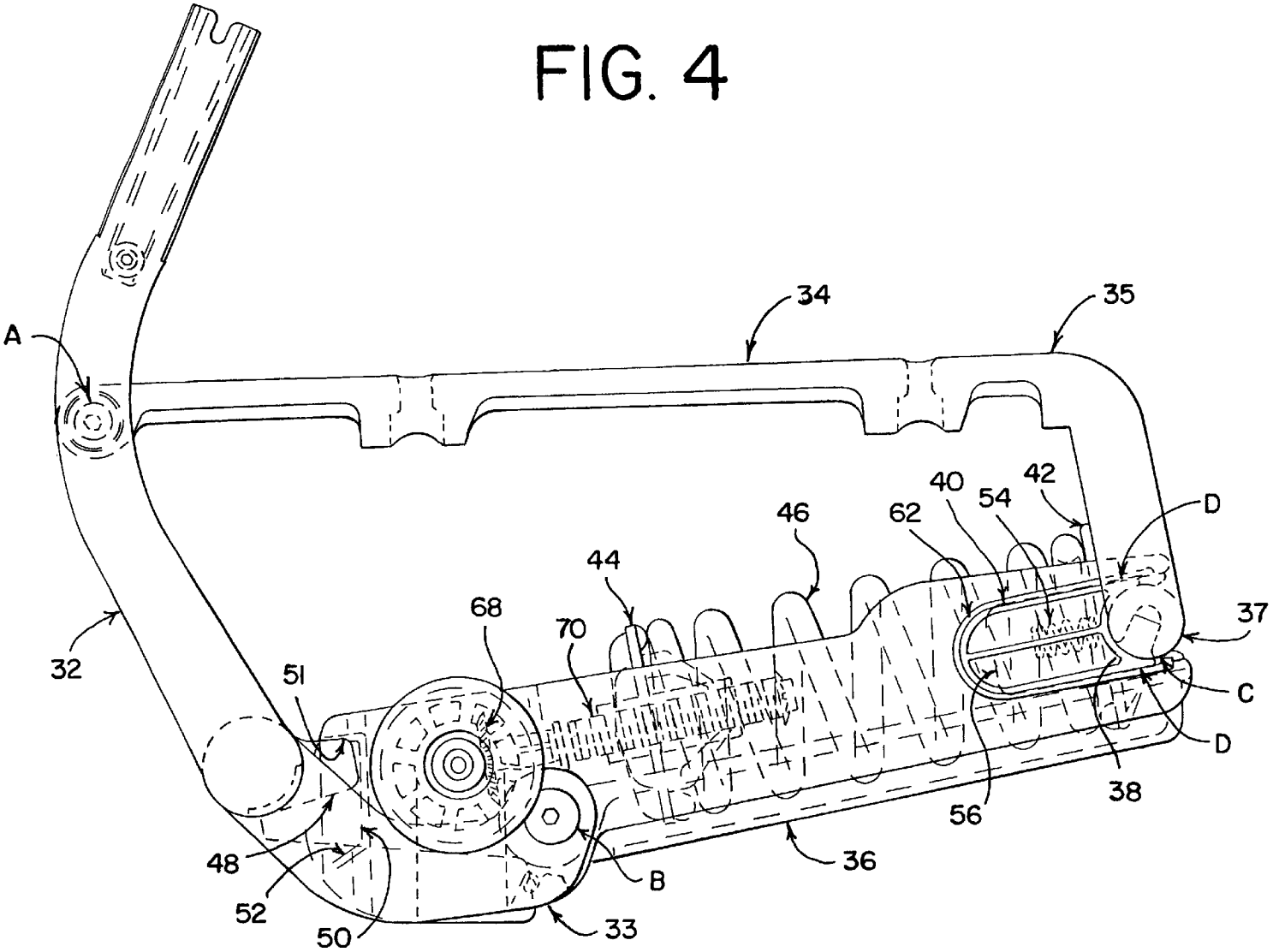
FIG. 4 is a side elevational view of the frame, showing the hidden internal components.

Turning now to FIGS. 2 through 4, the frame assembly 30 of the chair 10 is a multi-member linkage 30 that allows the back 14 and the seat 12 to recline at different angles.

Accordingly, a yoke 32, or first member 32, is provided, which is rigidly attached to the back 14. The yoke 32 extends downward from the back 14 and below the seat 12. Along the bottom side of the yoke 32, two extended arms 33 are rigidly attached to the yoke 32. The extended arms 33 pivotally attach B the yoke 32 to the base 36, or third member 36, along the rear end of the base 36. The yoke 32 is pivotally attached A to the seat support 34, or second member 34, which is rigidly attached to the seat. Along the front side of the seat support 34, the seat support 34 is pivotally mounted C through an axle 37 to the bearing guide 38, or fourth member 38. The axle 37 is an integral portion of the seat support 34 and extends across the width of the base 36. The bearing guide 38 is slidably connected to the base 36 through a fore-aft slot 40, or pocket 40, in the base 36. To ease assembly, the slot 40 is open at the forward end to receive the bearing guide 38 and the axle 37.

This multi-member linkage 30, therefore, results in a seat travel that is different than the reclining angle of the back 14. It can be seen from FIG. 4 that as the back 14 is reclined rearward, the pivot connection A between the yoke 32 and the seat support 34 will move downwards. At the same time the front end 35 of the seat support 34 will remain at approximately the same height while moving rearward along the bearing guide slot 40. The rearward movement of the bearing guide 38 correspondingly forces the front spring guide 42 rearward, which compresses the main spring 46 and provides the desired reclining pressure. Various main springs are possible, but the preferred embodiment includes a spring with a spring rate of 310 lb/in. The reclining angle is restricted between an upright position and a reclined position by two stops 48 that are rigidly attached to the bottom side of the yoke 32. The stops 48 extend into slots 50 in the rear end of the base 36. Thus, when no pressure is exerted by the user against the back 14, the main spring 46 forces the yoke 32 forward through the seat support 34, and the stops 48 limit this forward movement by abutting against the top side 51 of the slots 50. On the other hand, when the user exerts full pressure on the back 14, the yoke 32 will rotate rearward compressing the main spring 46 until the stops 48 abut against the bottom side 32 of the slots 50.

Figure 5:
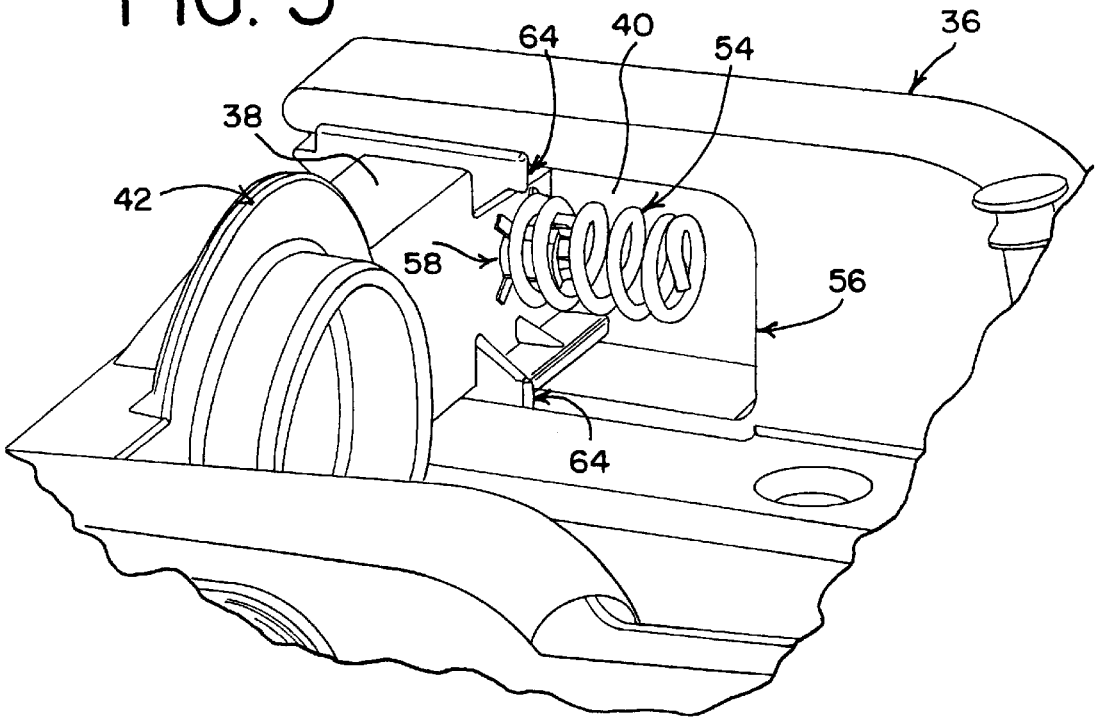
FIG. 5 is a perspective view of the frame assembly, showing an assist spring.
Figure 6:
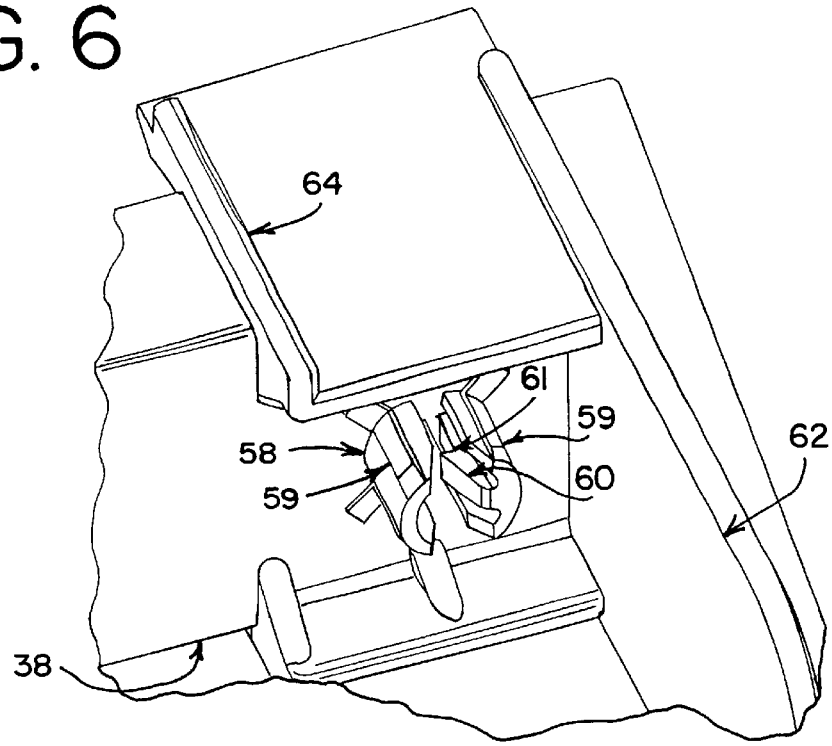
FIG. 6 is a perspective view of a bearing guide, showing a mount for the assist spring.
Figure 6A:
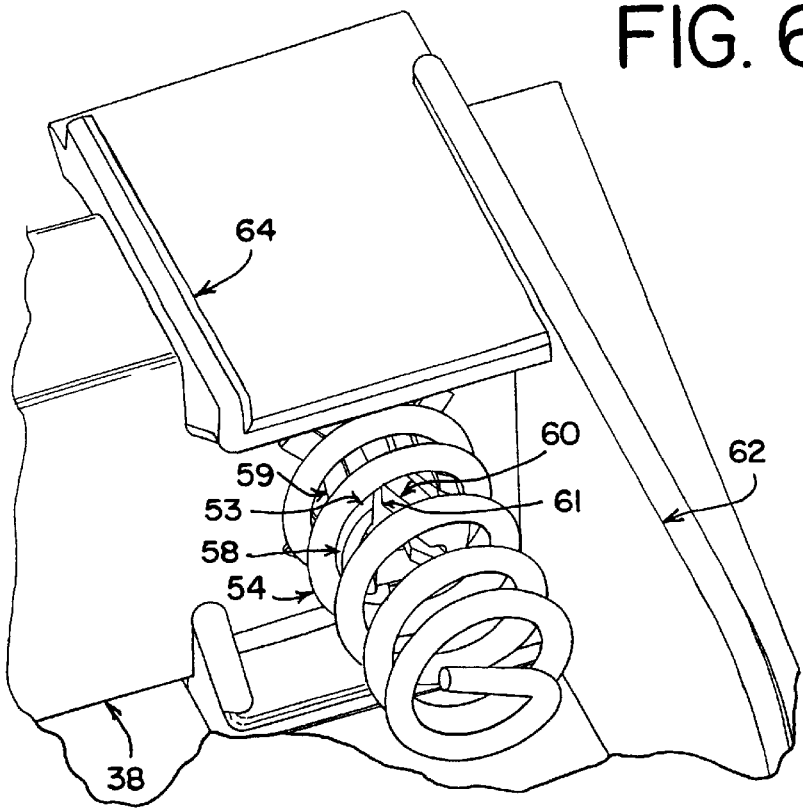
FIG. 6*a* is a perspective view of the bearing guide, showing the assist spring attached to the mount.
Figure 7:
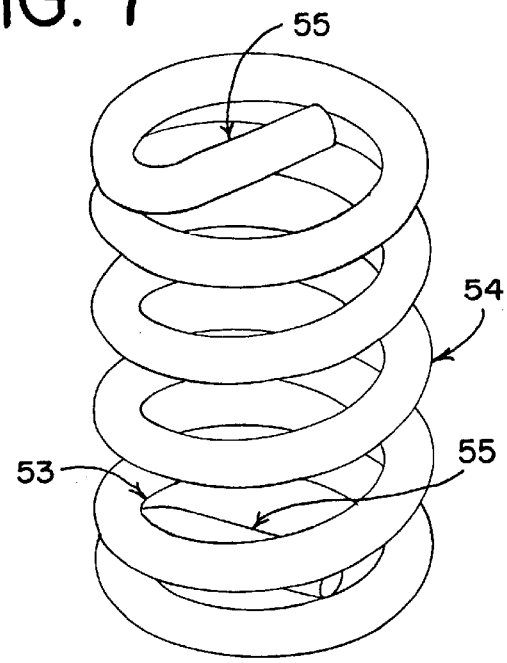
FIG. 7 is a perspective view of the assist spring.
Figure 8:
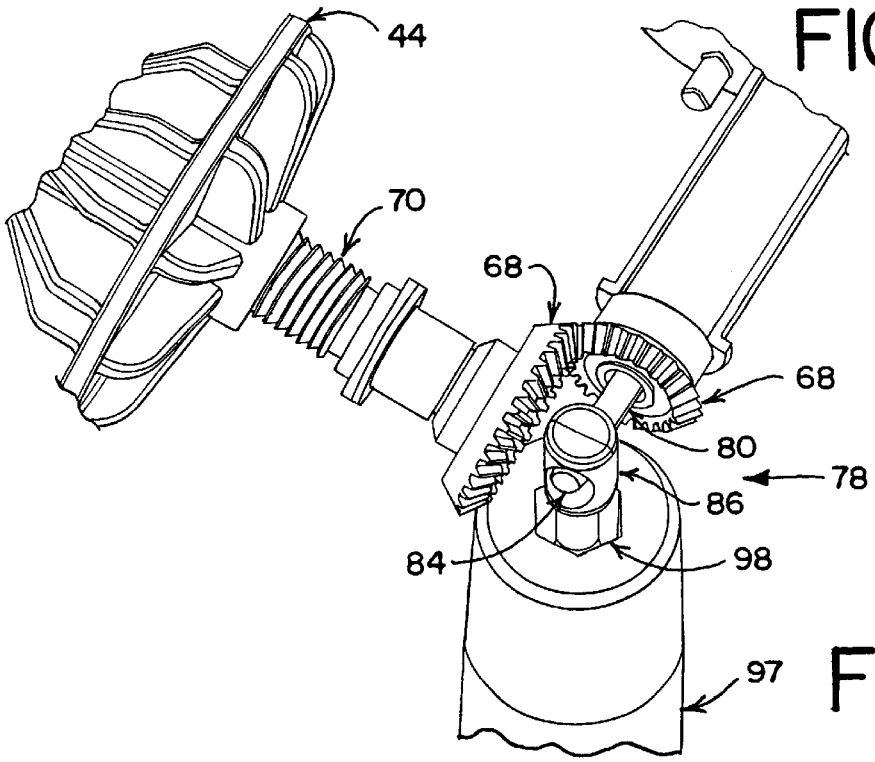
FIG. 8 is a perspective view of a height adjustment mechanism.
Figure 10:
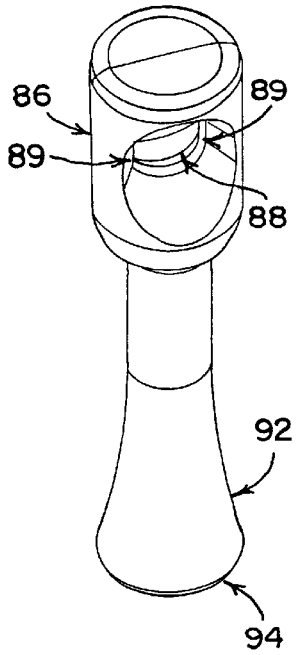
FIG. 10 is a perspective view of the actuating member.
Figure 9:
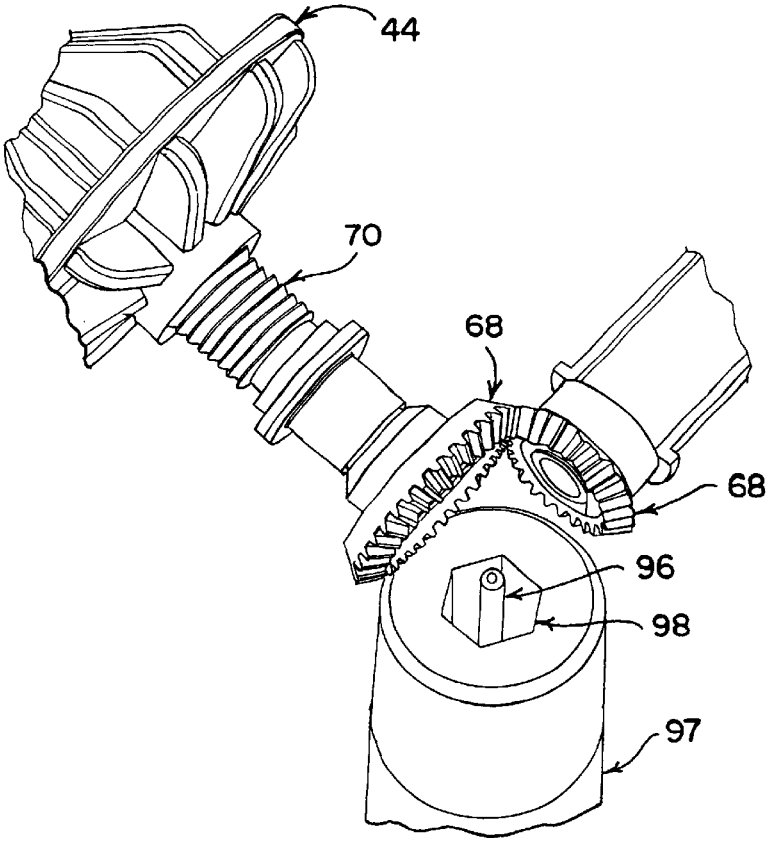
FIG. 9 is a perspective view of the height adjustment mechanism, with an actuating member and an actuating stem excluded to show a valve stem.
Figure 11:
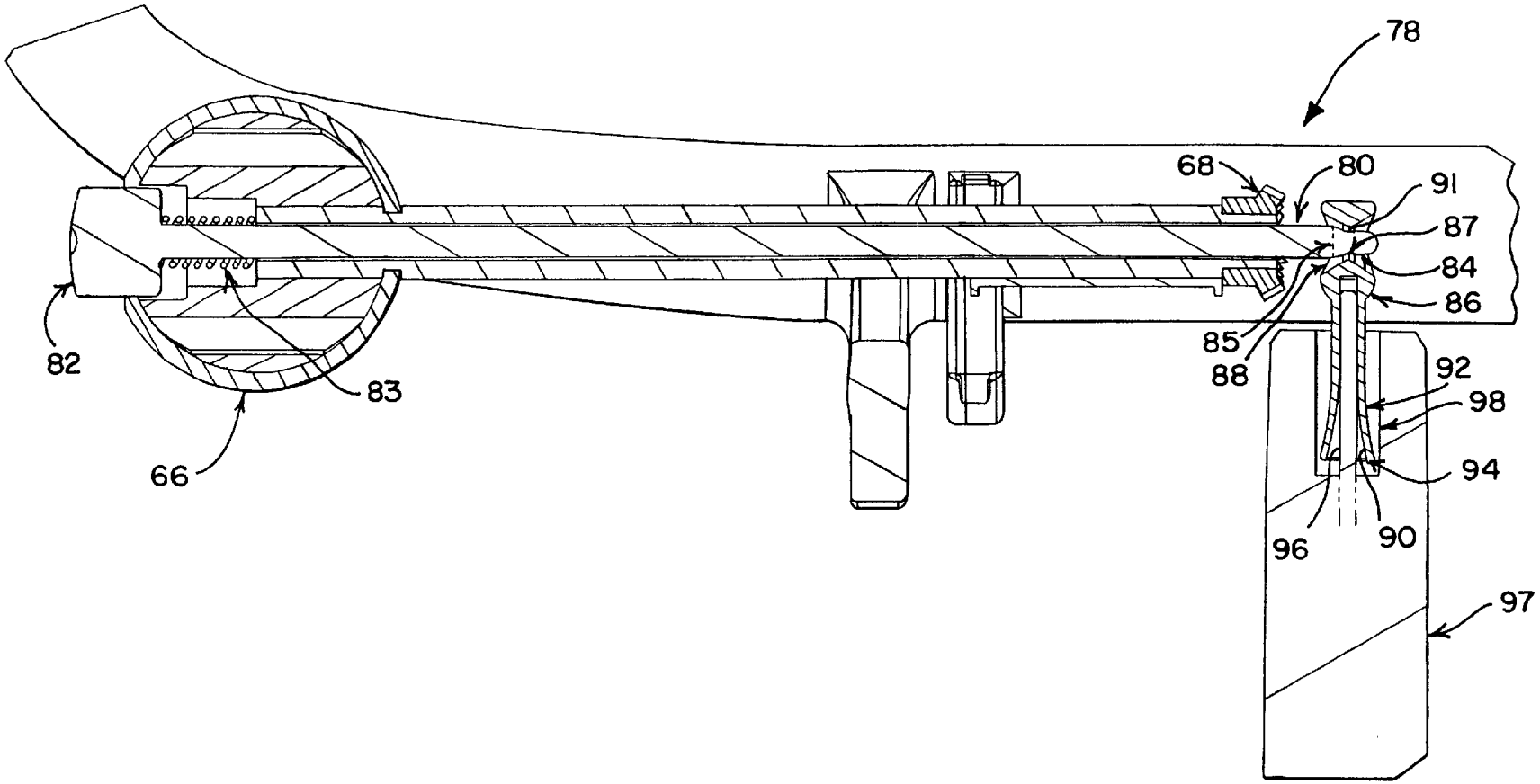
FIG. 11 is a cross-sectional view of the height adjustment mechanism.
Figure 12:
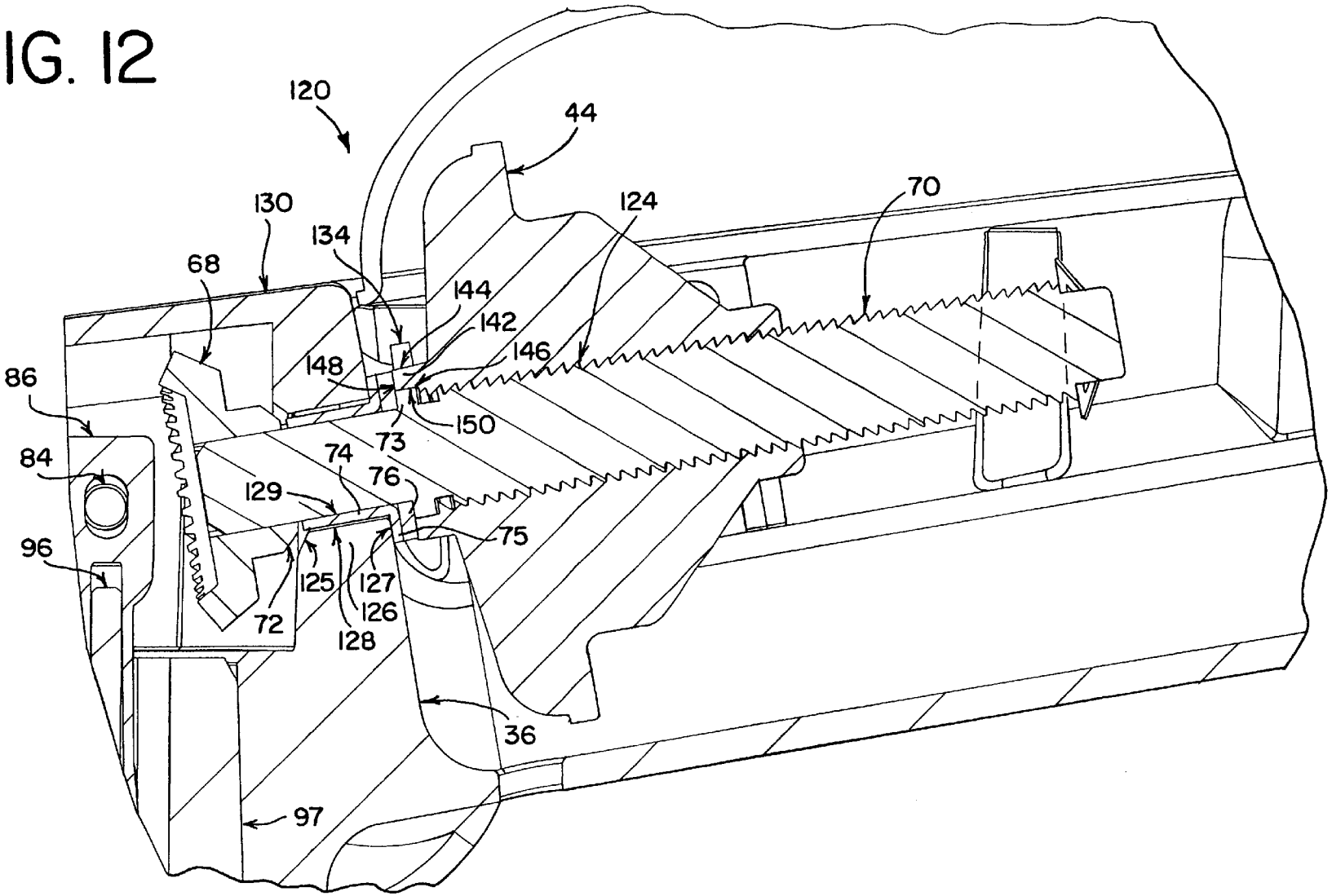
FIG. 12 is a cross-sectional view of a spring preload system, showing a spring guide adjusted to its rear-most position.
Figure 12A:
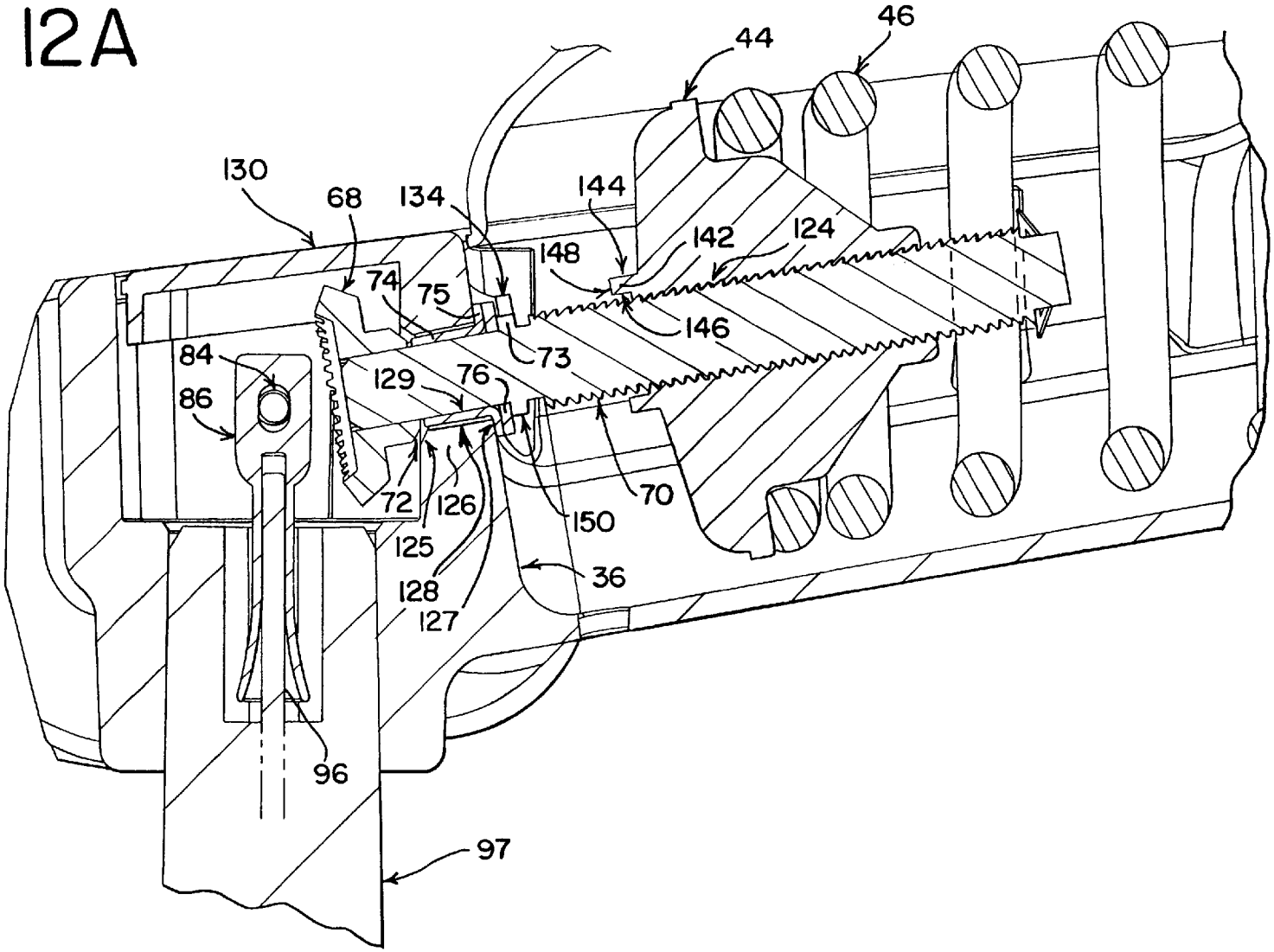
FIG. 12*a* is a cross-sectional view of the spring preload system, showing the spring guide adjusted forward of its rear-most position.
Figure 13:
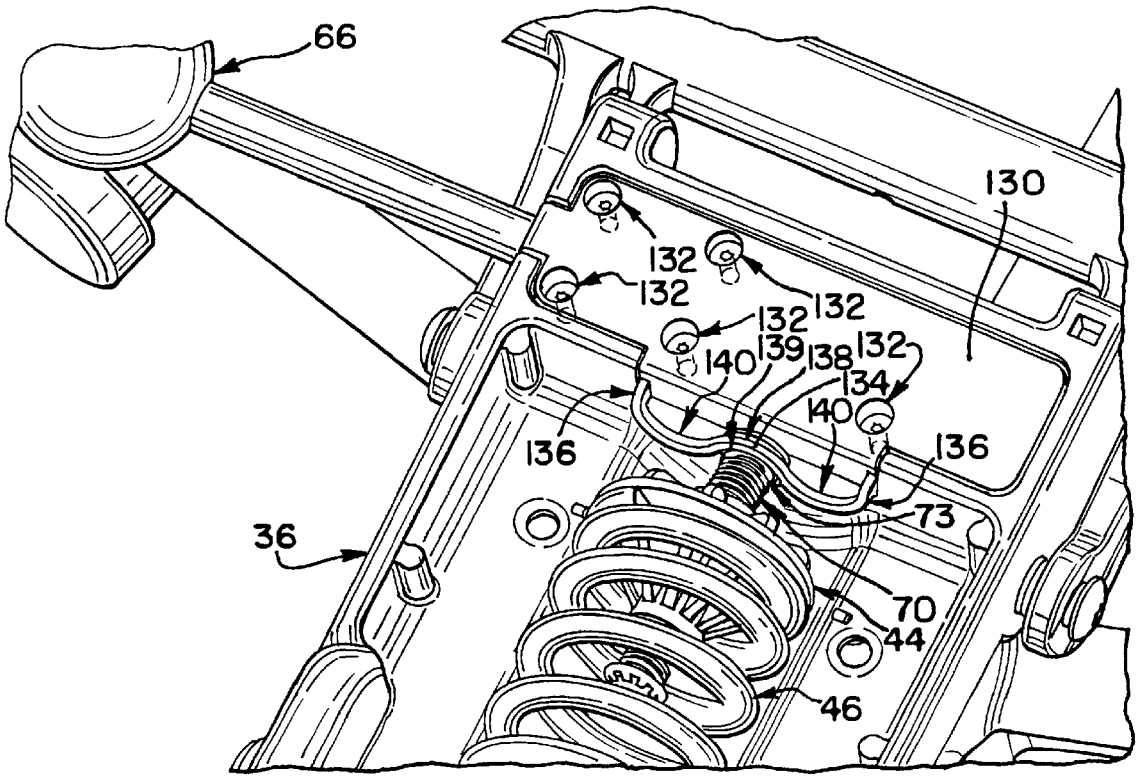
FIG. 13 is a perspective view of the spring preload system.
Figure 14:
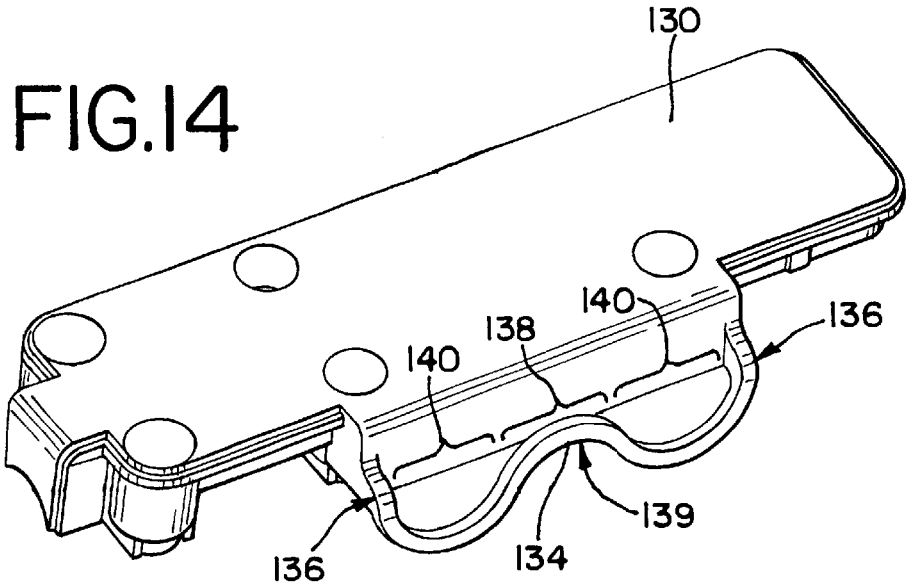
FIG. 14 is a perspective view of a preload member attached to a cover.
Figure 15:
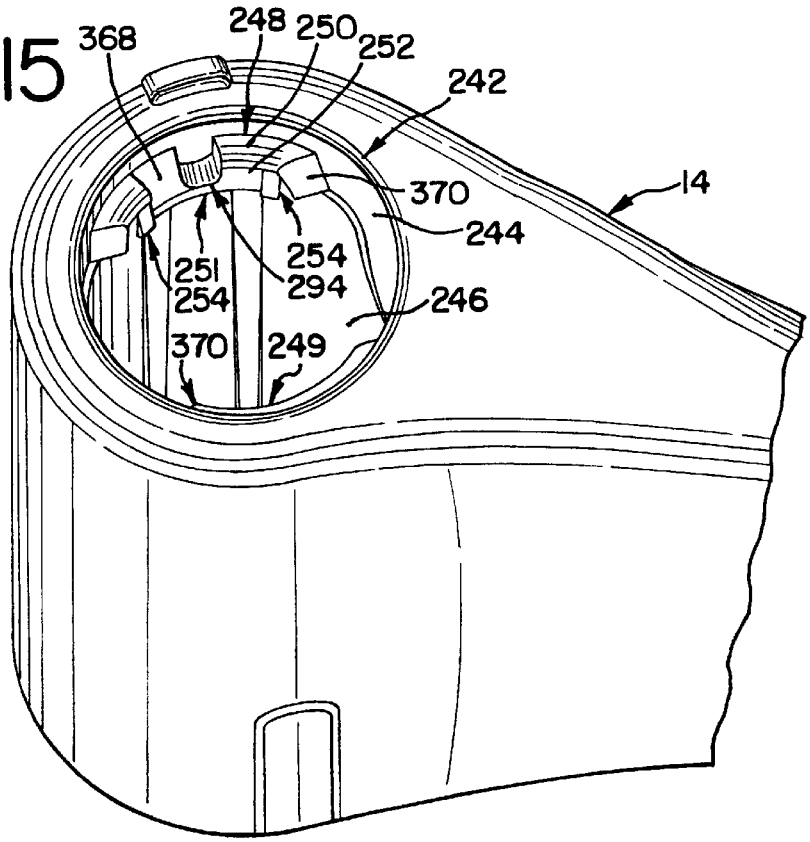
FIG. 15 is a perspective view of a back, showing the top side of a hole for an arm rest.
Figure 16:
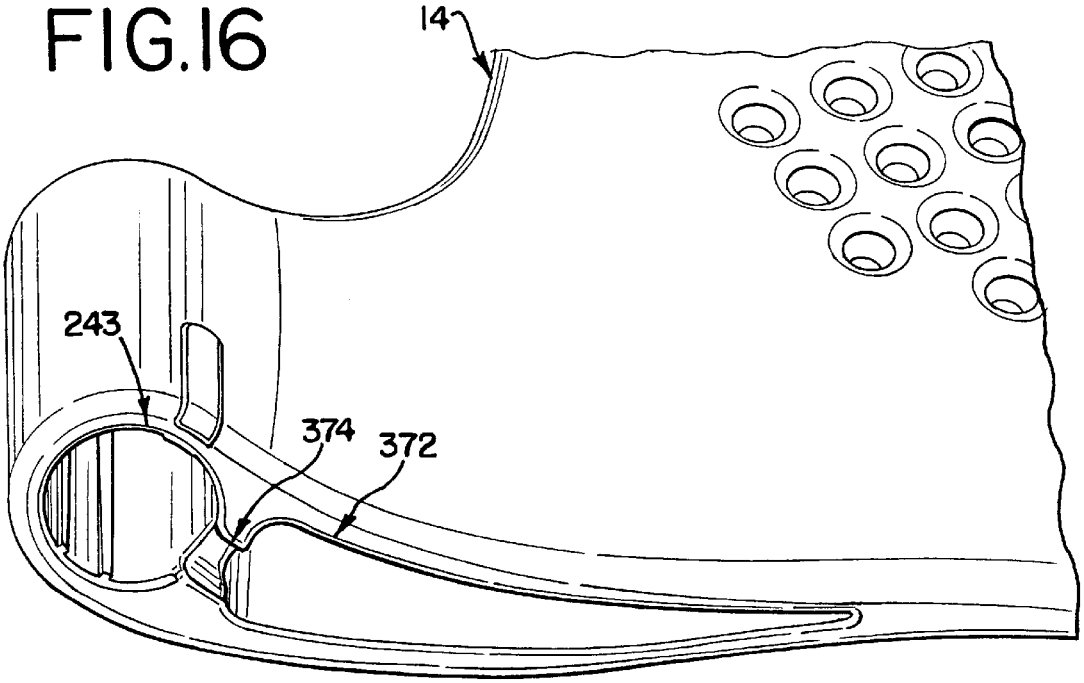
FIG. 16 is a perspective view of the back, showing the bottom side of the hole for an arm rest.
Figures 17, 18:
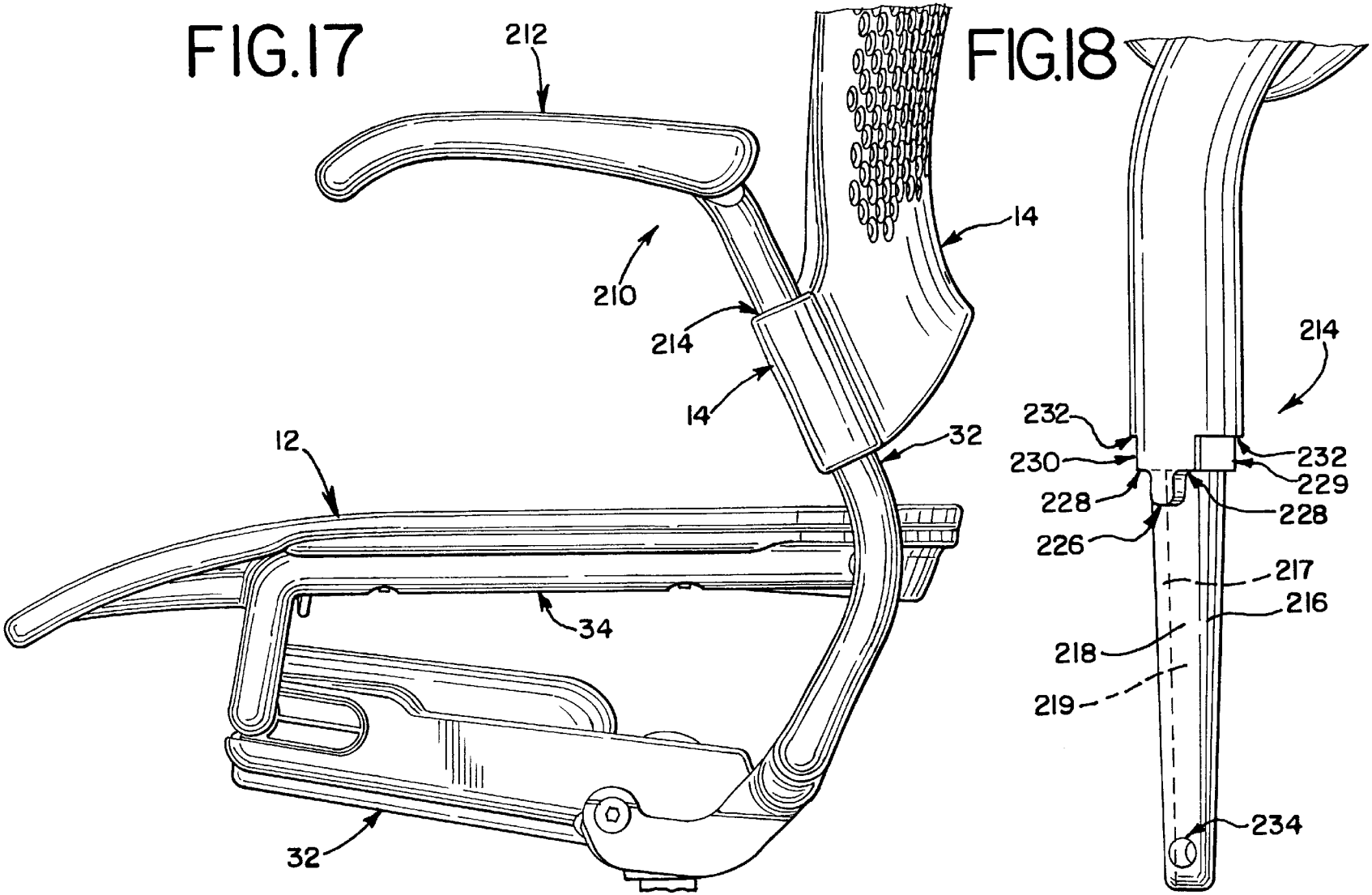
FIG. 17 is a side elevational view of the task chair, showing a task chair arm rest installed.
FIG. 18 is a perspective view of the task chair arm rest, showing a connecting member.
Figure 20:
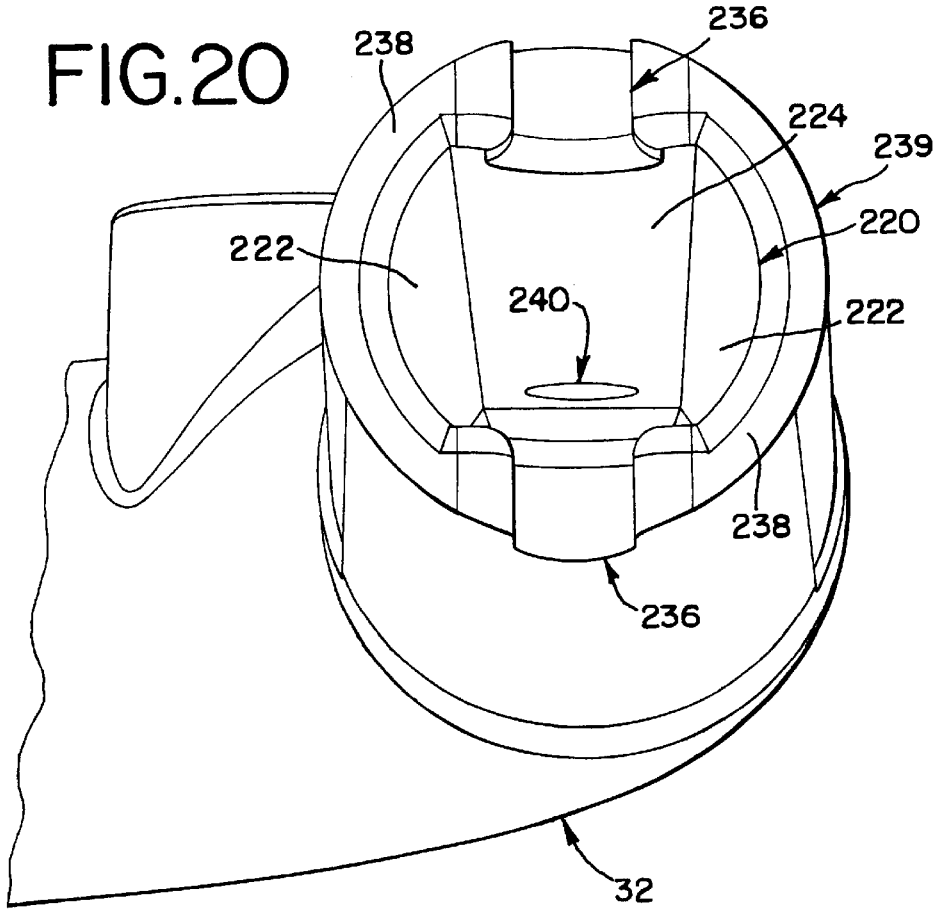
FIG. 20 is a perspective view of the task chair yoke, showing an interior cavity.
Figure 21:
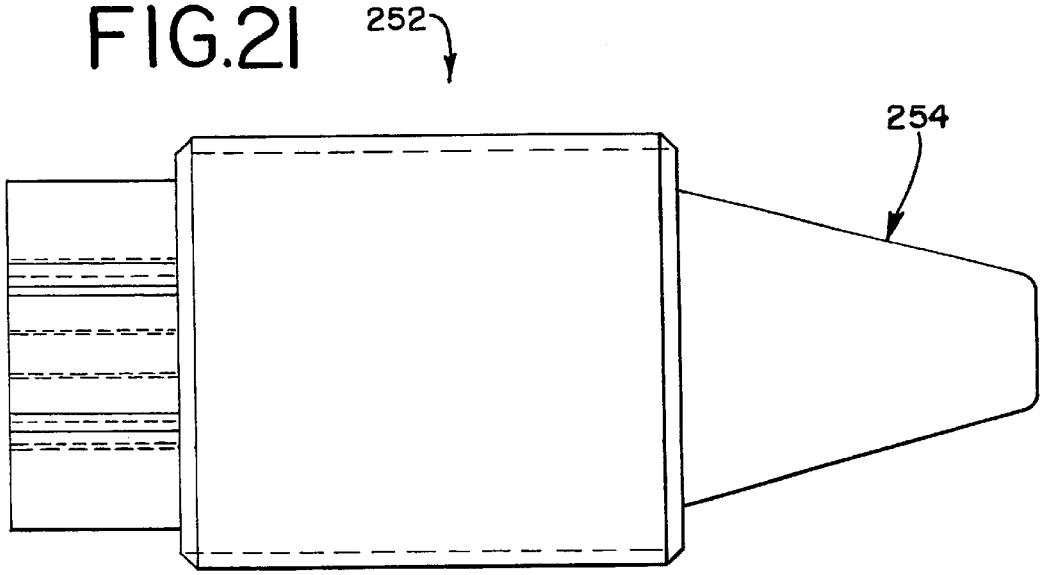
FIG. 21 is a side elevational view of a set screw.

Turning now also to FIGS. 5, 6*a,* and 7, assist springs 54 have been provided to increase the reclining pressure as the back 14 is reclined rearward. The assist springs 54 compensate for the increased leverage that is exerted on the main spring 46 as the back 14 is reclined at higher angles. One characteristic of the multi-member linkage 30 previously described is that the linkage 30 displaces the main spring 46 a decreasing amount the further rearward the back is reclined. Thus, the user will feel less resistance, or support, from the back 14 the further rearward the user reclines. However, many users prefer a more constant amount of support. The assist springs 54, therefore, improve this characteristic of the multi-member linkage 30 by engaging at an intermediate position, or about halfway, between the upright and reclined positions of the back 14, thereby providing increased resistance to further rearward reclining of the back 14.

The assist springs 54 are mounted within the pockets 40 that are formed in the base 36 for the slidable connection D between the bearing guide 38 and the base 36. Thus, as the bearing guide 38 moves rearward during reclining of the back 14, the springs 54 will contact the back face 56 of the pocket 40 and will begin to compress between the back face 56 and the bearing guide 38. Various assist springs are possible but the preferred embodiment includes two assist springs with a spring rate of 106 lb/in each. Accordingly, as the user reclines the back 14 rearward from the upright position towards the reclined position, the user will feel increased resistance from the assist springs 54 when the springs 54 engage intermediately, or approximately halfway, through the total allowed reclining angle.

The assist springs 54 are mounted to the back side of the bearing guide 38 onto specially formed mounts 58. Each of the mounts 58 have an outer diameter 59 which fits snugly within the inner diameter 53 of the spring 54 to stabilize the spring 54 in the proper orientation. A ramped tab 60 is also provided inside the outer diameter 59 with an undercut area 61 in order to retain the spring 54 on the mount 58. Thus, once installed on the mount 58, the bent inward end 55 of the spring 54 will lodge under the ramped tab 60 and will become trapped by the undercut area 61 below the tab 60. The mount 58, therefore, securely attaches one end 55 of the spring 54 to the bearing guide 38, leaving the other end of the spring 54 free to abut up against the backside 56 of the pocket 40 during reclining. The ramped tab 60 and undercut area 61 also allow the spring 54 to be easily installed in place during manufacturing. In order to install the spring 54, the spring 54 can be simply pushed onto the mount 58. The bent inward end 55 of the spring 54 will then ride along the ramped portion of the tab 60 until the bent end 55 reaches the undercut area 61, where it will pop into place.

In order to prevent the user from pinching fingers, clothing, or the like within the moving parts of the chair 10 during reclining, a pinch guard 62 has been provided to cover the pockets 40 in the base 36. The pinch guard 62 also improves the appearance of the chair 10 by covering up the unsightly pockets 40 and the internal mechanisms of the chair 10. The pinch guards 62 are attached to the bearing guide 38 and rest flat against the outer sides of the base 36. Thus, when the bearing guide 38 moves rearward during reclining, the pinch guards 62 will move rearward also. The pockets 40 on the base 36, therefore, are always covered, preventing anything from becoming pinched between the rearwardly moving bearing guide 38 and the back side 56 of the pockets 40. The pinch guards 62 also cooperate with the inner lateral guides 64 to laterally retain the bearing guide 38 in place.

Turning now also to FIGS. 8 through 11, the reclining pressure of the back 14 is also adjustable in order to satisfy the individual preferences of different users. Thus, by adjusting the amount of preload in the main spring 46, the user can individually set the amount of reclining pressure that will be exerted when the back 14 is reclined rearward. The preload on the main spring 46 is adjusted by the user by turning the pressure adjustment knob 66 either clockwise or counter clockwise, depending on whether more or less reclining pressure is desired. The rotation of the pressure adjustment knob 66 is then translated by a spiral bevel gear set 68 to rotate the spring adjustment screw 70. The spring adjustment screw 70, however, is fixed in place by a rear shoulder 72 on the spiral bevel gear 68 and a front shoulder 73 on the screw 70 so that the screw 70 is prevented from translating rearward or forward. The screw 70 rotates about a bushing 74 with a Teflon impregnated mesh interior. A thrust surface is also provided between a Teflon impregnated lip 75 on the bushing 74 and a washer 76 positioned between the lip 75 and the forward shoulder 73. Thus, when the pressure adjustment knob 66 is rotated by the user and the screw 70 correspondingly rotates, the rear spring guard 44 will travel forward or rearward depending on the rotational direction of the screw 70. Therefore, the initial compression of the main spring 46, or preload, will vary depending on the user's adjustment of the pressure adjustment knob 66. To ensure a minimum amount of preload in the spring 46 and to ease assembly of the pressure adjustment mechanism, a spring preload device like that disclosed below can be provided.

A height adjustment mechanism 78 is also provided which can be integrated into the pressure adjustment knob 66. The height adjustment mechanism 78 allows the user to quickly and easily adjust the height of the seat 12 and back 14 depending on the individual preference of the user. The height adjustment mechanism 78 includes an actuating stem 80 installed through the pressure adjustment knob 66. The outer end of the activating stem 80 forms a button 82 which can be easily depressed by the user. A spring 83 installed behind the button 82 forces the button 82 outward when it is not depressed. The inner end of the actuating stem 80 forms a smaller diameter nose portion 84 and a larger diameter shoulder portion 85.

The nose portion 84 of the actuating stem 80 is then installed through a slot 88 that extends through the upper portion of the actuating member 86. The actuating stem 80 resists the outward pressure of the spring 83 with a groove 87 located between the nose portion 84 and the shoulder 85 that is installed into a retention snap 91 within the actuating member slot 88. The actuating member 86 includes a funnel-like cavity 90 along its lower end that is adapted to fit over the valve pin 96 of the variable height cylinder 97. The actuating member 86 also includes a similar funnel-like shape along its exterior 92, with the lower outer diameter 94 being approximately the size of the inner cavity surface 98 of the chair stem assembly 18.

The cylinder 97 is a typical cylinder 97 used by office chair manufacturers to provide variable height adjustment. A cylinder with a lateral release system like that manufactured by Suspa is an example of one such cylinder. The cylinder 97 is unlocked from its selected height by pressing the valve pin 96 to the side, which then allows the cylinder 97 to freely travel upward and downward. The user, therefore, is able to easily adjust the height of the chair 10 by depressing the button 82 of the actuating stem 80. The shoulder 85 on the other end of the actuating stem 80 then abuts against the outer sides 89 of the slot 88 in the actuating member 86. This forces the top side of the actuating member 86 to pivot around the opposite side of the bottom, flared outer diameter 94 of the actuating member 86 when the outer diameter 94 abuts against the inner cavity surface 98 of the chair stem assembly 18. As a result, the valve pin 96 is forced to the side by the inner cavity 90 of the actuating member 86, thereby releasing the cylinder 97 to move upward or downward. When the user releases the button 82 of the actuating stem 80, the actuating member 86 and the valve pin 96 will return to their centralized position without the need for a separate return device. The cylinder 97 will then be locked in place at the desired height. The actuating member 86 also makes the height adjustment mechanism 78 easier to assemble in manufacturing because the vertical placement of the cylinder 97 is less crucial then it is in traditional height adjustment mechanisms.

Spring Preload System

Referring now to FIGS. 12, 12*a*, 13, and 14, a preload system 120 is provided in order to eliminate looseness in the main spring assembly 122 when the rear spring guide 44 is adjusted to its rear-most position. Looseness in the main spring assembly 122 can result in a rattling of the reclining system 30 when the chair 10 is moved about during normal use. Naturally, user's of the office chair 10 find this rattling noise to be distracting and disturbing. Typically, this looseness is prevented by introducing an initial compression into the main spring 46 so that the spring 46 is always compressed even when the pressure adjustment knob 66 is turned all the way towards the lowest pressure setting.

Introducing this initial compression into the main spring 46 can make installation of the spring assembly 122 quite difficult, however. For example, in the preferred embodiment the main spring 46 has a spring rate of 310 lb/in. The desired amount of initial compression in the spring 46 is about 0.090 inch to adequately prevent rattling of the reclining system 30. Therefore, about 28 lbs of force (310 lb/in*0.090 in) must be applied to the spring 46 in order to compress it sufficiently to permit installation of the spring 46 into the spring assembly 122. As a result, installation of the spring 46 becomes difficult because of the large amount of force that must be applied to the spring 46 at the same time that the multiple pieces of the spring assembly 122 are being fitted together. This can make manual installation of the spring 46 difficult to perform repeatedly in a manufacturing assembly line. Thus, special tools are usually required. These tools, however, can become overly complicated and can make the installation procedure more time consuming.

The preload system 120 alleviates this difficulty by allowing the main spring 46 to be installed without applying any initial compression to the spring 46. The initial compression is then introduced into the spring 46 after the entire reclining system 30 has been assembled simply by turning the pressure adjustment knob 66. Thus, the main spring 46 can be installed by easily fitting together the pieces of the spring assembly 122 without applying any force to the spring 46. Although the preload system 120 can be used on other reclining systems, the preferred embodiment includes a multi-member reclining system 30 like the one described above.

The spring assembly 122 includes a front spring guide 42 and a rear spring guide 44 which entrap and hold the main spring 46 in place. The front spring guide 42 is integrally formed into the bearing guide 38. Thus, when the back 14 is reclined rearwardly the forward end of the spring 46 travels rearward along with the bearing guide 38. The rear spring guide 44 is threaded onto the spring adjustment screw 70 and is fixed in place during normal reclining of the chair 10. Accordingly, when the back 14 is reclined, the main spring 46 becomes increasingly compressed between the rearward moving front spring guide 42 and the fixed rear spring guide 44. As a result, the user feels a supportive resistance from the back 14 as the user presses rearwardly against the back 14.

The resistance that the user feels from the back 14 during reclining can be adjusted by turning the pressure adjustment knob 66 in either a clockwise or counter-clockwise direction for increased or decreased resistance, respectively. When the pressure adjustment knob 66 is turned, the spiral bevel gear set 68 is engaged and the spring adjustment screw 70 rotates correspondingly. However, the rear spring guide 44 is prevented from rotating due to the pressure applied to the rear spring guide 44 by the mainspring 46 and the resulting friction between the guide 44 and the spring 46. Therefore, the threaded connection 124 between the spring adjustment screw 70 and the rear spring guide 44 cause the rear spring guide 44 to travel forward when the pressure adjustment knob 66 is turned clockwise. Likewise, the rear spring guide 44 travels rearward when the pressure adjustment knob 66 is turned counterclockwise. The movement of the front spring guide 42, however, is restricted by the stops 48 which limit the travel range of the front spring guide 44 between a forward-most position and a rearward-most position. As a result, the user is able to adjust the compression in the main spring 46 so that a correspondingly greater or lesser amount of resistance is felt by the user when reclining the back 14.

The spring adjustment screw 70 is prevented from traveling forward or rearward during rotation by a rear shoulder 72 on the spiral bevel gear 68 and a front shoulder 73 on the screw 70. The rear shoulder 72 abuts against the back face of a fixed support wall 126 formed into the base 36. The front shoulder 73 is located on the opposite side of the support wall 126 and abuts against a thrust washer 76. The thrust washer 76 then abuts against a lip 75 on the bushing 74, which abuts against the front face of the support wall 126. The bushing 74 is mounted onto the shaft portion 129 of the spring adjustment screw 70 and is installed within an inner diameter 128 formed into the support wall 126. The bushing 74 includes a Teflon impregnated mesh along its interior to allow the shaft portion 129 to smoothly rotate against the bushing's 74 inner diameter. The lip 75 of the bushing 74 also includes a Teflon impregnated mesh on the surface that contacts the thrust washer 76 to also ensure smooth rotation of the screw 70.

A cover 130 is also provided that is installed over the spiral bevel set 68 and the bushing 74 and is secured in place by screws 132 that are threaded into the base 36. The cover 130 traps the spring adjustment screw 70 along the top 129 of the screw 70 to restrain the screw 70 within the inner diameter 128 formed in the support wall 126. A portion of the inner diameter 128 is also formed into the bottom side of the cover 130 to support the top of the bushing 74.

A preload member 134 is also formed into the cover 130. The preload member 134 is attached along each end 136 to the cover 130 and has a relatively small cross-section so that the preload member 134 is moderately flexible. In the preferred embodiment, the preload member 134 and the cover 130 are made from a material known by those skilled in the art as acetyl, or sometimes referred to as Delrin. Preferably, the spring rate of the preload member 134 is about 40 lb/in. The preload member 134 includes a central portion 138 with a partial inner diameter 139 and two outer portions 140. The two outer portions 140 are curved downwards and connect the central portion 138 to the two ends 136 that are attached to the cover 130.

The rear spring guide 44 is adapted for the preload member 134 by including a rear shoulder 142. The outer diameter 144 of the rear shoulder 142 is about equal to the outer diameter of the thrust washer 76. Unlike the inner threaded section 124 of the spring guide 44, the interior of the rear shoulder 142 is unthreaded and has an inner diameter 146 larger than the threads of the screw 70 and slightly larger than the front shoulder 73 of the screw 70. Thus, when the rear spring guide 44 is threaded rearward to its rearward-most position, the inner diameter 146 of the shoulder 142 will be positioned over the outer diameter 150 of the front shoulder 73 of the screw 70. The back face 148 of the shoulder 142 will then abut against the thrust washer 76 and the outer diameter 144 of the shoulder 142 will be about flush with the outer diameter of the thrust washer 76.

The partial inner diameter 139 of the preload member 134 is shaped and positioned to rest upon the outer diameter 150 of the front shoulder 73 of the screw 70 in its free state. However, the preload member 134 is sufficiently flexible to rest upon the larger outer diameter 144 of the rear shoulder 142 of the rear spring guide 44 also.

Accordingly, the preload member 134 allows the spring assembly 122 to be installed without having to compress the main spring 46 either manually or with special tools. Initial compression can then be introduced to the main spring 46 by simply turning the pressure adjustment knob 66. To install the spring assembly 122, the rear spring guide 44 is first threaded rearward into its rearward-most position, or a first position, so that the back face 148 of the rear shoulder 142 abuts against the thrust washer 76. The preload member 134 is then installed so that it rests on top of the rear shoulder 142 of the spring guide 44 in a slightly tensioned state. The main spring 46 and the other pieces of the assembly 122 can then be installed without any compression of the main spring 46 necessary. When the entire spring assembly 122 is installed in this initial state, a small amount of looseness will exist between the individual pieces of the spring assembly 122. To remove this looseness, the pressure adjustment knob 66 is turned clockwise to force the rear spring guide 44 forward. Because no initial compression will exist in the main spring 46, the rear spring guide 44 may need to be held with one hand to prevent rotation of the spring guide 44. When the rear spring guide 44 travels forward at least the distance of the width of the preload member 134, the preload member 134 will pop down into its free state and will rest on top of the outer diameter 150 of the front shoulder 73 of the screw 70.

In the preferred embodiment, the width of the preload member 134 is about 0.090 inch. Therefore, after the preload member 134 pops down onto the front shoulder 73 of the screw 70, an initial compression, or stress, in the main spring 46 will be indefinitely preserved. Accordingly, after the initial installation procedure, the rear spring guide 44 will be prevented from returning to its rearward-most position that existed before the installation procedure. Thus, after the installation procedure, if the user turns the pressure adjustment knob 66 so that the rear spring guide 44 travels rearward, the back face of the shoulder 142 of the spring guide 44 will now abut against the preload member 134 instead of the thrust washer 76. Because the preload member 134 is then compressed between the thrust washer 76 and the back face of the spring guide shoulder 142, the user is prevented from removing the initial compression that has been introduced into the main spring 46.

Removable Arm Rests and Plugs System

In order to satisfy the wide range of user preferences for chair options, a modular system has been provided for the arm rests 210, 310 of the chair 10, 300. This modular system includes arm rests 210, 310 and plugs 270, 380 for both a task chair 10 with a reclining system and a four legged chair 300 commonly used for stacking. In order to reduce manufacturing costs, the modular system provides a single back 14 that can be used on both the task chair 10 and the stacker chair 300. A set of removable arm rests 210, 310 are also provided, with one arm rest 210 being adapted for the task chair 10 and another arm rest 310 being adapted for the stacker chair 300. A similar set of plugs 270, 380 are also provided, one 270 for the task chair 10 and another 380 for the stacker chair 200. Accordingly, the arm rests 210, 310 can be removed and the chair 10, 300 can be used without arm rests 210, 310 by using the plugs 270, 380 instead. The two arm rests 210, 310 and the two plugs 270, 380 are all adapted to be used with the single back 14. Thus, the modular system provides an increased number of possible chair configurations. In addition, the user can reconfigure the chair from the initial configuration if desired. Of course, it should be understood that either set of arm rests 210, 310 or plugs 270, 380 could be adapted for either chair 10, 300.

Referring now to FIGS. 1, 15, 16, 17, 18, 20, and 21, the task chair arm rest 210 includes an arm rest portion 212 along the top side of the arm rest 210 that is shaped so that the user can comfortably rest his arm upon the top of the arm rest portion 212. The arm rest portion 212 is made from a moderately soft material to increase comfort, such as rubber or foam. The arm rest 210 also includes a connecting member 214 along the bottom side of the arm rest 210 that is used to connect the arm rest 210 to the frame 30 of the chair 10. Preferably, the connecting member 214 is made from an iron material that is cast in a sand mold. The arm rest portion 212 and the connecting member 214 are permanently attached to each other to form a rigid arm rest 210.

The connecting member 214 extends downward in a tapered shape with the bottom end being narrower than the upper end. As is well-known by those skilled in the art of said castings, a certain amount of draft, or downward slope, is required to manufacture the cast iron connecting member 214. This necessary draft angle has been advantageously incorporated into the connecting system to provide a secure and tight fit between the arm rest 210 and the chair 10. Accordingly, the connecting member 214 includes a front 216 and rear 217 rounded surface that tapers downward about 2.5° on each surface. The connecting member 214 also includes an inside 218 and outside 219 flat surface that tapers downward about 1.5° on each surface. Similarly, the yoke 32 of the chair 10 includes an interior cavity 220 with corresponding rounded surfaces 222 and flat surfaces 224 that are also tapered.

Along the top side of the connecting member 214, an inner and outer anti-rotation tab 226 is provided. The anti-rotation tabs 226 extend below the frame stop surfaces 228, and the exterior surface of the tabs 226 form a rounded guide diameter 230. The outer guide diameter 230 extends upward to the top end of the connecting member 214. The frame stop surfaces 228 are positioned along each side of the anti-rotation tabs 226 and extend diametrically from the tapered flat surface 218, 219 to the outer guide diameter 230. The top side of the connecting member 214 also includes back stop surfaces 232 that are positioned above the frame stop surfaces 228. The back stop surfaces 232 extend diametrically from the inner guide diameter 228 to the outer guide diameter 230. Finally, a tapered receiving hole 234, or receiver, is included along the bottom side of the connecting member 214 that extends through the inside flat surface 218.

The yoke 32, or frame 32, includes anti-rotation slots 236 that correspond to the anti-rotation tabs 226. In addition, the yoke 32 includes a mounting surface 238 along the top of the yoke 32 that corresponds to the frame stop surfaces 232. Lastly, a threaded hole 240 is included, which corresponds to the receiving hole 234, that extends through the inside wall of the yoke 32 to the bottom of the interior tapered cavity 220.

Preferably, the back 14 is made from 20% glass filled polypropylene. To increase the comfort of the back 14, the back 14 is perforated with a number of holes to increase aeration. The back 14 includes a left arm rest hole 242 and a right arm rest hole 243 that extend through the back 14. The arm rest holes 242 include an upper guide diameter 244 that corresponds to the arm rest outer guide diameter 230. A lower guide diameter 246 is also included that corresponds to the outer diameter 239 of the yoke 32. Near the top side of the arm rest hole 242 is a front 248 and a rear 249 ledge. The ledges 248, 249 have top surfaces 250 that correspond to the back stop surfaces 232 and extend diametrically from an inner diameter 252 slightly larger than the inner guide diameter 229 of the connecting member 214, 228 to the upper guide diameter 244. The ledges 248, 249 extend only around the front and the rear of the arm rest hole 242 and do not extend around the sides of the arm rest hole 242.

Four wedges 254 are also included along the inner diameter 252 of the ledges 248, 249. The wedges 254 extend downward from the top of the ledges 248, 249 to the bottom of the ledges 248, 249. The wedges 254 are positioned near each edge of the ledges 248, 249. The wedges 254 are shaped with a downward sloping ramp that extends further in towards the center of the arm rest hole 242 near the bottom of the ledge 248, 249 than near the top of the ledge 248, 249.

From the foregoing description, it is apparent that the arm rest 210 can be easily connected to the yoke 32 to provide a secure and tight fit between the arm rest 210, the yoke 32, and the back 14. Accordingly, in order to install the arm rest 210, the back 14 is first installed over the yoke 32. The lower guide diameter 246 of the back 14 fits snugly around the outer diameter 239 of the yoke 32. The bottom surfaces 251 of the ledges 248, 249 in the arm rest hole 242 will then abut against the top mounting surface 238 of the yoke 32.

Next, the arm rest 210 is installed through the arm rest hole 242 in the back 14 and into the interior cavity 220 of the yoke 32. The frame stop surfaces 228 will then be located near the top mounting surface 238 of the yoke 32, and the back stop surfaces 232 will be located near the top surface 250 of the ledges 248, 249 in the arm rest hole 242. The anti-rotation tabs 226 of the arm rest 210 also slide down into the anti-rotation slots 236 in the yoke 32.

Finally, a set screw 252 is threaded into the threaded hole 240 of the yoke 32, with the nose 254 of the set screw 252 extending into the receiving hole 234 of the connecting member 214. When the set screw 252 is tightened the connection between the arm rest 210, the yoke 32, and the back 14 becomes rigid and secure. It is believed that several different features contribute to the rigidity of the connection. First, the threaded hole 240 in the yoke 32 is offset below and towards the inside from where the receiving hole 234 is expected to be positioned. Because the receiving hole 234 is tapered about 100° per side, and the set screw nose 254 is tapered about 15° per side, a wedge is formed between the set screw nose 254 and the receiving hole 234 which pulls the connecting member 214 towards the threaded hole 240. Preferably, the threaded hole 240 is offset about 0.035 inch down from the expected position of the receiving hole 234. Therefore, tightening of the set screw 252 will force the connecting member 214 downward and deeper into the interior cavity 220 of the yoke 32. Because the surfaces 222, 224 of the interior cavity 220 are tapered like the connecting member surfaces 216, 217, 218, 219, the connecting member 214 will wedge tightly into the interior cavity 220. Alternatively, the connecting member 214 could be forced downward until either the frame stop surfaces 228 abut against the top mounting surface 238 of the yoke 32 or the back stop surfaces 232 abut against the top surfaces 250 of the arm rest hole ledges 248, 249. Preferably, the threaded hole 240 is also offset about 0.030 inch inside from the expected position of the receiving hole 234. Therefore, the connecting member 214 will be rotated inward by the set screw 252 until the anti-rotation tabs 226 abut against the anti-rotation slots 236 in the yoke 32. Offsetting the threaded hole 240 towards the inside is believed to be desirable over positioning the threaded hole 240 towards the outside because side impacts to the arm rest 210 will be transferred to the yoke 32 through the anti-rotation tabs 226 instead of being absorbed by the set screw 252. It should be understood that other offset positions between the threaded hole 240 and the receiving hole 234 would also provide a tight connection. The set screw 252 further tightens the connection between the connecting member 214 and the yoke 32 by pushing the bottom of the connecting member 214 outwards and away from the threaded hole 240. As the nose 254 of the set screw 252 contacts the tapered sides of the receiving hole 234, leverage is created between the receiving hole 234 at the bottom of the connecting member 214 and the top of the connecting member 214. This wedges the connecting member 214 even tighter into the interior cavity 220 of the yoke 32.

The wedges 254 on the inner diameter 252 of the ledges 248, 249 in the back 14 also contribute to the rigidity of the connection. The bottom ends of the ramped wedges 254 form an inner diameter that is smaller than the inner diameter 229 of the connecting member 214. Therefore, when the arm rest 210 is installed through the arm rest hole 242, an interference fit will occur between the inner guide diameter 229 of the connecting member 214 and the wedges 254. However, the wedges 254 are relatively narrow in width and are made from a material that is compressible. Thus, when the inner guide diameter 229 of the connecting member 214 is forced through the wedges 254, the wedges 254 will compress slightly to allow the inner guide diameter 229 to pass through the wedges 254. The resulting connection between the wedges 254 and the inner guide diameter 229 is a tight, compressive fit.

Figure 22:
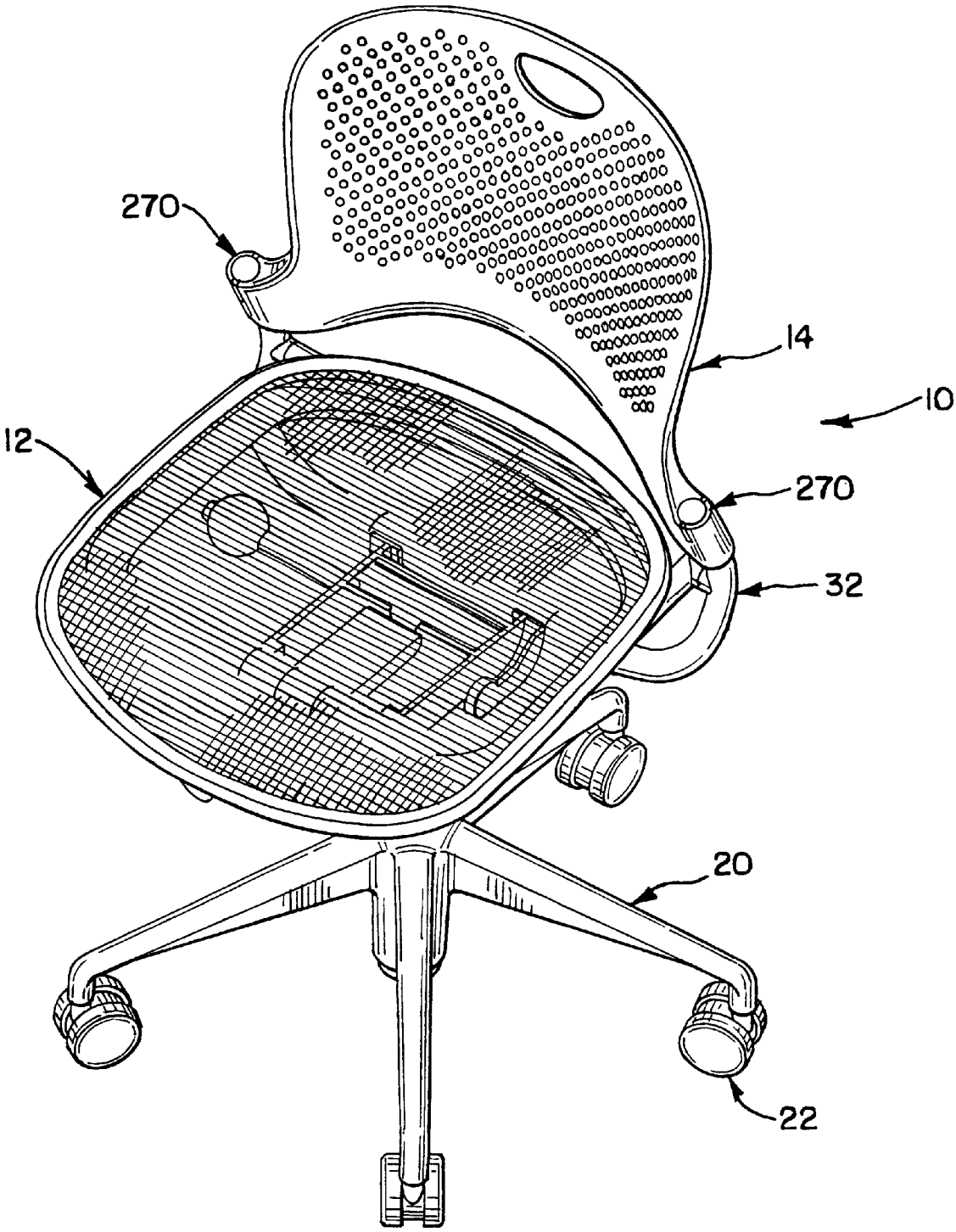
FIG. 22 is a perspective view of a task chair, showing task chair plugs installed.
Figure 23:
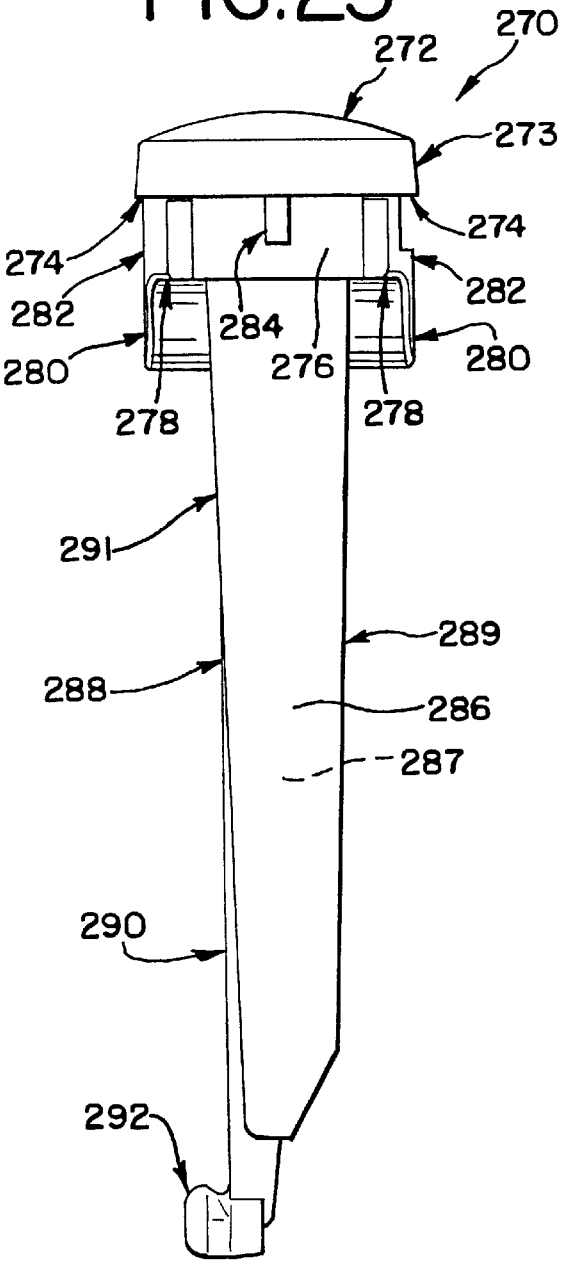
FIG. 23 is a side elevational view of the task chair plug.
Figure 24:
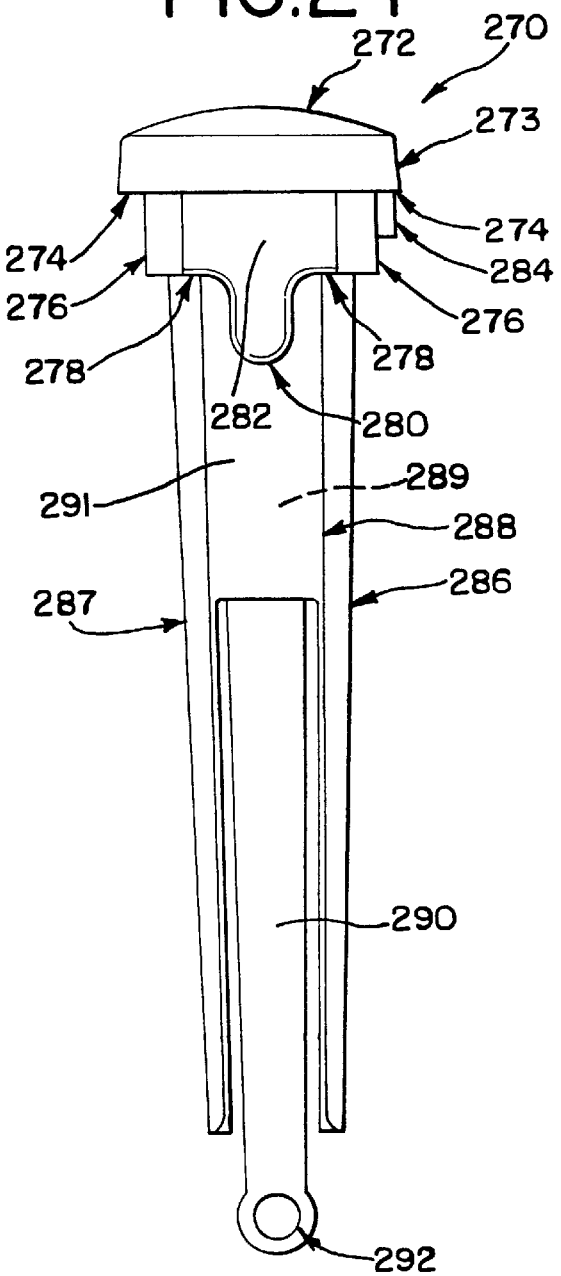
FIG. 24 is a front elevational view of the task chair plug.
Figure 25:
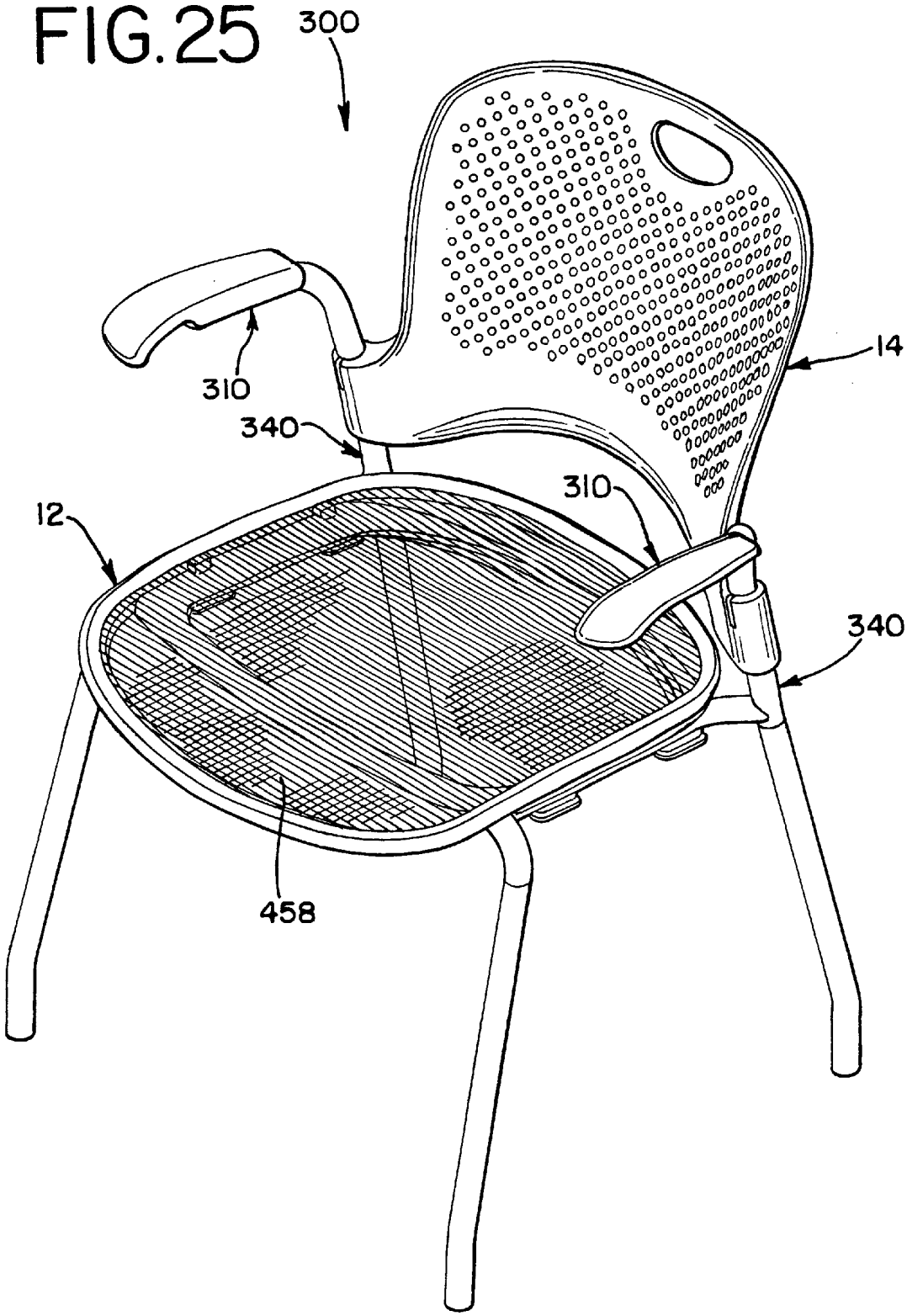
FIG. 25 is a perspective view of a stacker chair, showing a set of stacker chair arm rests installed and a fabric seat installed.
Figure 26:
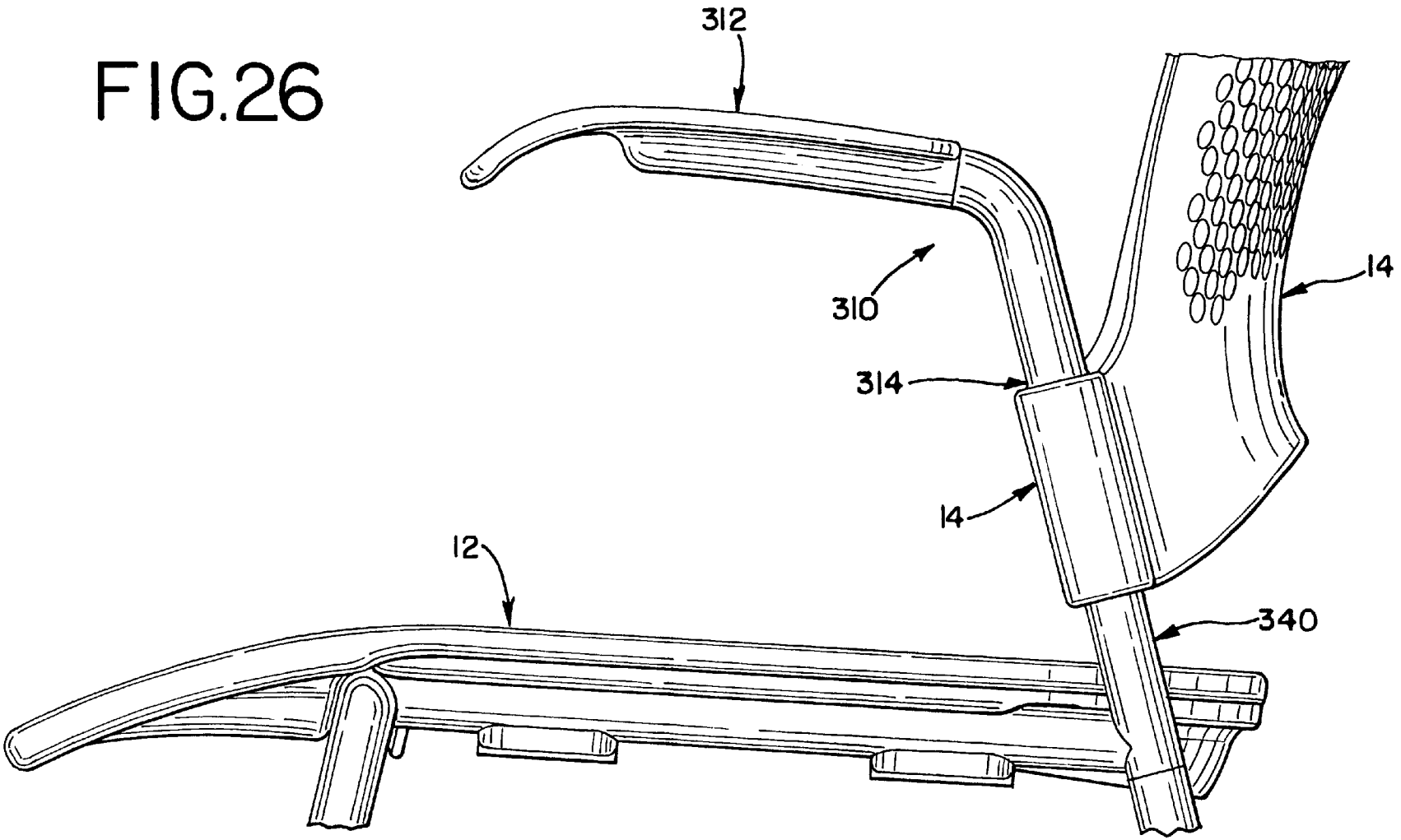
FIG. 26 is a side elevational view of the stacker chair, showing the stacker chair arm rest installed.
Figure 29:
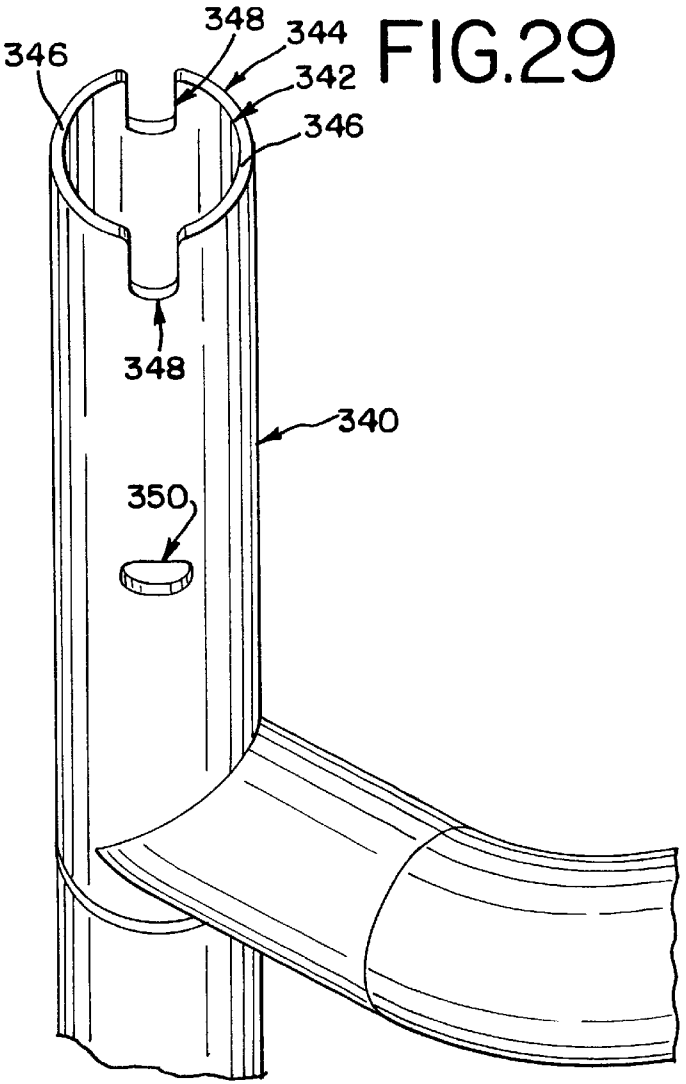
FIG. 29 is a perspective view of the stacker chair frame, showing an interior cavity.
Figure 28:
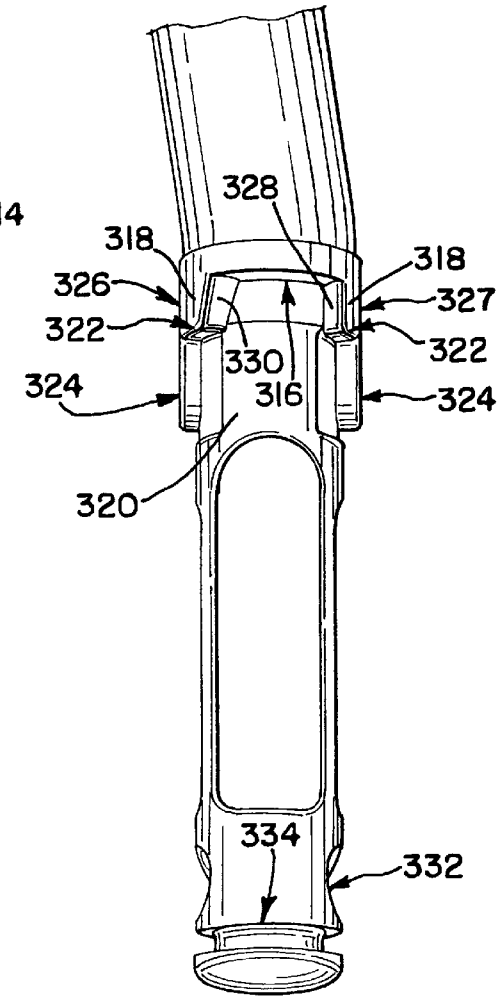
FIG. 28 is a back elevational view of the stacker chair arm rest, showing the connecting member.
Figure 27:
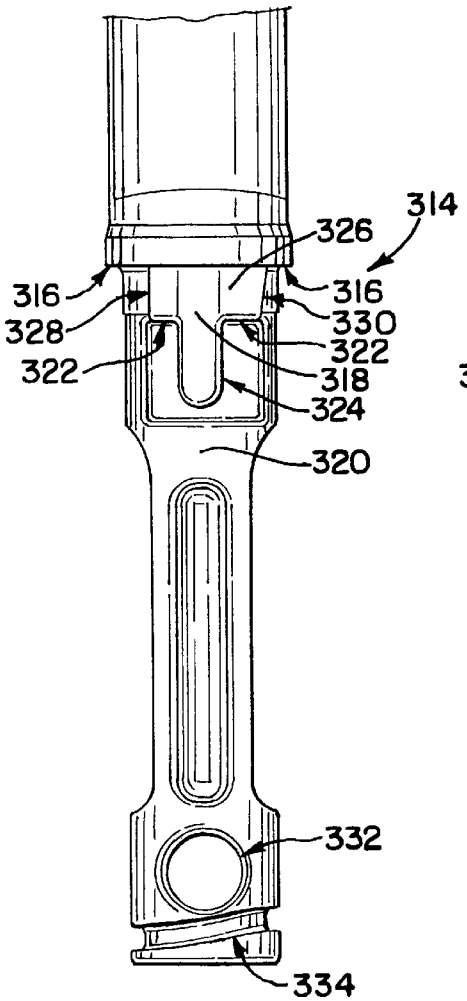
FIG. 27 is a side elevational view of the stacker chair arm rest, showing a connecting member.
Figure 30:
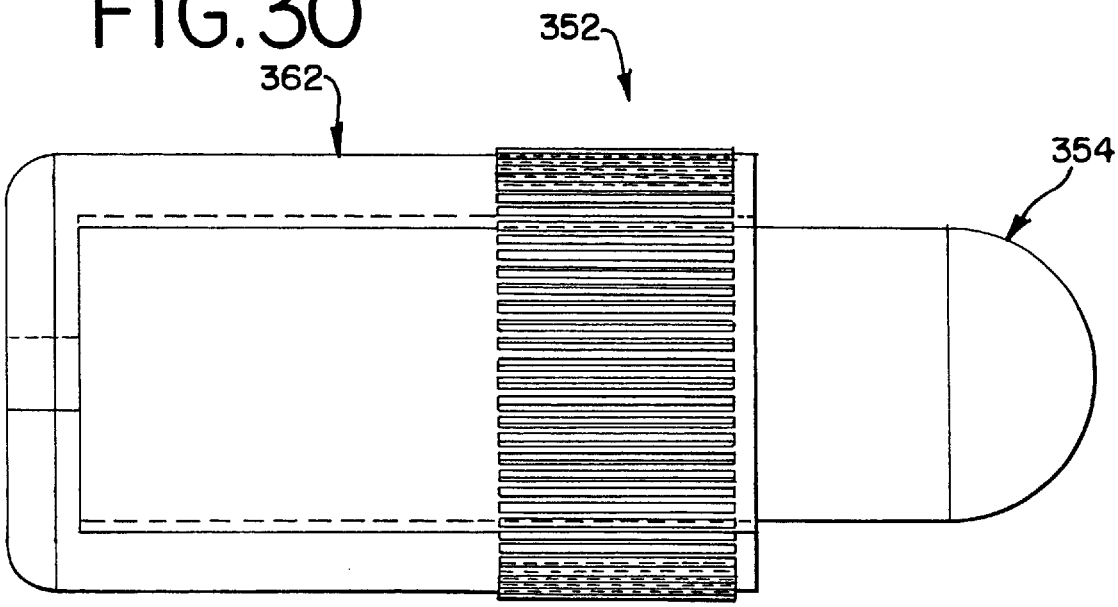
FIG. 30 is a side elevational view of a detent assembly having a rounded nose.
Figure 31:
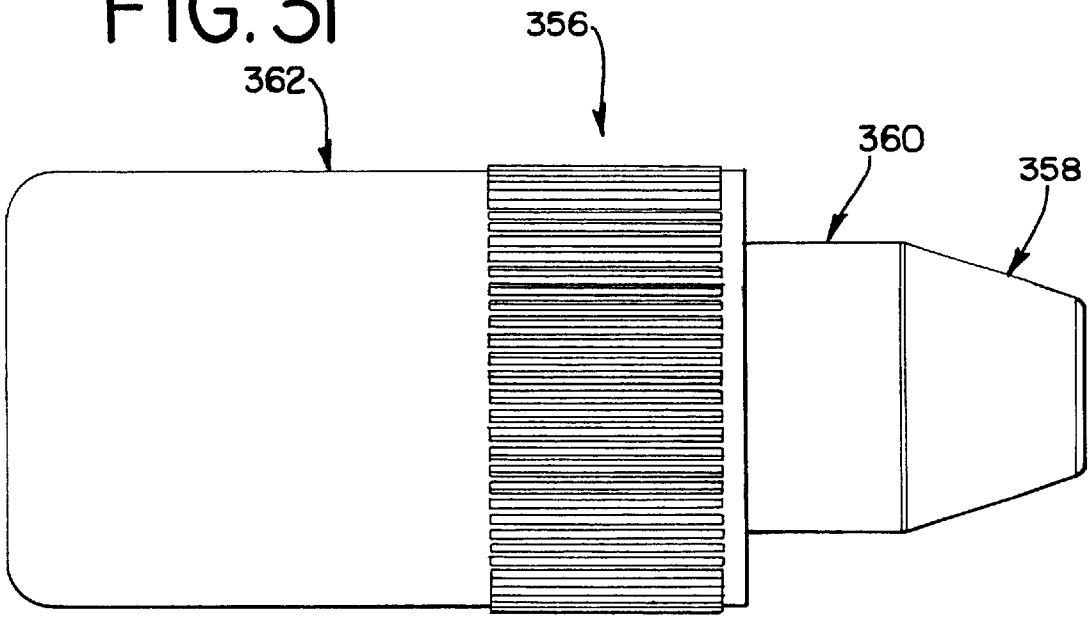
FIG. 31 is a side elevational view of a detent assembly having an angled nose.

Turning now also to FIGS. 22 through 24, a plug 270 is provided in order to satisfy users of the task chair 10 who prefer not to use arm rests 210. The plug 270 is molded from a nylon material.

Along the top side of the plug 270, a cap 272 is provided that has a smoothly rounded, textured surface for an attractive appearance. The bottom side of the cap 272 forms a back stop surface 274. The back stop surface 274 extends diametrically from the outer diameter 273 of the cap 272 to the inner guide diameter 276. Frame stop surfaces are also provided along each side of the anti-rotation tabs 280. The frame stop surfaces 278 extend diametrically from the tapered flat surfaces 288, 289 to the outer guide diameter 282. The anti-rotation tabs 280 are provided along the inner and outer sides near the top of the plug 270. The anti-rotation tabs 280 extend below the frame stop surfaces 278 and outwards to the outer guide diameter 282. Along the front side of the plug 270, an installation tab 284 is provided that extends downward from the back stop surface 274 and outwards from the inner guide diameter 276.

Along the bottom side of the plug 270, a front 286 and rear 287 rounded surface and an inside 288 and an outside 289 flat surface are provided. The rounded surfaces 286, 287 and the flat surfaces 288, 289 are tapered so that they slope inward from the top side of the plug 270 to the bottom side of the plug 270. The inside flat surface 288 is disconnected along the sides from the front and rear rounded surfaces 286, 287. This disconnected portion forms a spring member 290 that is angled slightly outward from the inward sloping upper portion 291 of the inside flat surface 288. Preferably, the spring member 290 has a spring rate of about 40 lb/in. At the bottom end of the spring member 290, a rounded detent nose 292 is provided that extends outward in the direction of the outward angle of the spring member 290.

From the foregoing description, it is apparent that the plug 270 can be installed into the yoke 32 and the back 14 to provide a secure connection between the yoke 32 and the back 14 without the need for an arm rest 210. Accordingly, to install the plug 270, the back 14 is first installed over the yoke 32 by sliding the lower guide diameter 246 of the arm rest hole 242 over the outer diameter 239 of the yoke 32 until the bottom surfaces 251 of the ledges 248, 249 abut against the top mounting surface 238 of the yoke 32. The plug 270 is then installed through the arm rest hole 243 in the back 14 and into the interior cavity 220 of the yoke 32. The plug 270 is pressed down until the detent nose 292 of the spring member 290 is aligned with the threaded hole 240, or receiver, in the yoke 32. Because the outward angle of the spring member 290 causes an interference fit between the spring member 290 and the interior cavity 220 of the yoke 32, the detent nose 292 will pop outward and into the threaded hole 240 when the detent nose 292 and the threaded hole 240 become aligned.

When the detent nose 292 pops into the threaded hole 240, the frame stop surfaces 278 will abut or be near the top mounting surface 238 of the yoke 32. The back stop surface 274 will also abut or be near the top side 250 of the ledges 248, 249 in the back 14. At the same time, the tapered rounded surfaces 286, 287 and the tapered flat surfaces 288, 289 will be wedged into the tapered interior cavity 220 of the yoke 32. The detent nose 292 will then prevent the back 14 from being disconnected from the yoke 32 by restraining the ledges 248, 249 in the back 14 under the back stop surface 274 of the plug 270.

The anti-rotation tabs 280 of the plug 270 also slide down into the anti-rotation slots 236 of the yoke 32. The anti-rotation tabs 280, thus, prevent the plug 270 from rotating and possibly dislodging the detent nose 292 from the threaded hole 240.

The connection between the plug 270 and the yoke 32 is further tightened by the wedges 254 on the inner diameter 252 of the ledges 248, 249 in the back 14. Like the arm rest inner guide diameter 229, the inner guide diameter 276 of the plug 270 compresses the wedges 254 to provide a tight, compressive fit.

Finally, the installation tab 284 slides into the installation slot 294 in the back 14. The installation slot 294 extends down through the front ledge 248 in the left arm rest hole 242 and through the rear ledge 249 in the right arm rest hole 243. The installation tab 284 allows a single plug 270 to be used for both the left arm rest hole 242 and the right arm rest hole 243 of the chair 10. The installation tab 284, thus, prevents the plug 270 from being installed with the detent nose 292 facing in the opposite direction of the threaded hole 240, where it would not adequately connect the back 14 to the yoke 32. This feature is useful for assembly line manufacturing, where the monotony of repeated assembly tasks can lead to inattention and improper installation of the plugs 270. The installation tab 284 is also especially useful for chairs 10 that are sold unassembled directly to users. Because users are not familiar with the proper functioning of the plugs 270, it is likely that some users will improperly install the plugs 270, and thus, cause later dissatisfaction with the chair 10 when the back 14 does not remain securely fastened to the yoke 32.

Turning now to FIGS. 15, 16, and 25 through 31, an arm rest 310 for a stacker chair 300 is provided. The arm rest 310 includes an arm rest portion 312 along the top side that is made from a soft, comfortable material. Along the bottom side of the arm rest 310, a connecting member 314 is provided. The connecting member 314 is made from aluminum that is cast in a permanent mold. The arm rest portion 312 and the connecting member 314 are permanently attached to each other to form a rigid arm rest 310.

Along the top side of the connecting member 314, back stop surfaces 316 are provided that extend diametrically from the outer guide diameter 318 to the inner guide diameter 320. Frame stop surfaces are also provided below the back stop surfaces 322. The frame stop surfaces 322 are positioned along each side of the anti-rotation tabs 324 and extend diametrically from the inner guide diameter 320 to the outer guide diameter 318. The anti-rotation tabs 324 are positioned along the inside and the outside of the connecting member 314 and extend downward from the frame stop surfaces 322.

Guide pads 326, 327 are provided above the anti-rotation tabs 324. The guide pads 326, 327 extend between the inner guide diameter 320 and the outer guide diameter 318 and between the frame stop surfaces 322 and the back stop surfaces 316. When directly viewing either of guide pads 326, 327 of the left arm rest 310 from the front side of the pad 326, 327, the guide pads 326, 327 include a flat side 328 on the left side of the guide pad 326, 327 and an angled side 330 on the right side of the guide pad 326, 327. The angle of the angled side 330 is about 10°, with the lower end of the angled side 330 sloped inward from the upper end. When viewed with the left arm rest 310 installed in the chair 300, the angled side 330 of the inside guide pad 326 will face forward, and the angled side 330 of the outside guide pad 327 will face rearward.

Along the bottom side of the connecting member 314, the inner guide diameter 320 extends downward from the top side of the connecting member 314 down to the bottom of side of the connecting member 314. Near the bottom of the connecting member 314, a retention hole 332 is provided for a detent assembly 352, 356. Just below the retention hole 332, an angled O-ring groove 334 is provided. The O-ring groove 334 is angled with the rear side of the O-ring groove 334 being lower than the front side of the O-ring groove 334.

The frame 340 of the stacker chair 300 is provided with an interior cavity 342 that is straight and non-tapered. An outer diameter 344 is also provided. Along the top side of the frame 340, a mounting surface 346 is included. Anti-rotation slots 348 extend downward from the mounting surface 346 and through the frame wall. The anti-rotation slots 348 are positioned on the inside and on the outside of the frame 340. Below the mounting surface 346, a detent hole 350, or receiver, is provided that extends through the inside wall of the frame 340.

Two different detent assemblies 352, 356 are provided. Both detent assemblies 352, 356 have a cylindrical housing 362 with a spring (not shown) installed within the housing 362. A detent nose 354, 358 extends out from one end of the housing 362. The detent nose 354, 358 can be pressed inward against the spring 364 but will extend outward in its free state. One detent assembly 352 has a detent nose 354 with a uniformly rounded end. Another detent assembly 356 has a detent nose 358 with angled sides. The angled sides are angled about 18° on each side. Below the angled sides is a straight portion 362 that has a uniform outer diameter.

From the foregoing description, it is apparent that the arm rest 310 can be easily connected to the frame 340 to provide a secure and tight fit between the arm rest 310, the frame 340, and the back 14. Accordingly, in order to install the arm rest 310, the back 14 is first installed over the frame 340 of the stacker chair 300. The lower guide diameter 246 fits snugly around the outer diameter 344 of the frame 340. The bottom surface 251 of the ledges 248, 249 will then abut against the top mounting surface 346 of the frame 340.

Next, the arm rest 310 is installed through the arm rest hole 242 in the back 14 and into the interior cavity 342 of the frame 340. To prepare the arm rest 310 for installation, an O-ring (not shown) is first installed into the O-ring groove 334 along the bottom side of the connecting member 314. One of the detent assemblies 352, 356 is also installed into the retention hole 332, with the detent nose 354, 358 facing towards the inside of the connecting member 314. The detent assembly 352 with the rounded detent nose 354 is preferred when the arm rest 310 is installed in a manufacturing assembly line. However, when the arm rest 310 is shipped unassembled and will be installed by a user, the detent assembly 356 with the angled detent nose 358 is preferred.

The connecting member 314 is then inserted into the arm rest hole 242 with the arm rest portion 312 facing outwards. This will allow the rear side of the O-ring, which is angled downward, to enter the arm rest hole 242 before the front side of the O-ring. Accordingly, the rear side of the O-ring will travel down the arm rest hole 242 ahead of the front side and will slide down between the front and rear ledges 248, 249 to allow easier installation of the arm rest 310.

A detent ramp 368 has been provided next to the installation slot 294 in the front ledge 248 in order to further ease installation of the detent assembly 352, 356. The detent ramp 368 extends downward and inward from the upper guide diameter 244 of the left arm rest hole 242 near the top side of the front ledge 248. The detent ramp 368 is less necessary when the rounded nosed detent assembly 352 is used but is especially helpful when the angled nosed detent assembly 356 is used. Thus, as the connecting member 314 is pressed down through the arm rest hole 242, the detent ramp 368 will gradually force the nose 354, 358 of the detent assembly 352, 356 inward to ease the detent nose 354, 358 past the top surface 250 of the ledge 248. Because the detent nose 354, 358 will be facing rearward when the arm rest 310 is installed in the right arm rest hole 243, the detent ramp 368 extends through the rear ledge 249 of the right arm rest hole 243.

Once the detent assembly 352, 356 passes by the front ledge 248, the arm rest 310 can be rotated forward so that the arm rest portion 312 faces forward, the connecting member 314 is then pressed down until the anti-rotation tabs 324 slide into the anti-rotation slots 348 and the detent nose 354, 358 pops through the detent hole 350 in the frame 340.

In order to provide a rigid connection between the arm rest 310, and the back 14, and the frame 340, an angled side 370 has been provided on the inside edge of the front ledge 248 and on the outside edge of the rear ledge 249. The angled sides 370 of the ledges 248, 249 correspond to the angled sides 330 of the guide pads 326, 327 on the connecting member 314. The position of the angled sides 330, 370 can be reversed, but the present configuration is preferred because side impacts to the arm rest 310 will be transferred away from the angled side 330 and will be absorbed by the straight sides instead. When installed, the guide pads 326, 327 will become wedged between the front and rear ledges 248, 249, with the angled sides 330 of the guide pads 326, 327 abutting against the angled sides 370 of the ledges 248, 249. In a manufacturing assembly line, about 100 lbs. of downward force can be applied to the arm rest 310 to wedge the guide pads 326, 327 against the ledges 248, 249 until the rounded detent nose 354 pops into the detent hole 350. The ledges 248, 249 are made from a compressible material that will deform slightly when pressure is applied from the angled sides 330 of the guide pads 326, 327. In contrast to a manufacturing assembly line, when a user installs the arm rest 310, the angled nosed detent assembly 356 is preferred because it allows less force to be applied while still providing a satisfactory wedge between the guide pads 326, 327 and the ledges 248, 249. Thus, when a smaller amount of downward force is applied to the arm rest 310, the angled nose 358 of the detent assembly will still partially pop into the detent hole 250. The angled nose 358 will then securely lock the detent assembly 356 to the detent hole 350 by wedging against the sides of the detent hole 350. Over time, during normal use of the chair 300, the angled detent nose 358 will further strengthen the connection as the connecting member 314 is slowly pressed deeper into the frame 341 by ramping further into the detent hole 350. Eventually, the angled detent nose 358 may pop all the way through the detent hole 350, and the straight portion 360 will provide a solid lock against the sides of the detent hole 351.

The connection is further tightened at the top by the wedges 254 on the inside diameter 252 of the ledges 248, 249. The wedges 254 contact the inner guide diameter 320 of the connecting member 314 and create an interference fit between the inner guide diameter 320 and the wedges 254. As the connecting member 314 is pressed downward, the wedges 254 will compress slightly to allow the connecting member 314 to pass through the ledges 248, 249. As a result, a tight compressive fit will occur between the wedges 254 and the top part of the inner guide diameter 320. Along the bottom of the connection member 314, the connection will be tightened by the O-ring 366. The O-ring 366 becomes compressed by the interior cavity 342 of the frame 340, thus, providing a further rigid connection.

Along the bottom side of the back 14, a cavity 372 has been provided in the back 14 to allow easy removal of the arm rest 310. The detent assembly 352, 356 and the detent hole 350 have been positioned above the bottom end of the back 14. The detent nose 354, 358, therefore, protrudes out from the detent hole 350 above the bottom end of the back 14 in an area that is hidden from casual observation in order to improve the appearance of the chair 300. The detent nose 354, 358 is also protected in this arrangement from being accidentally dislodged during normal use by inadvertent contact with the detent nose 354, 358. Accordingly, a detent slot 374 is provided in the back 14 for clearance of the detent nose 354, 358 that extends between the arm rest hole 242 and the bottom cavity 370. Thus, the arm rest 10 can be easily removed by reaching into the bottom cavity 372, pressing the detent nose 354, 358 back through the detent slot 374 and the detent hole 350, and lifting the arm rest 310 back out of the arm rest hole 242.

Figure 32:
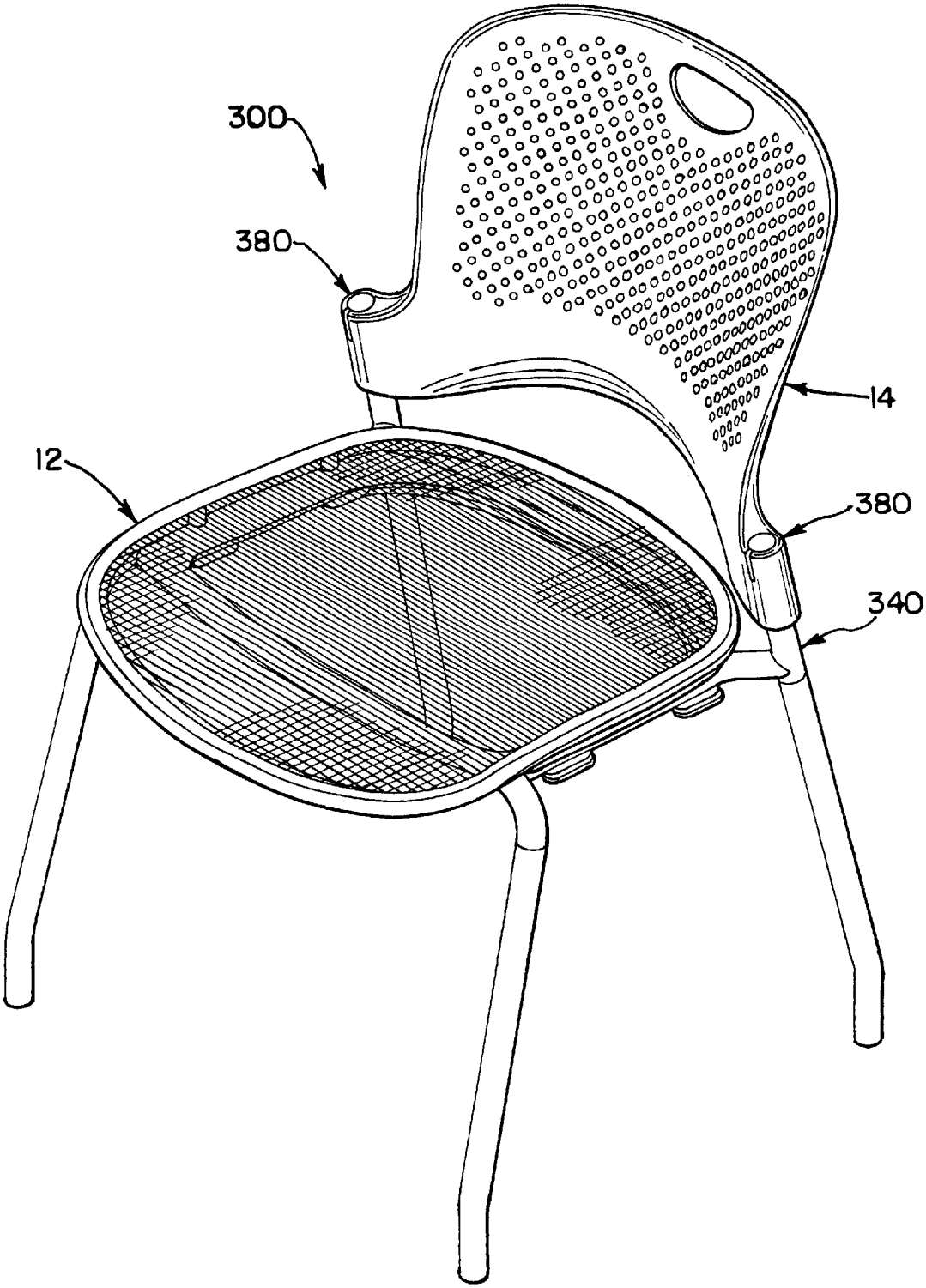
FIG. 32 is a perspective view of a stacker chair, showing stacker chair plugs installed.
Figure 33:
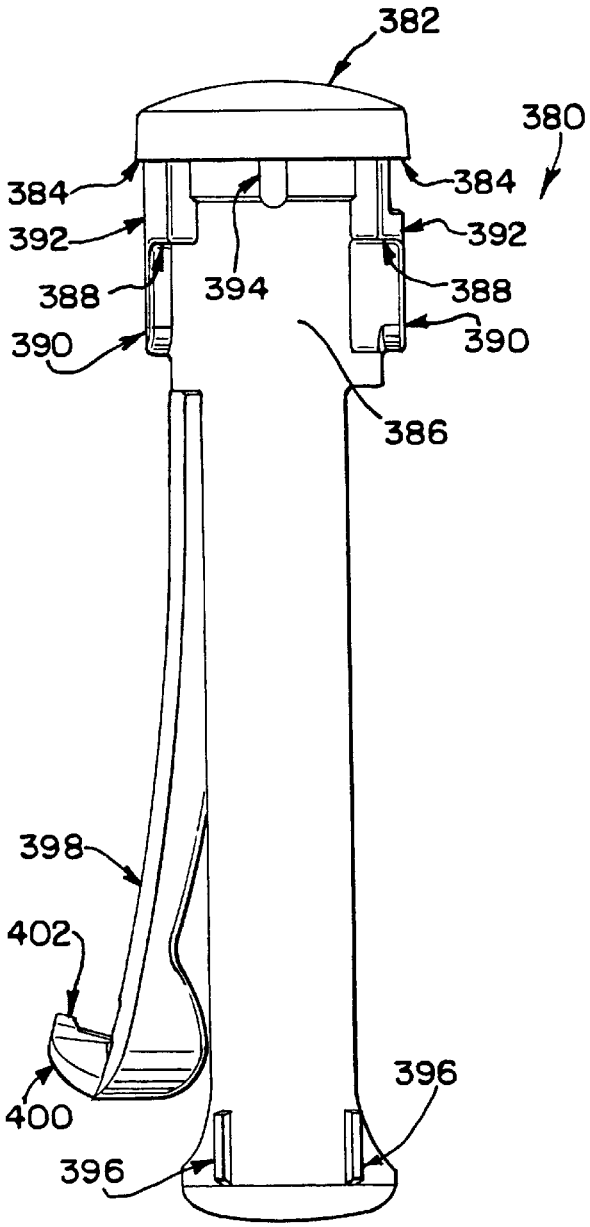
FIG. 33 is a side elevational view of the stacker chair plug.
Figure 34:
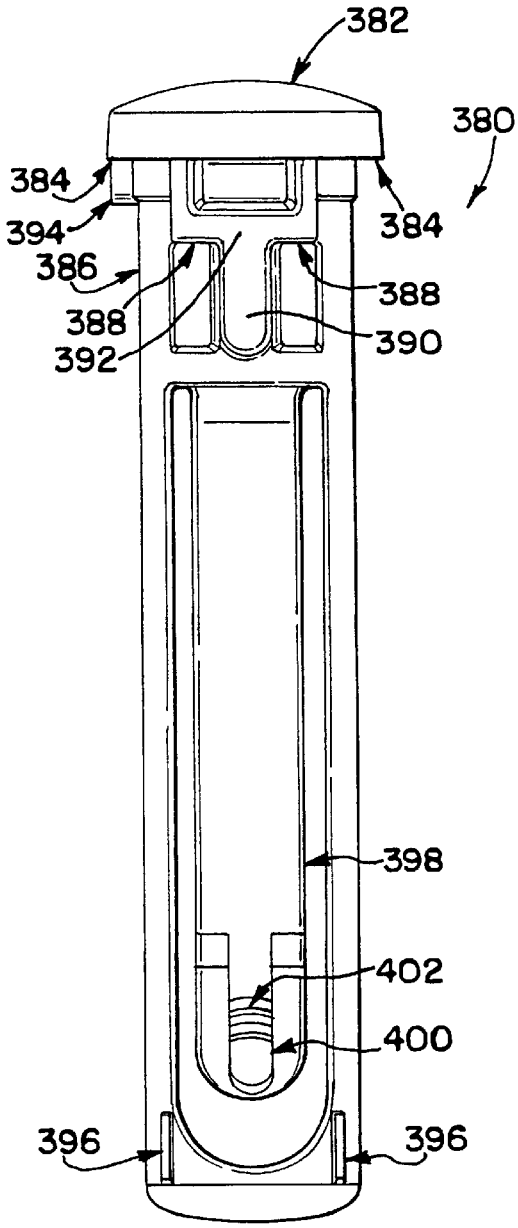
FIG. 34 is a front elevational view of the stacker chair plug.
Figure 35:
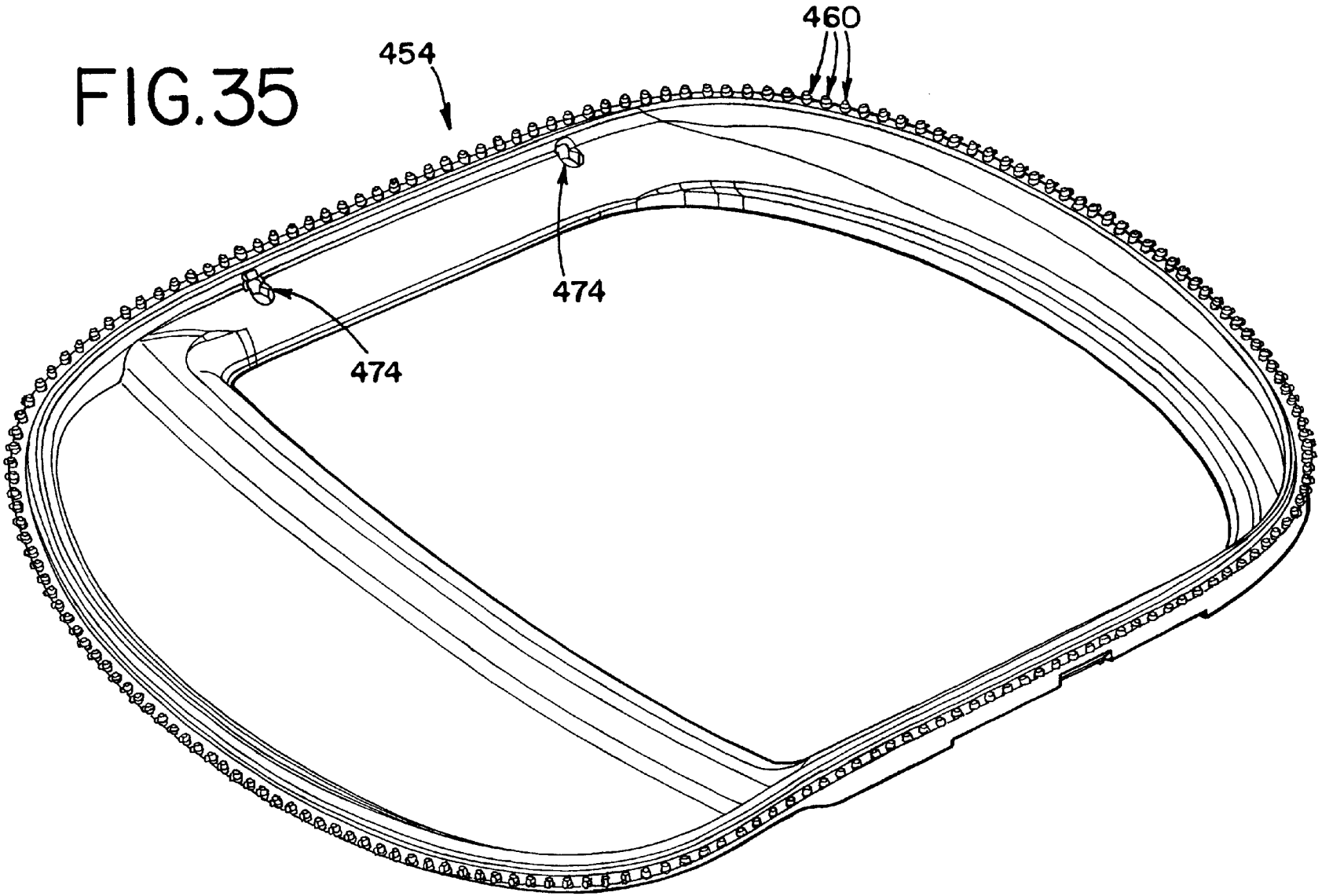
FIG. 35 is a perspective view of a seat frame, showing the top side of the seat frame.
Figure 36:
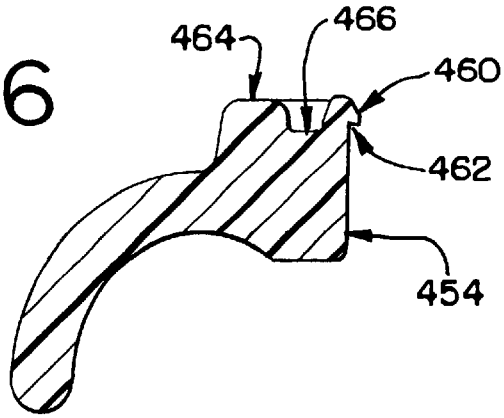
FIG. 36 is a cross-sectional view of a portion of the seat frame, showing a tooth.
Figure 37:
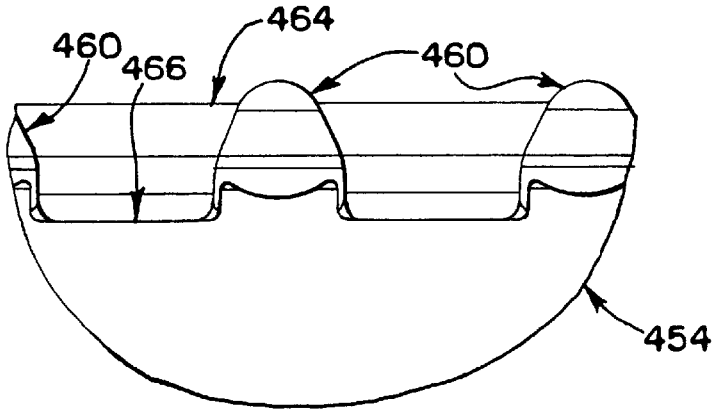
FIG. 37 is a front elevational view of a portion of the seat frame, showing the tooth.
Figure 38:
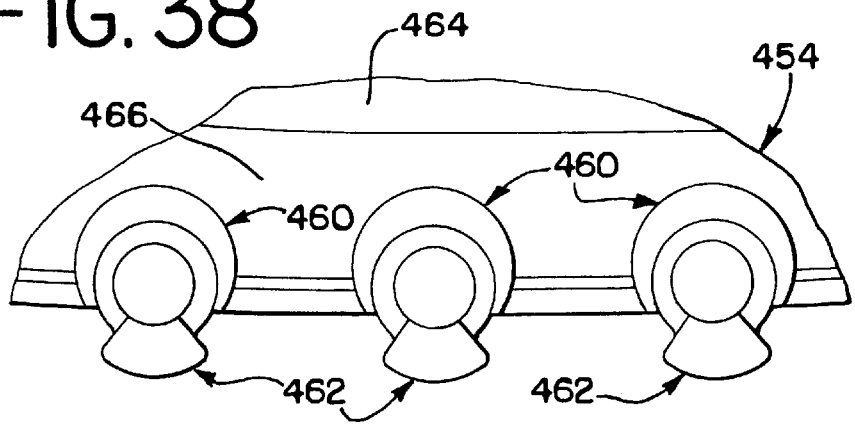
FIG. 38 is a top plan view of a portion of the seat frame, showing the tooth.
Figure 39:
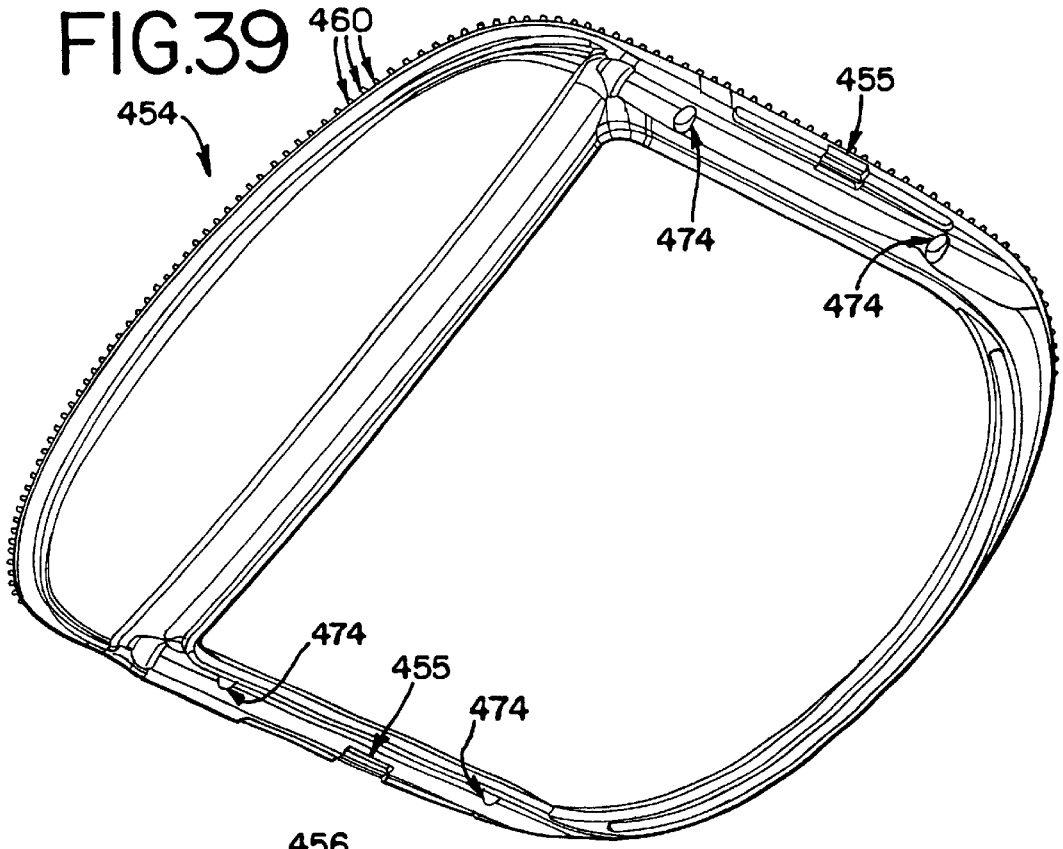
FIG. 39 is a perspective view of the seat frame, showing the bottom side of the seat frame.
Figure 40:
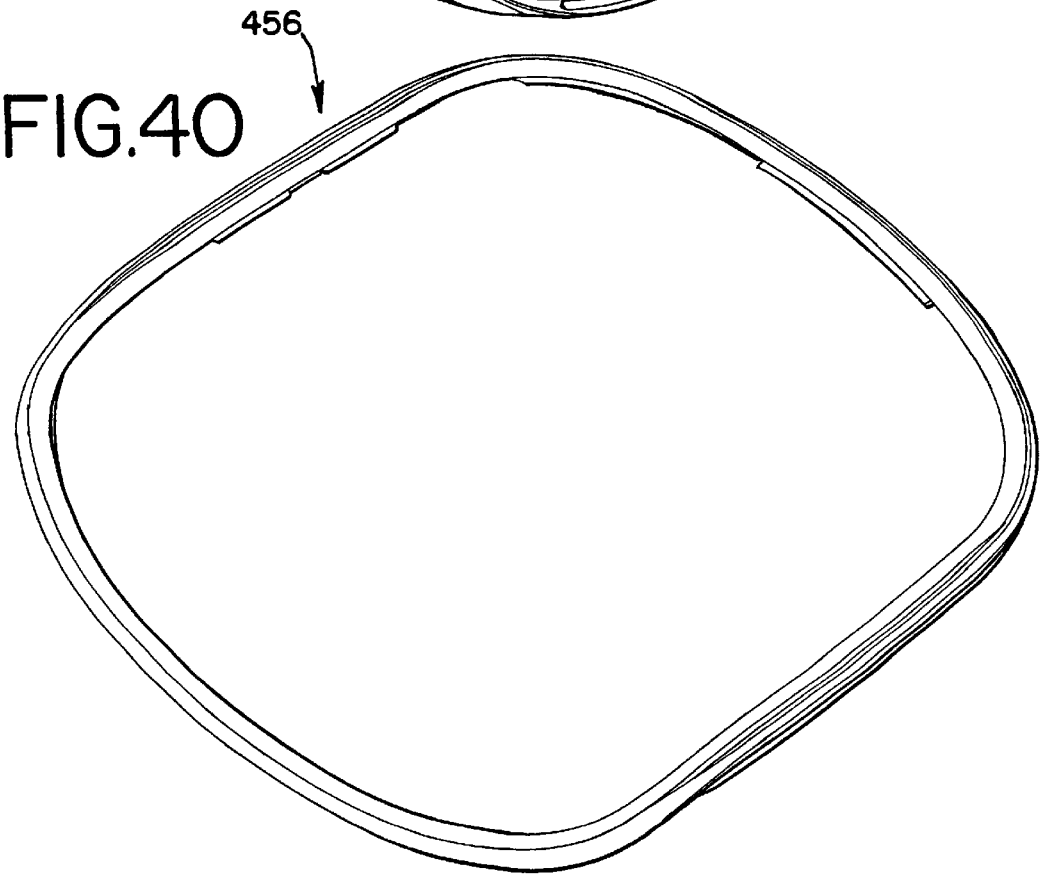
FIG. 40 is a perspective view of a cover, showing the top side of the cover.
Figure 41:
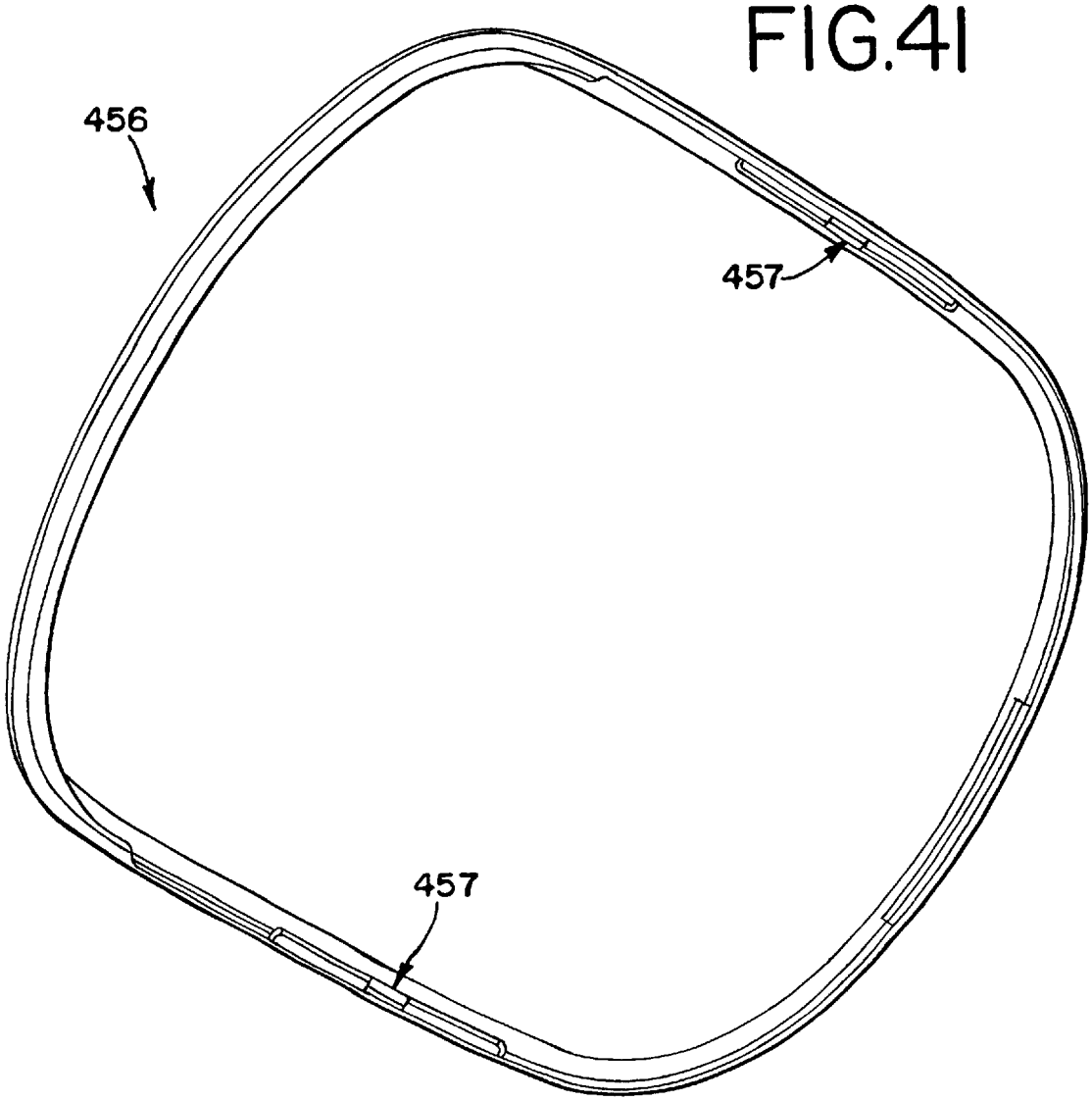
FIG. 41 is a perspective view of the cover, showing the bottom side of the cover.
Figure 43:
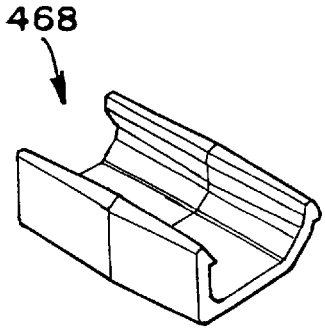
FIG. 43 is a perspective view of a clip.
Figure 44:
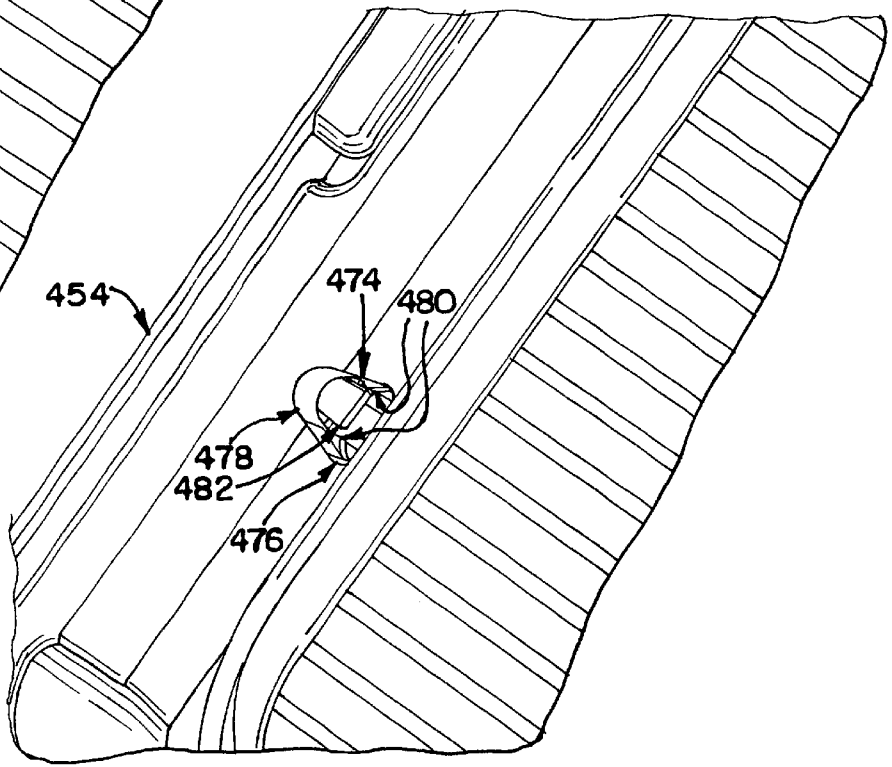
FIG. 44 is a perspective view of a portion of a seat, showing a retention slot in the bottom side of the seat frame.
Figure 45:
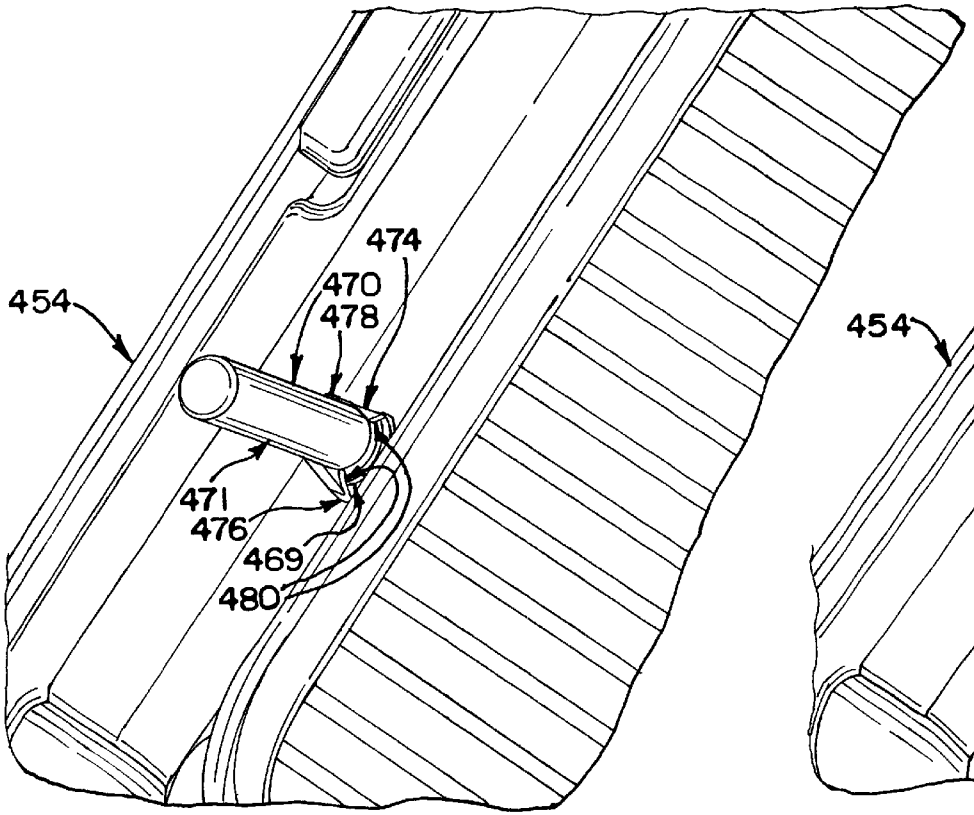
FIG. 45 is a perspective view of a portion of the seat, showing a pin installed in the retention slot.
Figure 46:
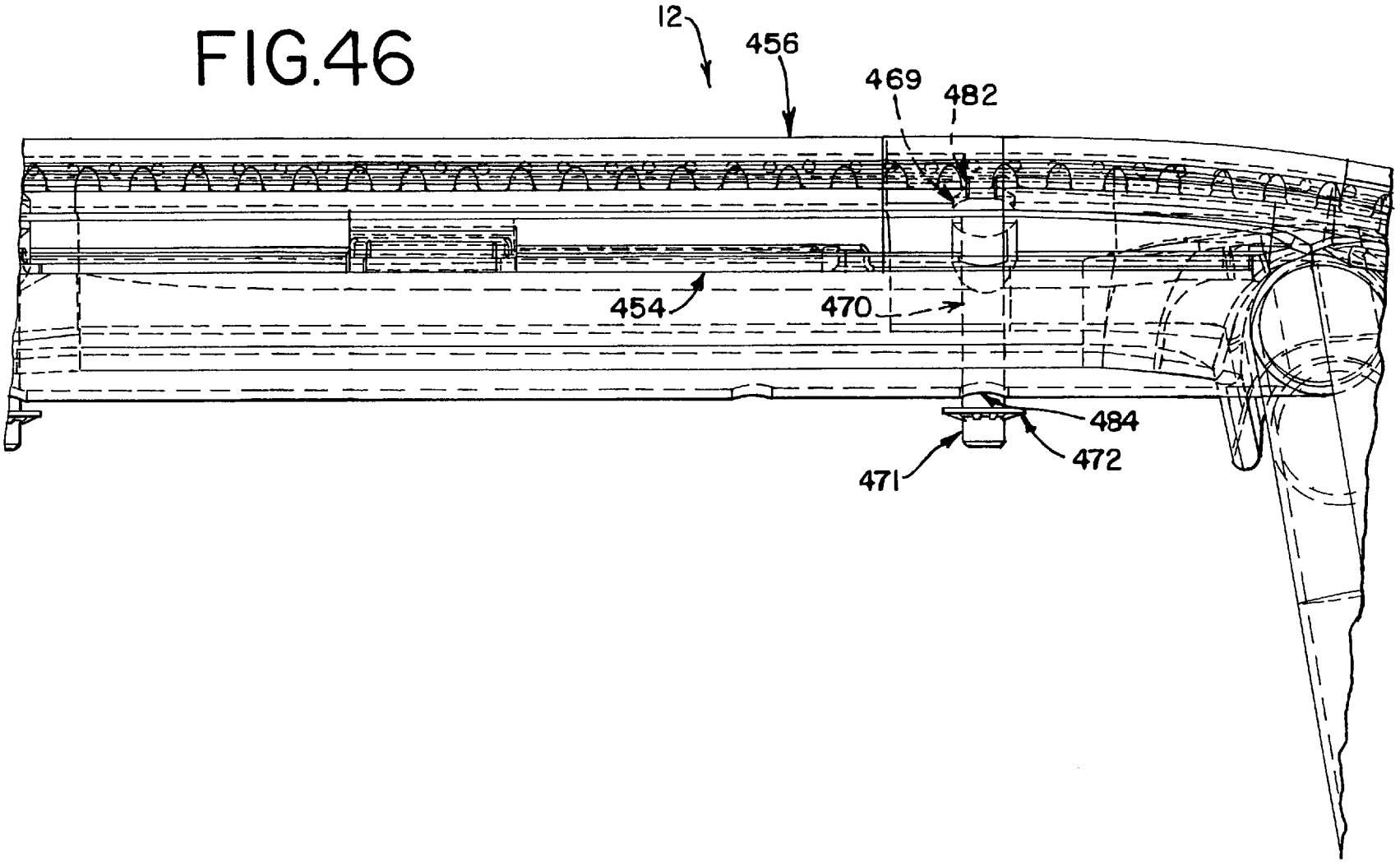
FIG. 46 is a side elevational view of the seat installed onto a chair frame, showing the pin installed through a hole in the chair frame and a tinnerman nut installed on the bottom end of the pin.

Turning now also to FIGS. 32 through 34, a plug 380 is provided in order to satisfy users of the stacker chair 300 who prefer not to use arm rests 310. The plug 380 is molded from a nylon material.

Along the top side of the plug 380, a cap 382 is provided that has a smoothly rounded, textured surface for an attractive appearance. The bottom side of the cap 382 forms a back stop surface 384. The back stop surface 384 extends diametrically from the outer diameter of the cap 382 to the inner guide diameter 386. Frame stop surfaces 388 are also provided along each side of the anti-rotation tabs 390. The frame stop surfaces 388 extend diametrically from the inner guide diameter 386 to the outer guide diameter 392. The anti-rotation tabs 390 are provided along the inner and outer sides near the top of the plug 380. The anti-rotation tabs 390 extend below the frame stop surfaces 388 and outwards to the outer guide diameter 392. Along the front side of the plug 380, an installation tab 394 is provided that extends downward from the back stop surfaces 384 and outwards from the inner guide diameter 386.

Along the bottom side of the plug 380, the inner guide diameter 386 extends down to the bottom end of the plug 380. Because the molding process is unable to accurately control the size of the inner guide diameter 386 along the bottom of the plug 380, guide pads 396 that can be more easily controlled have been added. Thus, four guide pads 396 are positioned around the inner guide diameter 386 near the bottom of the plug 380 that extend outward from the inner guide diameter 386.

A spring member 398 is also provided. The spring member 398 is cantilevered from the plug 380 and is connected to the plug 380 near the top side of the plug 380. Preferably, the spring rate of the spring member 398 is about 20 lb/in. The spring member 398 extends downward toward the bottom of the plug 380 and is disconnected from the plug 380 along its sides and its bottom end. The spring member 398 is also angled outwards from the plug 380, with the bottom of the spring member 398 protruding further away from the inner guide diameter 386 than the connected top end. A detent nose 400 is provided along the bottom end of the spring member 398 that extends outward from the spring member 398. Finally, an upward facing catch surface 402 is formed onto the outer end of the detent nose 400.

From the foregoing description, it is apparent that the plug 380 can be installed into the frame 340 and the back 14 to provide a secure connection between the frame 340 and the back 14 without the need for an arm rest 310. Accordingly, to install the plug 380, the back 14 is first installed over the frame 340 by sliding the lower guide diameter 246 of the arm rest hole 242 over the outer diameter 344 of the frame 340 until the bottom surfaces 251 of the ledges 248, 249 abut against the top mounting surface 346 of the frame 340. The plug 380 is then installed through the arm rest hole 242 in the back 14 and into the interior cavity 342 of the frame 340. The plug 380 is pressed down until the detent nose 400 of the spring member 398 is aligned with the detent hole 350 in the frame 340. Because the outward angle of the spring member 398 causes an interference fit between the spring member 398 and the interior cavity 342 of the frame 340, the detent nose 400 will pop outwards and into the detent hole 350 when the detent nose 400 and the detent hole 350 become aligned.

When the detent nose 400 pops into the detent hole 350, the frame stop surfaces 388 will abut or be near the top mounting surface 346 of the frame 340. The back stop surface 384 will also abut or be near the top side 250 of the ledges 248, 249. The detent nose 400 will then prevent the back 14 from being disconnected from the frame 340 by restraining the ledges 248, 249 in the back 14 under the back stop surface 384 of the plug 380. Experience has shown that the back 14 of the stacker chair 300 is subjected to considerably more upward forces than the back 14 of the task chair 10. This commonly occurs when one chair 300 is stacked on top of another chair 300, thus causing an impact on the upper chair 300. Therefore, the plug 380 of the stacker chair 300 experiences higher and more frequent upward forces on the cap 382. This condition has been known to force the detent nose 400 out of the detent hole 350, thus allowing the back 14 to become disconnected from the frame 340. To prevent this problem, the catch surface 402 grasps the outer diameter 344 of the frame 340, which prevents the detent nose 400 from being pulled back through the detent hole 350 by an upward force on the plug 380.

As the plug 380 is installed into the back 14 and the frame 340 the anti-rotation tabs 390 of the plug 380 slide down into the anti-rotation slots 348 of the frame 340. The anti-rotation tabs 390, thus, prevent the plug 380 from rotating and possibly dislodging the detent nose 400 from the detent hole 350.

The connection between the plug 380 and the frame 340 is further tightened by the wedges 254 on the inner diameter 252 of the ledges 248, 249 in the back 14. Like the arm rest inner guide diameter 320, the inner guide diameter 386 of the plug 380 compresses the wedges 254 to provide a tight, compressive fit. The guide pads 396 on the lower end of the plug 380 also contribute to a tight fit. The guide pads 396 contact the sides of the interior cavity 342 of the frame 340, thus eliminating any looseness between the bottom of the plug 380 and the frame 340.

Finally, the installation tab 394 slides into the installation slot 294 in the back 14. The installation tab 394 allows a single plug 380 to be used for both the left arm rest hole 242 and the right arm rest hole 243 of the chair 300. The installation tab 394, thus, prevents the plug 380 from being installed with the detent nose 400 facing in the opposite direction of the detent hole 350, where it would not adequately connect the back 14 to the frame 340. Correct installation of the plug 380 is particularly important in the stacker chair 300 because of the increased upward forces on the back 14 that are likely to dislodge the plug 380 as previously described. The installation tab 394 is useful for assembly line manufacturing, where the monotony of repeated assembly tasks often lead to inattention and improper installation of the plugs 380. The installation tab is also especially useful for chairs 300 that are sold unassembled directly to users. Because users are not familiar with the proper functioning of the plugs 380, it is likely that some users will improperly install the plugs 380, and thus, cause later dissatisfaction with the chair 300 when the back 14 does not remain securely fastened to the frame 340.

Like the arm rest 310 for the stacker chair 300, the detent nose of the plug 380 is hidden above the bottom 460 side of the back 14 within the detent slot 374 in the back 14 to improve the appearance of the chair 300 and protect the detent nose 400 from accidental dislodging. Accordingly, the plug 380 can be easily removed by reaching into the bottom cavity 372, pressing the detent nose 400 back through the detent slot 374 and the detent hole 350, and lifting the plug 380 back out of the arm rest hole 242.

Fabric Seat

Referring now to FIGS. 35 through 41, 43 through 47, and 49 through 53, a method of manufacturing the fabric seat 12 is provided. A variety of fabric materials 450 may be used with the fabric seat 12. The preferred fabric material 450, however, is a knit material 450. One example of a knit material 450 that may be used is the fabric manufactured by Milliken under the product name Flexnet. This knit fabric material 450 differs from woven fabric materials because the threads of the fabric 450 are interlocked together to prevent single threads from being pulled loose, as is possible with woven fabrics. The preferred fabric 450 also includes holes through the fabric 450 that are formed between the lateral and the longitudinal threads of the fabric 450. In addition, the lateral threads preferably include elastomer threads, while the longitudinal threads include polyester threads. The elastomer threads are desirable because they allow the fabric 450 to be stretched further in the lateral direction than in the longitudinal direction.

The fabric seat 12 includes a seat frame 454 and a cover 456 that grasps the fabric 450 around the circumference of the seat 12 in order to maintain a tight stretch in the fabric 450. Preferably, the seat frame 454 and the cover 456 are molded from a 20% glass filled polypropylene material, but other materials may be used also. The seat frame 454 also provides an attaching system for rigidly installing the seat 12 onto the frame 30, 340 of the chair 10, 300. To improve the comfort of the fabric seat 12, a cushion 458 is installed under the fabric 450 along the front of the seat 12 to provide a resting area for the user's legs.

The fabric 450 is securely attached to the seat frame 454 with a series of teeth 460, or grasping members 460, that have been provided around the circumference of the seat frame 454. The teeth 460 extend up from the seat frame 454 and are smoothly contoured so that the top of each tooth is rounded and smaller and the base of the tooth 460 is broader. In addition, each tooth 460 includes an undercut area 462 along the outside of the tooth 460. A raised ridge 464 is also provided along the inside of the teeth 460 that extends up to about the height of the teeth 460. A recessed channel 466 is formed between the teeth 460 and the raised ridge 464 which extends up from the base of the teeth 460 to the top of the raised ridge 464. Accordingly, the teeth 460 securely retain the fabric 450 by protruding up through the holes in the fabric 450 that are formed between the lateral and longitudinal threads. In addition, the undercut areas 464 prevent the fabric 450 from dislodging from the teeth 460 by securely grasping the fabric holes. The raised ridge 464 provides support for the fabric 450 when a user sits on the seat 12.

Once the fabric 450 has been installed onto the teeth 460 of the seat frame 454, the cover 456 is installed on top of the outer circumference of the seat frame 454. Preferably, the cover 456 is flexible and includes snaps so that it can be easily installed onto the frame 454. Clips 468 can also be provided along the bottom side of the seat 12 to further secure the seat frame 454 and the cover 456 together. Accordingly, the clips 468 snap into a receiver 455 on the seat frame 454 and a receiver 457 on the cover 456. Therefore, the cover 456 traps the fabric 450 between the seat frame 454 and the cover 456 to further prevent dislodging of the fabric 450. The cover 456 also provides a smooth exterior surface for both aesthetic purposes and to prevent the user from snagging his clothes on the fabric joint.

In order to simplify installation of the seat 12 onto the chair frame 30, 340, an attaching system that uses a headed pin 470 and tinnerman nut 472 is also provided. Therefore, four retention slots 474 are provided along the bottom side of the seat frame 454 for the headed pin 470. The retention slots 474 include a first hole 476 that is large enough for the head 469 of the pin 470 to pass through. A second hole 478 is also included that is connected to the first hole 476. The second hole 478 is smaller than the first hole and is about the diameter of the shaft 471 of the pin 470. Retention pads 480 separate the first 476 and second 478 holes. A retention tab 482 is also provided above the second hole 478.

Accordingly, the seat 12 is attached to the chair frame 30, 340 by first installing the headed pins 470 into the retention slots 474. Each pin 470 is installed by inserting the head 469 up through the first hole 476 of the retention slot, 424. The pin 470 is then pressed outward and into the second hole 478. The retention pads 480 provide a small amount of interference with the shaft 471 of the pin 470 so that the pin 470 must be snapped into the second hole 478. The retention pads 480 will then prevent the pin 470 from dislodging from the second hole 478. The seat 12 can then be installed onto the chair frame 30, 340 by inserting the shafts 471 of the pins 470 down through holes 484 in the chair frame 30, 340. The retention tabs 481 assist installation by obstructing upward movement of the head 469 of the pin 470. After the seat 12 has been installed onto the chair frame 30, 340, a tinnerman nut 472 can be pressed onto the bottom end of the pin 470 to prevent the seat 12 from being detached from the chair frame 30, 340. Because a significant amount of the force is usually required to press the tinnerman nut 472 onto the shaft 471 of the pin 470, it is preferable to use an assembly tool that contacts the top of the head 469 of the pin 470 to resist the pressing force. Alternatively, the retention tab 482 can also be used to resist the pressing force, thereby eliminating the need for the assembly tool.

Figure 47:
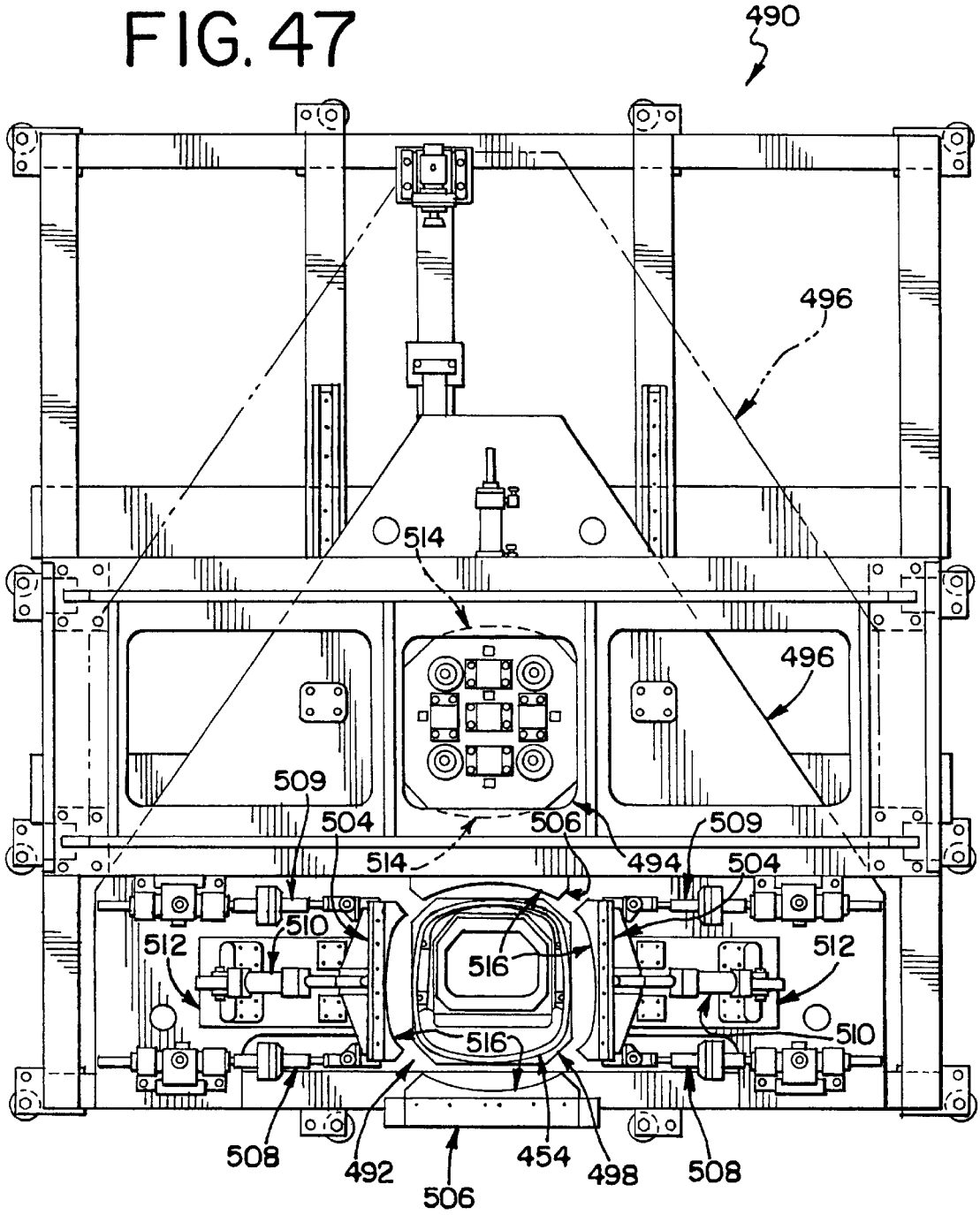
FIG. 47 is a top plan view of a machine for installing the fabric onto the seat frame.
Figure 49:
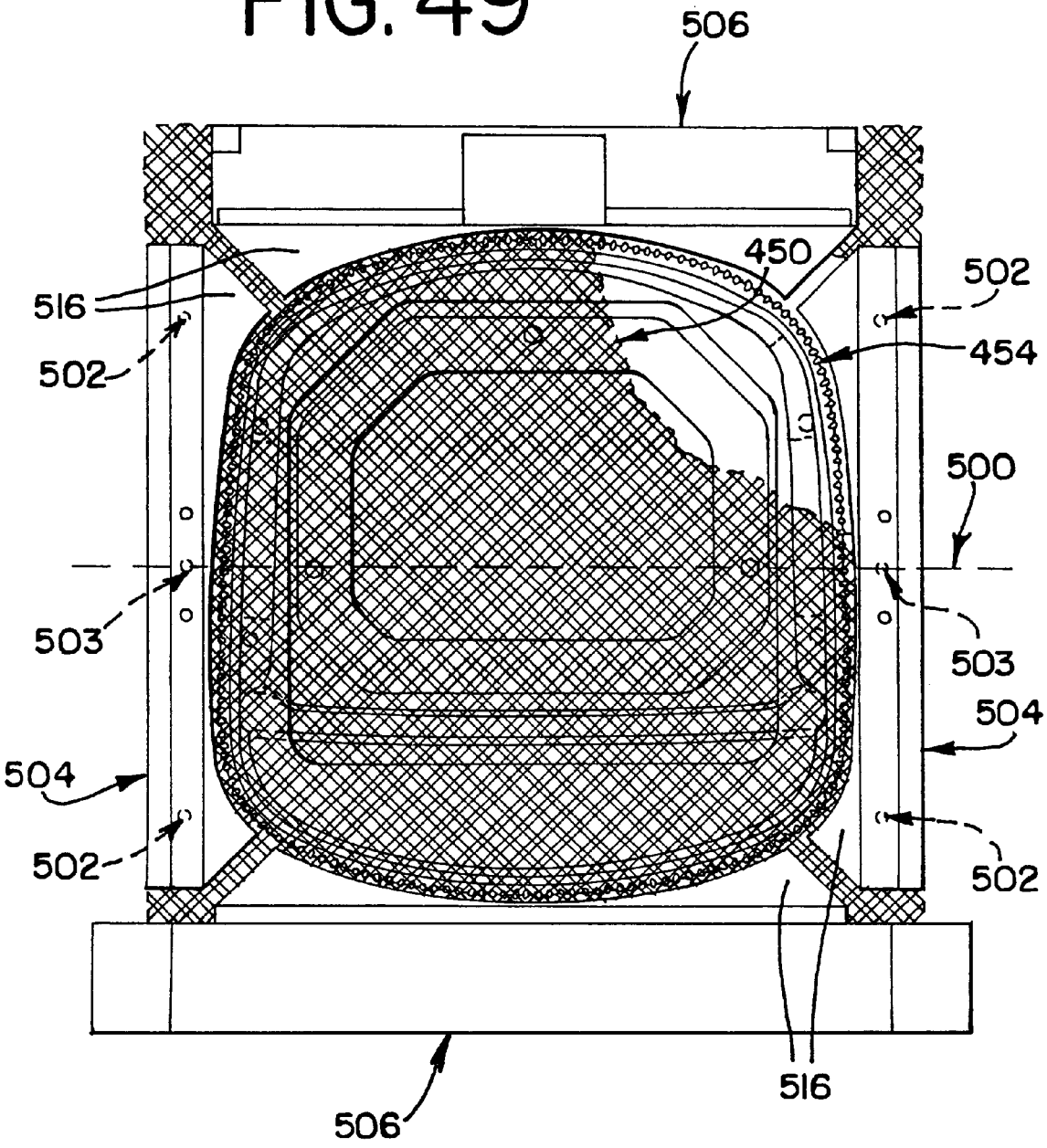
FIG. 49 is a top plan view of a portion of the machine, showing the seat frame installed on a support and the fabric engaged by a set of front and rear clamps and a set of side clamps.

Turning now to FIGS. 47 and 49 through 53, a method of attaching the fabric 450 to the seat frame 454 is provided. As shown in FIGS. 47 and 48, a machine 490 is included for easily and reliably installing the fabric 450 onto the series of teeth 460. The machine 490 uses hydraulics for most of the clamping and moving functions but other sources of power could also be used. The machine 490 installs the fabric 450 onto the seat frame 454 in a two station operation 492, 494. The first station 492 is a loading and pre-stretching station. The second station 494 is located rearward from the first station 492 and includes a pressing member 514 that forces the fabric 450 onto the teeth 460 of the seat frame 454. To move the seat frame 454 and the fabric 450 from the first station 492 to the second station 494, a moveable base 496 is provided that is mounted onto rails (not shown) and is moved back and forth with a cylinder (not shown). The clamps 504, 506 and the support 498 for the seat frame 545 are attached to the moveable base 496 so that the entire assembly moves between the two stations 492, 494.

The machine 490 is operated by first positioning the seat frame 454 down onto the support 498. In order to fully support the entire circumference of the seat frame 454, the support 498 is made form a poured urethane so that the shape of the support 498 matches the exterior of the bottom of the seat frame 454. Rigid locators are also included on the support 498 along the interior of the seat frame 454 to further position the seat frame 454 in the desired location.

Once the seat frame 454 has been accurately positioned, a rectangular piece of fabric 450 is laid over the seat frame 454. Because the fabric 450 has visually discernible lateral threads and longitudinal threads, accurate positioning of the fabric 450 relative to the seat frame 454 is important to satisfy appearance criteria for the seat 12. Therefore, a laser beam 500 is provided that shines a visible line laterally across the top of the fabric 450. The operator can then use the laser beam 500 as a guide to visually line up the lateral threads of the fabric 450 with the laser beam 500 to ensure that the fabric 450 is straight.

Clamping pins 502, 503 are also attached to the bottom face of each of the side clamps 504. The clamping pins 502, 503 extend upward and are received by recessed pockets in the top face of the corresponding side clamp 504 when the clamps 504 are engaged. Three sets of clamping pins 502, 503 are included, with the first set 502 being located along the front end of the side clamps 504, the second set 502 being located along the rear end of the side clamps 504, and the third set 503 being located at the center of the side clamps 504. The center clamping pins 503 are used in conjunction with the laser beam 500 to accurately position the fabric 450. Accordingly, the laser beam 500 shines over the two center clamping pins 503 so that the operator can line up the threads with the beam 500 and then secure the alignment by pressing the fabric 450 down onto each of the center clamping pins 502. Therefore, the pins 502, 503 are approximately equal in diameter to the holes in the fabric 450 so that the fabric 450 can be easily but securely pressed onto the clamping pins 502, 503. After aligning the fabric 450, the operator then presses the fabric 450 onto the front and rear sets of clamping pins 502.

The fabric 450 is next pre-stretched in an over-stretching operation. The pre-stretch applies an excess stretch to the fabric 450 that is higher than the final stretch to prevent the fabric 450 from loosening and losing its final stretch over time. Accordingly, the front and rear clamps 506 engage the fabric 450 and apply a small amount of initial tension to the fabric 450 before the side clamps 504 engage. This initial forward and rearward tension is helpful in order to evenly spreading out the fabric 450 along the length of the side clamps 504. Next, the side clamps 804 also engage the fabric 450. The fabric 450 is then prestretched by the clamps 504, 506. Experimental tests with the fabric 450 described above have determined that a pre-stretch of about 20% for the lateral threads and 10% for the longitudinal threads adequately prevents loosening of the fabric 450 over time. Therefore, the front and rear clamps 506 and the side clamps 504 are pulled away from each other so that the fabric 450 is stretched 20% in the lateral direction and 10% in the longitudinal direction for a short period of time. In this pre-stretch operation the seat frame 454 is positioned slightly below the fabric 450 to avoid interference between the fabric 450 and the seat frame 454.

After the pre-stretch operation is complete, the clamps 504, 506 release the tension on the fabric 450. The moveable base 496, along with the support 498 and the clamps 504, 506 is then moved rearward to the second station 494. Next, the final stretch is applied to the fabric 450. The amount of final stretch to be used is determined primarily based on comfort tests of the stretched seat 12. Accordingly, a higher stretched fabric 450 results in a stiffer, more rigid seat 12; and a lower stretch results in a softer, more compliant seat 12. Comfort tests have determined that a final stretch of about 6% to 8% from side-to-side and about 4% from the front-to-back is preferred. Alternatively, a non-constant final stretch can be provided, with the side-to-side stretch being about 10% near the front of the seat 12% and 6% near the back of the seat 12. In this alternative final stretch, the front-to-back stretch is about 4%.

Accordingly, the front and rear clamps 506 and the side clamps 504 are pulled away from each other to achieve the desired final stretch. The present machine 490 does not use actual measurements of stretch to apply the desired stretch to the fabric 450. Instead, the stretch is achieved by applying a predetermined amount of pressure to the tensioning cylinders. The amount of pressure to be applied is determined by experimental testing and is chosen to correspond to the desired amount of fabric stretch. This system provides a relatively easy method for controlling the fabric stretch and results in a consistent amount of final stretch in the seats 12.

To apply a non-constant lateral stretch, separate side tensioning cylinders 508, 509 are provided. Thus, a front set of tensioning cylinders 508 are provided along the front side of the side clamps 504, and a rear set of tensioning cylinders 509 are provided along the rear side of the side clamps 504. The tensioning cylinders 508, 509 are connected at one end to the moveable base 496 and are connected at the other end to a side clamp 504. Accordingly, the front and rear side tensioning cylinders 508, 509 can be used to apply a non-constant lateral stretch by applying a different amount of pressure to the front set of tensioning cylinders 508 than to the rear set of tensioning cylinders 509. To accommodate this non-constant stretch, the side clamps 504 and the clamping cylinders 510 are mounted onto rotatable bases 512. Thus, the rotatable bases 512, along with the corresponding side clamps 504 and clamping cylinders 510, are capable of moving outward as the stretch is applied and rotating as the lateral stretch differs from front to rear.

Figures 50, 51, 52, 53:
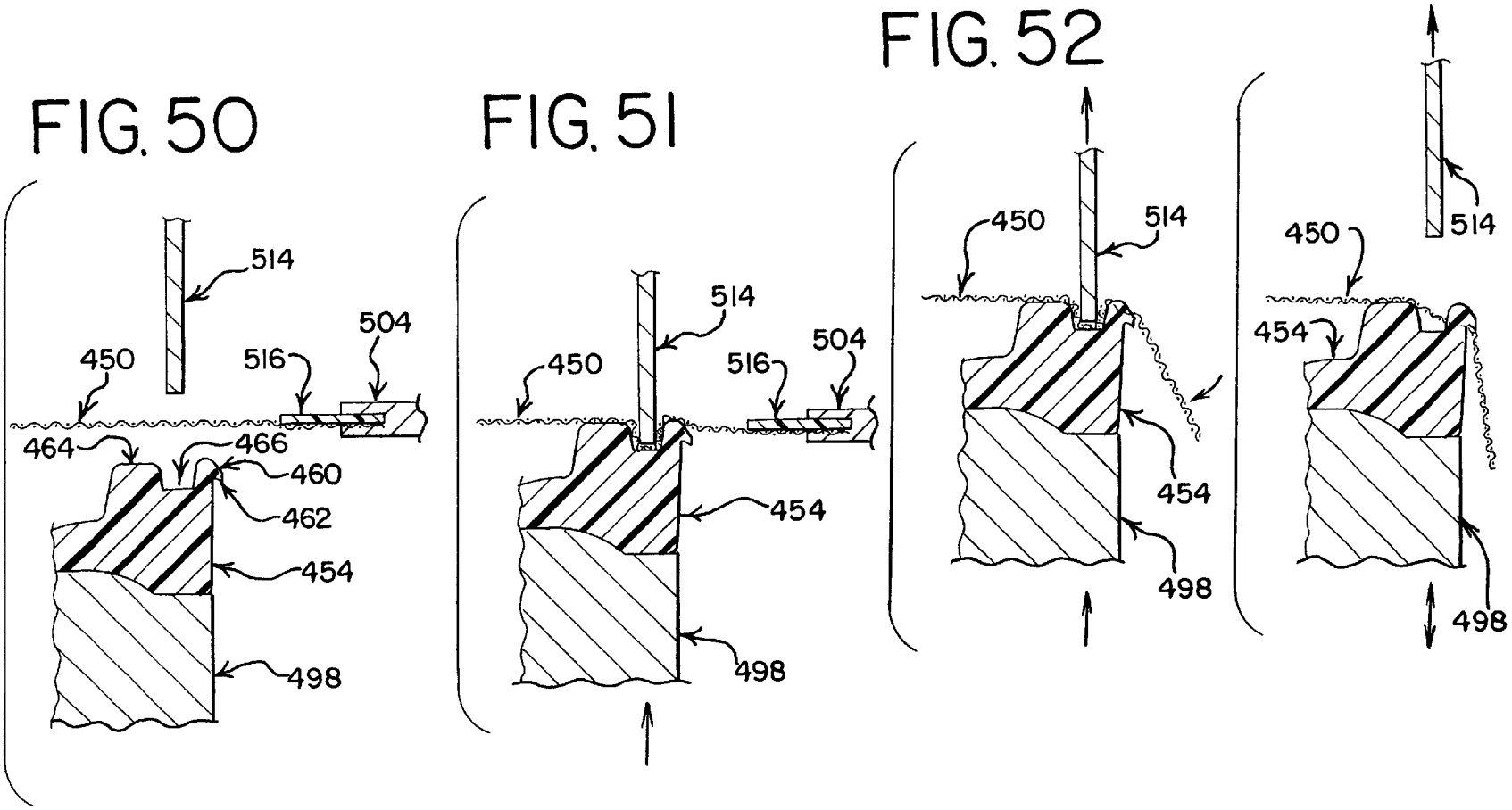
FIG. 50 is a cross-sectional view of a portion of the machine, showing a pressing member above the fabric and the seat frame below the fabric.
FIG. 51 is a cross-sectional view of a portion of the machine, showing the seat frame raised so that the pressing member is within a recessed channel.
FIG. 52 is a cross-sectional view of a portion of the machine, showing the seat frame and the pressing member raised and the outside edge of the fabric pulled down around the circumference of the seat frame.
FIG. 53 is a cross-sectional view of a portion of the machine, showing the pressing member raised away from the seat frame and the seat frame reciprocated into the fabric.

Once the final stretch has been applied to the fabric 450, the fabric 450 is installed onto the seat frame 454 by forcing the fabric 450 down over the series of teeth 460 on the seat frame 454. As shown in FIG. 50, the pressing member 514, or blade 514, is first lowered so that it is positioned slightly above the stretched fabric 450. The pressing member 514 is approximately the width of the recessed channel 466 so that the pressing member 514 can be pressed down into the channel 466 during installation of the fabric 450. Although the recessed channel 466 extends around the entire circumference of the seat frame 454, it has been determined that the pressing member 514 is unnecessary for the installation procedure around the sides of the seat frame 454. Therefore, the pressing member 514 has been provided as a front member 514 and a rear member 514 that are formed in a semi-circumference shape that matches the recessed channel 466 along the front and the rear of the seat frame 454.

As shown next in FIG. 51, the support 498 is then moved upwards so that the seat frame 454 is forced into the fabric 450. This causes the teeth 460 and the recessed channel 466 to move upwards until the pressing member 514 enters the recessed channel 466 and abuts against the bottom of the channel 466. The fabric 450 is then pressed down into the recessed channel 466 so that the fabric 450 is compressed between the pressing member 514 and the seat frame 454.

As shown next in FIG. 52, a small amount of down force is applied to the pressing member 514. A higher amount of upward force, however, is applied to the support 498 so that the seat frame 454 and the pressing member 514 move upward together. At the same time the seat frame 454 and pressing member 514 move up, the pressure on the tensioning cylinders are released and the tensioning cylinders move the clamps 504, 506 inward towards the seat frame 454. To control the position of the outside edge of the fabric 456, guide members 516 have been provided that are attached to the top of each of the clamps 504, 506. The guide members 516 are shaped to approximately match the outer circumference of the seat frame 454. Thus, as the seat frame 454 moves up and the clamps 504, 506 move in, the guide members 516 will pull the fabric 450 down tightly around the circumference of the seat frame 454.

As a result of pressing the fabric 450 down into the recessed channel 466 behind the teeth 460 and pressing the fabric 450 down around the outside of the teeth 460, the fabric 450 is pulled down over the teeth 460. The teeth 460 will then protrude up through the holes in the fabric 450 which are formed between the lateral and longitudinal threads. Sometimes the teeth 460 do not fully protrude through the fabric 450, however. Therefore, a finishing procedure is provided that is shown in FIG. 53. Accordingly, the pressing member 514 is raised upward away from the seat frame 454. The support 498 is then reciprocated in two cycles about 1 inch upward and downward with the guide members 516 still pulling down on the outside of the fabric 450. The speed of each cycle takes about 1 second to complete. These reciprocating motions further force the fabric 450 down over the teeth 460 so that the teeth 460 fully protrude up through the fabric 450.

To release the seat frame 454 and the installed fabric 450 from the machine 12, the support 498 is lowered, the moveable base 496 is moved back to the first station 492, and the clamps 504, 506 are disengaged. The fabric 450 is then trimmed along the outside of the teeth 460 so that about 0.75 inch of excess fabric 450 remains around the outside of the teeth 460. The cover 456 is then installed onto the seat frame 454, and the seat 12 is installed onto the chair frame 30, 340 as previously described.

While a preferred embodiment of the invention has been described, it should be understood that the invention is not so limited, and modifications may be made without departing from the invention. The scope of the invention is defined by the appended claims, and all devices that come within the meaning of the claims, either literally or by equivalence, are intended to be embraced therein.

We claim:

1. A chair comprising: a back having a hole, a frame received through said hole wherein said frame comprises an interior cavity, an arm rest comprising a connecting member received through said hole and into said interior cavity, and a nose connecting said connecting member to said frame and thereby locking said arm rest to said chair; wherein said hole in said back comprises a ledge with a bottom surface and a top surface, said connecting member comprises a frame stop surface and a back stop surface, said frame comprises a top mounting surface; wherein said bottom surface of said ledge abuts said top mounting surface, said frame stop surface is adjacent to and/or abuts said top mounting surface, and said back stop surface is adjacent to and/or abuts said top surface of said ledge.

2. A chair comprising: a back having a hole, a frame received through said hole wherein said frame comprises an interior cavity, an arm rest comprising a connecting member received through said hole and into said interior cavity, and a nose connecting said connecting member to said frame and thereby locking said arm rest to said chair; wherein said connecting member comprises tapered surfaces and said interior cavity comprises corresponding tapered surfaces.

3. The chair according to claim 2 wherein said tapered surfaces comprise flat tapered surfaces on opposite sides and comprise rounded tapered surfaces on opposite sides adjacent to said flat tapered surfaces.

4. A chair comprising: a back having a hole, a frame received through said hole wherein said frame comprises an interior cavity, an arm rest comprising a connecting member received through said hole and into said interior cavity, and a nose connecting said connecting member to said frame and thereby locking said arm rest to said chair; wherein said nose engages a receiver thereby locking said connecting member to said frame; wherein said nose and said receiver are misaligned from each other by a first offset distance in a first installed position with one being offset from the other; wherein said nose and said receiver are misaligned by a second offset distance in a second installed position, said second offset distance being less than said first offset distance.

5. The chair according to claim 4 wherein said first offset distance misalignment is about 0.035 inch.

6. The chair according to claim 4 wherein said first offset distance between said nose and said receiver comprises a misalignment from each other with one being offset to the side of the other.

7. The chair according to claim 6 wherein said side first offset distance misalignment is about 0.030 inch.

8. The chair according to claim 6 wherein said second installed position rotates said arm rest inwards so that side impacts to the arm rest are not absorbed by said nose.

9. The chair according to claim 4 wherein said first offset distance between said nose and said receiver comprises a misalignment from each other with one being offset below the other and said first offset distance between said nose and said receiver comprises a misalignment from each other with one being offset to the side of the other.

10. The chair according to claim 9 wherein said below first offset distance misalignment is about 0.035 inch and said side first offset distance misalignment is about 0.030 inch.

11. The chair according to claim 9 wherein said nose comprises one end of a set screw.

12. The chair according to claim 11 further comprising a threaded hole in said frame receiving said set screw and wherein said receiver comprises a tapered hole in said connecting member.

13. The chair according to claim 4 wherein said nose comprises one end of a detent assembly; wherein said detent assembly comprises a rounded nose.

14. The chair according to claim 4 wherein said nose comprises one end of a detent assembly; wherein said detent assembly comprises an angled nose and a straight portion next to said angled nose.

15. The chair according to claim 1 wherein said ledge comprises a detent ramp extending through the ledge thereby forcing said nose inwards and easing the nose past said top surface of the ledge.

16. The chair according to claim 1 wherein said back comprises a cavity extending above a bottom side of the back thereby allowing access to said nose and a receiver.

17. A chair comprising: a back having a hole, a frame received through said hole wherein said frame comprises an interior cavity, an arm rest comprising a connecting member received through said hole and into said interior cavity, and a nose connecting said connecting member to said frame and thereby locking said arm rest to said chair; wherein said frame comprises an anti-rotation slot and said connecting member comprises an anti-rotation tab received by said anti-rotation slot thereby restraining rotation of said connecting member.

18. The chair according to claim 1 wherein said connecting member comprises a guide pad having an angled side, said ledge in said back comprises an angled side, wherein a wedge is formed between said angled side of the guide pad and said angled side of said ledge when a downward force is applied to the arm rest.

19. The chair according to claim 18 wherein said guide pad comprises a flat side wherein said wedge is formed between the flat side of the guide pad and a side of one ledge and said angled side of the guide pad and said angled side of another ledge.

20. The chair according to claim 18 wherein said angled sides of said guide pad and said ledge rotate said arm rest inwards so that side impacts to the arm rest are not absorbed by the angled sides.

21. A chair comprising: a back having a hole, a frame received through said hole wherein said frame comprises an interior cavity, an arm rest comprising a connecting member received through said hole and into said interior cavity, and a nose connecting said connecting member to said frame and thereby locking said arm rest to said chair; further comprising an O-ring compressed between said connecting member and said interior cavity.

22. The chair according to claim 21 wherein said O-ring is disposed on said connecting member and is angled with one side of the O-ring being below the other side of the O-ring.

23. The chair according to claim 1 further comprising compressible wedges compressed between said connecting member and said hole in said back.

24. The chair according to claim 23 wherein said wedges are formed into an inner diameter of said ledge and are narrow ramp-shaped portions thereby compressing against a guide diameter of said connecting member.

25. The chair according to claim 1 wherein said connecting member comprises tapered surfaces and said interior cavity comprises corresponding tapered surfaces; and said nose engages a receiver thereby locking said connecting member to said frame.

26. The chair according to claim 25 wherein said tapered surfaces comprise flat tapered surfaces on opposite sides and rounded tapered surfaces on opposite sides adjacent to said flat tapered surfaces, said nose and said receiver are misaligned from each other in their expected installation positions, said nose comprises one end of a set screw, said frame comprises a threaded hole receiving said set screw, and said receiver comprises a tapered hole in said connecting member.

27. The chair according to claim 26 wherein said side misalignment rotates said arm rest inwards so that side impacts to the arm rest are not absorbed by said nose, said frame comprises an anti-rotation slot and said connecting member comprises an anti-rotation tab received by said anti-rotation slot thereby restraining the rotation of said connecting member.

28. The chair according to claim 27 further comprising compressible wedges compressed between said connecting member and said hole in said back, wherein said wedges are formed into an inner diameter of said ledge and are narrow ramp-shaped portions that compress against a guide diameter of said connecting member.

29. The chair according to claim 1 wherein said connecting member is non-tapered and said interior cavity is non-tapered.

30. The chair according to claim 29 wherein said nose engages a receiver thereby locking said connecting member to said frame and said nose comprises one end of a detent assembly.

31. The chair according to claim 30 wherein said detent assembly comprises an angled nose and a straight portion next to said angled nose, said detent assembly is attached to said connecting member, said receiver comprises a hole through said frame, and said ledge comprises a detent ramp extending through the ledge thereby forcing said nose inwards and easing the nose past said top surface of the ledge.

32. The chair according to claim 31 wherein said back comprises a cavity extending above a bottom side of the back thereby allowing access to said nose and said receiver, said frame comprises an anti-rotation slot and said connecting member comprises an anti-rotation tab received by said anti-rotation slot thereby restraining the rotation of said connecting member, said connecting member comprises a guide pad with an angled side and said ledge in said back includes an angled side wherein a wedge is formed between said angled side of the guide pad and said angled side of said ledge when a downward force is applied to the arm rest, said guide pad comprises a flat side wherein said wedge is formed between the flat side of the guide pad and a side of one ledge and said angled side of the guide pad and said angled side of another ledge, and said angled sides of said guide pad and said ledge are positioned to rotate said arm rest inwards so that side impacts to the arm rest are not absorbed by the angled sides.

33. The chair according to claim 32 further comprising an O-ring disposed on said connecting member and compressed between said connecting member and said interior cavity wherein one side of the O-ring is angled below the other side of the O-ring and compressible wedges compressed between said connecting member and said hole in said back wherein said wedges are formed into an inner diameter of said ledge and are narrow ramp-shaped portions that compress against a guide diameter of said connecting member.

34. A chair comprising: a back having a hole, a frame received through said hole wherein said frame comprises an interior cavity, and a plug received through said hole and into said interior cavity; wherein said plug comprises a spring member attached to said plug along one end and cantilevered therefrom wherein said spring member is angled outward from said attached and cantilevered end and a detent nose is disposed along an unattached end of said spring member.

35. The chair according to claim 34 wherein said hole in said back comprises a ledge having a bottom surface and a top surface, said plug comprises a frame stop surface and a back stop surface, said frame comprises a top mounting surface, wherein said bottom surface of said ledge abuts said top mounting surface, said frame stop surface is near to or abuts said top mounting surface, and said back stop surface is near to or abuts said top surface of said ledge.

36. The chair according to claim 34 wherein said frame comprises a hole receiving said detent nose.

37. The chair according to claim 34 wherein said back comprises a cavity extending above a bottom side of the back thereby allowing access to said detent nose and a receiver.

38. The chair according to claim 34 wherein said frame comprises an anti-rotation slot and said plug comprises an anti-rotation tab received by said anti-rotation slot thereby restraining the rotation of said plug.

39. The chair according to claim 34 wherein said back comprises two of said holes each comprising an installation slot in opposite positions and said plug comprises an installation tab thereby allowing a single plug to be received into either of the two holes in opposite orientations.

40. The chair according to claim 34 wherein said detent nose comprises a catch surface engaging an outside surface of said frame.

41. The chair according to claim 34 wherein said plug comprises tapered surfaces and said interior cavity comprises corresponding tapered surfaces.

42. The chair according to claim 34 wherein said plug is non-tapered and said interior cavity is non-tapered.

43. The chair according to claim 42 wherein said plug comprises guide pads contacting interior surfaces of said interior cavity along an end away from said attached and cantilevered end and near said unattached end of said spring member.

44. The chair according to claim 34 wherein said hole in said back comprises a ledge having a bottom surface and a top surface, said plug comprises a frame stop surface and a back stop surface, said frame comprises a top mounting surface; wherein said bottom surface of said ledge abuts said top mounting surface, said frame stop surface is near to or abuts said top mounting surface, and said back stop surface is near to or abuts said top surface of said ledge; said frame comprises a hole receiving said detent nose; and said frame comprises an anti-rotation slot and said plug comprises an anti-rotation tab received by said anti-rotation slot thereby restraining the rotation of said plug.

45. The chair according to claim 44 wherein said back comprises a cavity extending above a bottom side of the back thereby allowing access to said detent nose and said receiving hole and said detent nose comprises a catch surface engaging an outside surface of said frame.

46. The chair according to claim 45 wherein said back comprises two of said holes each comprising an installation slot in opposite positions and said plug comprises an installation tab received by said installation slot wherein a single plug can be received into either of the two holes in opposite orientations.

47. The chair according to claim 46 wherein said plug comprises tapered surfaces and said interior cavity comprises corresponding tapered surfaces.

48. The chair according to claim 46 wherein said plug is non-tapered and said interior cavity is non-tapered.

* * * * *